US011992105B2

(12) United States Patent
Fisher et al.

(10) Patent No.: US 11,992,105 B2
(45) Date of Patent: May 28, 2024

(54) MODULAR LUGGAGE FRAME

(71) Applicant: JJEM, LLC—IP, New Lenox, IL (US)

(72) Inventors: Ethan Fisher, New Lenox, IL (US); Patrick Harris, Downers Grove, IL (US); Vern Thomas Hammett, Jr., New Lenox, IL (US)

(73) Assignee: JJEM, LLC—IP, New Lenox, IL (US)

( * ) Notice: Subject to any disclaimer, the term of this patent is extended or adjusted under 35 U.S.C. 154(b) by 153 days.

(21) Appl. No.: 17/154,740

(22) Filed: Jan. 21, 2021

(65) Prior Publication Data

US 2021/0219683 A1 Jul. 22, 2021

Related U.S. Application Data

(60) Provisional application No. 62/963,832, filed on Jan. 21, 2020.

(51) Int. Cl.

| | |
|---|---|
| ***A45C 7/00*** | (2006.01) |
| ***A45C 5/02*** | (2006.01) |
| ***A45C 5/14*** | (2006.01) |
| ***A45C 13/26*** | (2006.01) |

(52) U.S. Cl.

CPC ..... *A45C 7/005* (2013.01); *A45C 5/02* (2013.01); *A45C 7/0036* (2013.01); *A45C 5/143* (2013.01); *A45C 13/262* (2013.01)

(58) Field of Classification Search

CPC ..... A45C 7/005; A45C 5/02; A45C 7/0036; A45C 5/143; A45C 13/262

See application file for complete search history.

(56) References Cited

U.S. PATENT DOCUMENTS

| | | | | | |
|---|---|---|---|---|---|
| 319,524 | A * | 6/1885 | Steel | B62B 1/10 | 280/47.27 |
| 2,537,750 | A * | 1/1951 | Gretschel | A45C 13/22 | 292/49 |
| 3,759,416 | A * | 9/1973 | Constantine | B65D 21/0219 | 206/508 |
| 3,935,613 | A * | 2/1976 | Kaneko | B60B 33/0002 | 16/30 |
| 4,299,313 | A | 11/1981 | Null | | |

(Continued)

FOREIGN PATENT DOCUMENTS

| | | |
|---|---|---|
| EP | 2522248 | 11/2012 |
| EP | 3106053 | 12/2016 |

*Primary Examiner* — Tri M Mai

(74) *Attorney, Agent, or Firm* — Hanley, Flight & Zimmerman, LLC

(57) ABSTRACT

Methods, apparatus, systems, and articles of manufacture for a modular luggage frame are disclosed and described. An example luggage includes a first portion and a second portion. The first portion includes: a first side including a first rib and a second rib; and a second side including a third rib and a fourth rib, the first rib and the third rib forming a first pair of ribs and the second rib and the fourth rib forming a second pair of ribs. The second portion includes: a third side including a fifth rib; a fourth side including a sixth rib, the fifth rib and the sixth rib forming a third pair of ribs. The third pair of ribs aligns with a selected one of the first pair of ribs or the second pair of ribs to removably affix the first portion to the second portion to form the modular luggage frame.

12 Claims, 57 Drawing Sheets

(56) References Cited

U.S. PATENT DOCUMENTS 4,422,212 A * 12/1983 Sheiman ..... A45C 5/143 280/37
4,749,097 A * 6/1988 Rosman ..... B65D 7/02 220/573.1
4,982,863 A * 1/1991 Skillius ..... B65D 25/32 220/675
5,082,094 A * 1/1992 Nechushtan ..... A45C 7/005 190/22
5,755,311 A * 5/1998 Younessian ..... E05B 65/5238 190/122
5,799,848 A * 9/1998 Wills ..... B60R 9/055 224/329
5,813,504 A * 9/1998 Iny ..... A45C 5/14 16/408
6,050,373 A * 4/2000 Wonka ..... A45C 7/005 190/117
6,202,254 B1 3/2001 Ezer
6,575,274 B1 6/2003 Huang
7,077,251 B1 * 7/2006 Gaither ..... A45C 13/002 150/105
7,367,467 B2 * 5/2008 Bashuk ..... B60R 11/06 220/4.03
2003/0085089 A1 5/2003 Lin et al.
2003/0132080 A1 7/2003 Dababneh
2004/0181906 A1 9/2004 Kuo et al.
2004/0238304 A1 12/2004 Fisher
2005/0011043 A1 1/2005 Comstock
2005/0016809 A1 1/2005 Wu
2005/0082776 A1 4/2005 Nordstrom et al.
2013/0292220 A1 * 11/2013 Kerley ..... A45C 5/14 190/108
2015/0353232 A1 * 12/2015 Kandel ..... A47G 23/06 47/65.5
2017/0367450 A1 12/2017 Karl
2019/0328099 A1 10/2019 Tayne

* cited by examiner

MODULAR LUGGAGE FRAME

CROSS REFERENCE TO RELATED APPLICATIONS

This patent claims the benefit of priority to U.S. Provisional Patent Application No. 62/963,832, filed on Jan. 21, 2020, entitled "Modular Luggage Frame," which is herein incorporated by reference in its entirety for all purposes.

FIELD OF THE DISCLOSURE

This disclosure relates generally to a luggage apparatus, and, more particularly, to a modular luggage frame and associated methods of manufacture and/or assembly.

BACKGROUND

The statements in this section merely provide background information related to the disclosure and may not constitute prior art.

Carry-on luggage is popular with travelers of all types, including airline professionals (e.g., pilots and crew) as well as passengers. Carry-on luggage is to fit beneath an airplane seat or in an overhead compartment of an airplane or other transportation vehicle (e.g., bus, train, etc.). Carry-on luggage can be soft-sided or hard-sided. Soft-sided carry-on luggage (also referred to as a soft-sided carry-on bag, soft-sided case, etc.) typically includes an inner frame surrounded by an outer shell made of a flexible material such as leather, fabric, etc. Soft-sided carry-on luggage is typically lighter than hard-sided luggage of similar size, and the flexibility provided by the outer shell or wrap allows the soft-sided luggage to fit into small or irregularly shaped spaces not accessible to similar-sized hard-sided luggage.

It is desirable to provide an improved luggage construction, in particular an improved luggage frame that improves existing luggage structures and methods of manufacture and/or assembly.

BRIEF DESCRIPTION

Certain examples provide a modular luggage frame including a first portion and a second portion. The example first portion includes: a first back surface; a first side including a first rib and a second rib; a second side including a third rib and a fourth rib, the first rib and the third rib forming a first pair of ribs and the second rib and the fourth rib forming a second pair of ribs; and a first opening. The example second portion includes: a second back surface; a third side including a fifth rib; a fourth side including a sixth rib, the fifth rib and the sixth rib forming a third pair of ribs; and a second opening. In the example modular luggage frame, the third pair of ribs aligns with a selected one of the first pair of ribs or the second pair of ribs to removably affix the first portion to the second portion to form the modular luggage frame. For example, the third pair of ribs aligns with the first pair of ribs to form the modular luggage frame of a first size, and the third pair of ribs aligns with the second pair of ribs to form the modular luggage frame of a second size. The modular luggage frame aligning the first back surface and the second back surface and the first opening and the second opening when the first portion and the second portion are removably affixed.

Certain examples provide a modular luggage frame including: a first modular luggage means; and a second modular luggage means. In the example modular luggage frame, the first modular luggage means is removably affixable to the second modular luggage means in at least a first position and a second position to vary a size of the modular luggage frame.

Certain examples provide a modular luggage apparatus including a first portion and a second portion assembled by aligning ribs of the first portion with ribs of the second portion to adjustably set a size and immobilize the first portion with respect to the second portion. The example first portion and the example second portion together form a main surface, sides, and an opening.

Figure 1A:
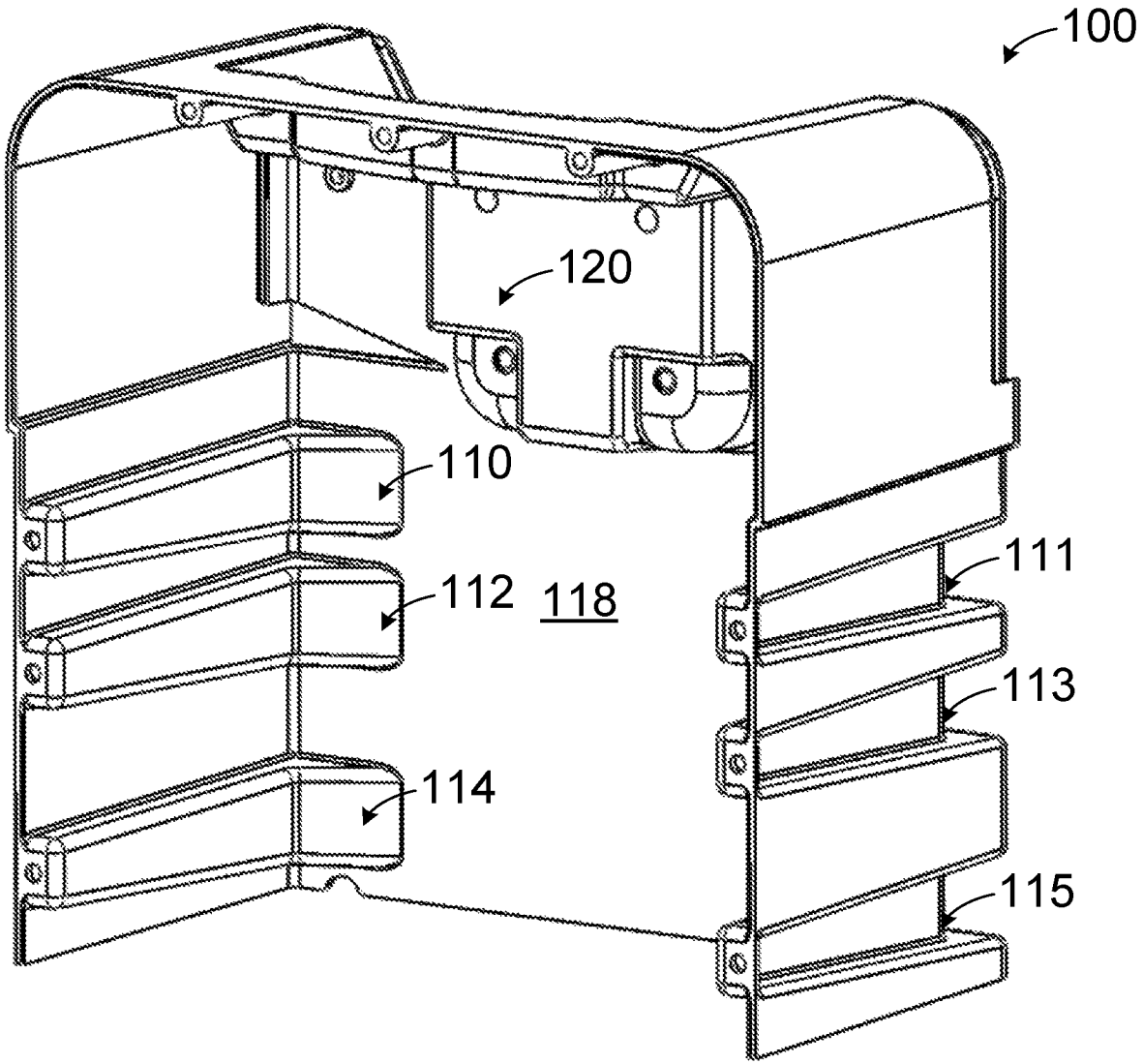
FIGS. 1A-4C illustrate example views of a modular luggage frame.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Stating that any part is in "contact" with another part means that there is no intermediate part between the two parts. Although the figures show layers and regions with clean lines and boundaries, some or all of these lines and/or boundaries may be idealized. In reality, the boundaries and/or lines may be unobservable, blended, and/or irregular.

Descriptors "first," "second," "third," etc. are used herein when identifying multiple elements or components which may be referred to separately. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

DETAILED DESCRIPTION

In the following detailed description, reference is made to the accompanying drawings that form a part hereof, and in which is shown by way of illustration specific examples that may be practiced. These examples are described in sufficient detail to enable one skilled in the art to practice the subject matter, and it is to be understood that other examples may be utilized and that changes may be made without departing from the scope of the subject matter of this disclosure. The following detailed description is, therefore, provided to describe example implementations and not to be taken as limiting on the scope of the subject matter described in this disclosure. Certain features from different aspects of the following description may be combined to form yet new aspects of the subject matter discussed below.

Certain examples provide a modular luggage frame. Certain examples provide a modular luggage frame designed to be manufactured as a defined number of pieces that can be dynamically arranged in a plurality of ways to provide carry-on luggage of varying sizes. For example, a two-piece modular luggage frame can be dynamically fit together to provide a plurality of sizes for luggage made from the same two-piece frame.

FIG. 1A illustrates a first portion 100 of an example modular luggage frame. The example first portion 100 (e.g., also referred to as a top portion or upper portion) is formed to include a plurality of ribs 110-115. The ribs 110-115 are arranged in pairs 110-111, 112-113, 114-115 in which the ribs 110-115 in each pair are positioned opposite each other along the longitudinal sides of the first portion 100 of the luggage.

As shown in the example of FIG. 1A, the ribs 110-115 form indentations in the luggage portion or section 100 which taper from a back or main surface 118 of the first luggage portion 100 to a front or open end of the first portion 100. In other examples, the ribs 110-115 can be implemented in a uniform shape and size from front to back along sides of the first portion 100.

As shown in the example of FIG. 1A, the ribs 110-115 can have a first indented portion along the back 118 of the luggage portion 100 and a second indented portion along a side of the luggage portion 100. In certain examples, the second indented portion is longer than the first indented portion (e.g., as shown in FIG. 1A). As shown in the example of FIG. 1A, the ribs 110-115 are spaced to provide a space or gap between each of the ribs 110, 112, 114 on a first side of the example portion 100 and between each of the ribs 111, 113, 115 on a second side of the example portion 100.

Figure 1B:
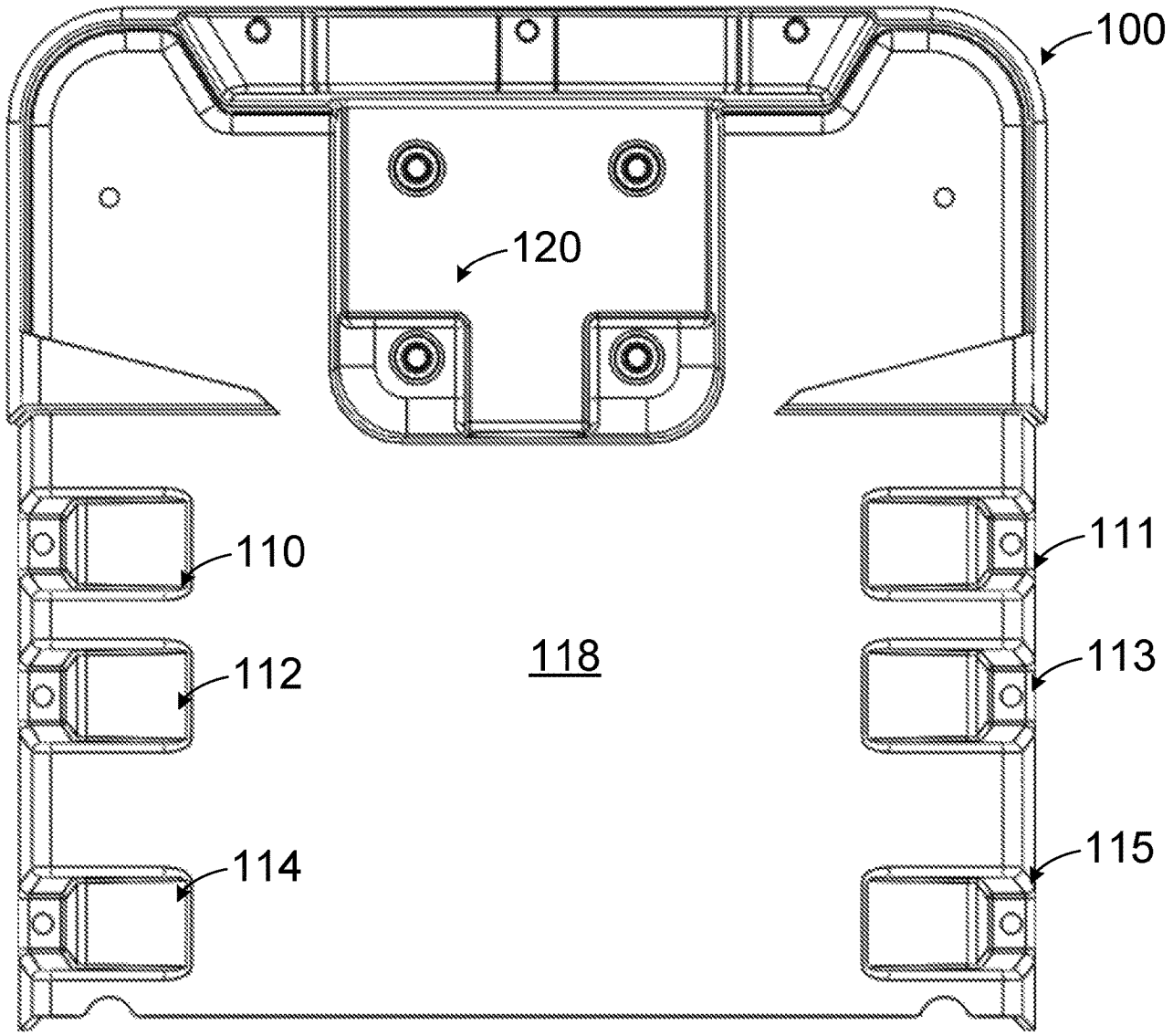
Figure 1C:
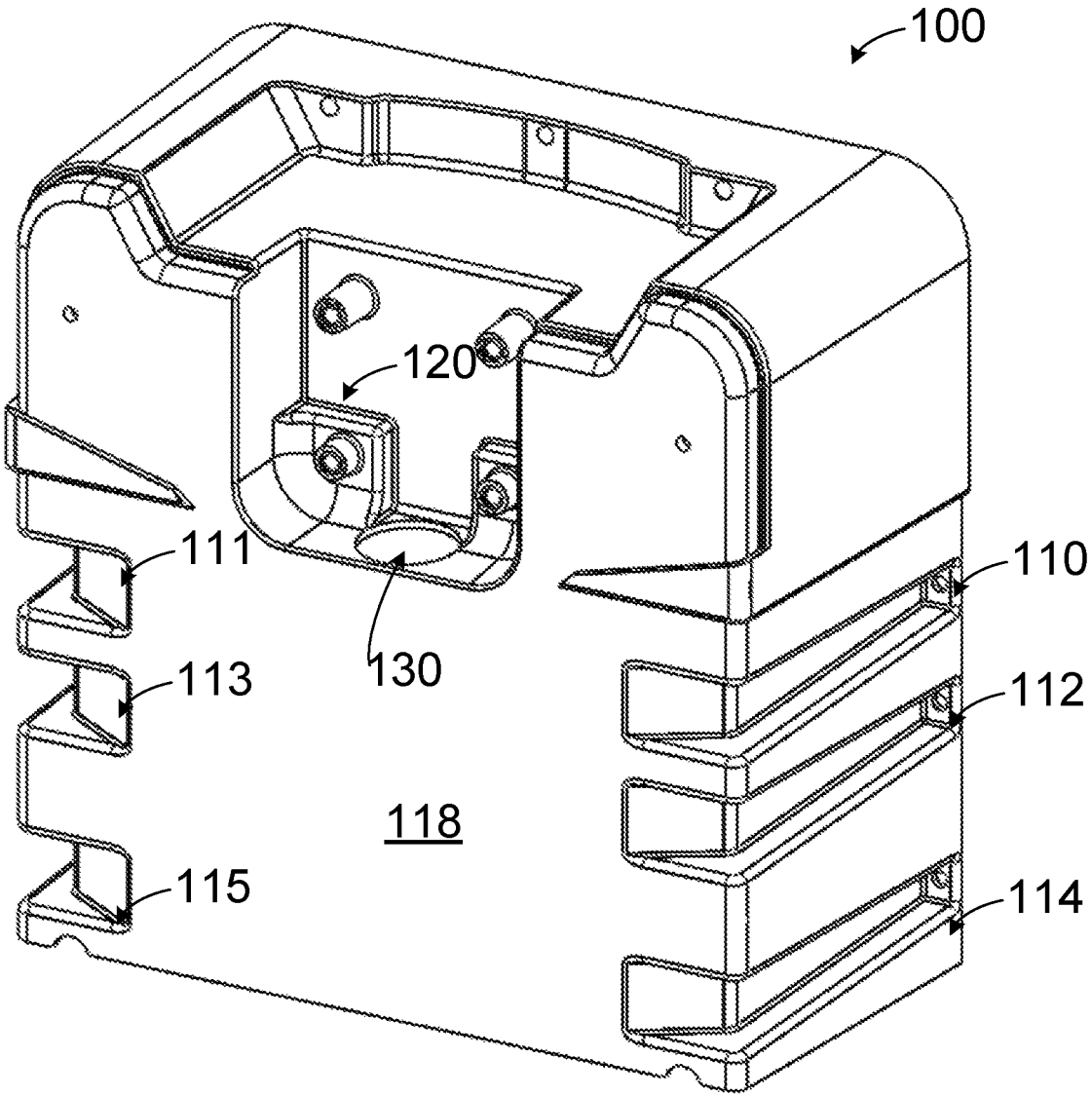

FIGS. 1B and 1C provide additional views of the first portion 100. As shown in the example of FIG. 1C, the first portion 100 includes an attachment area 120 for a handle mechanism, such as the articulated handle shown in the example of FIGS. 5A-5R. The example of FIG. 1C also includes an opening 130 through which a portion of the handle assembly can pass from an interior of the first portion 100 to an exterior of the first portion 100.

Figure 2A:
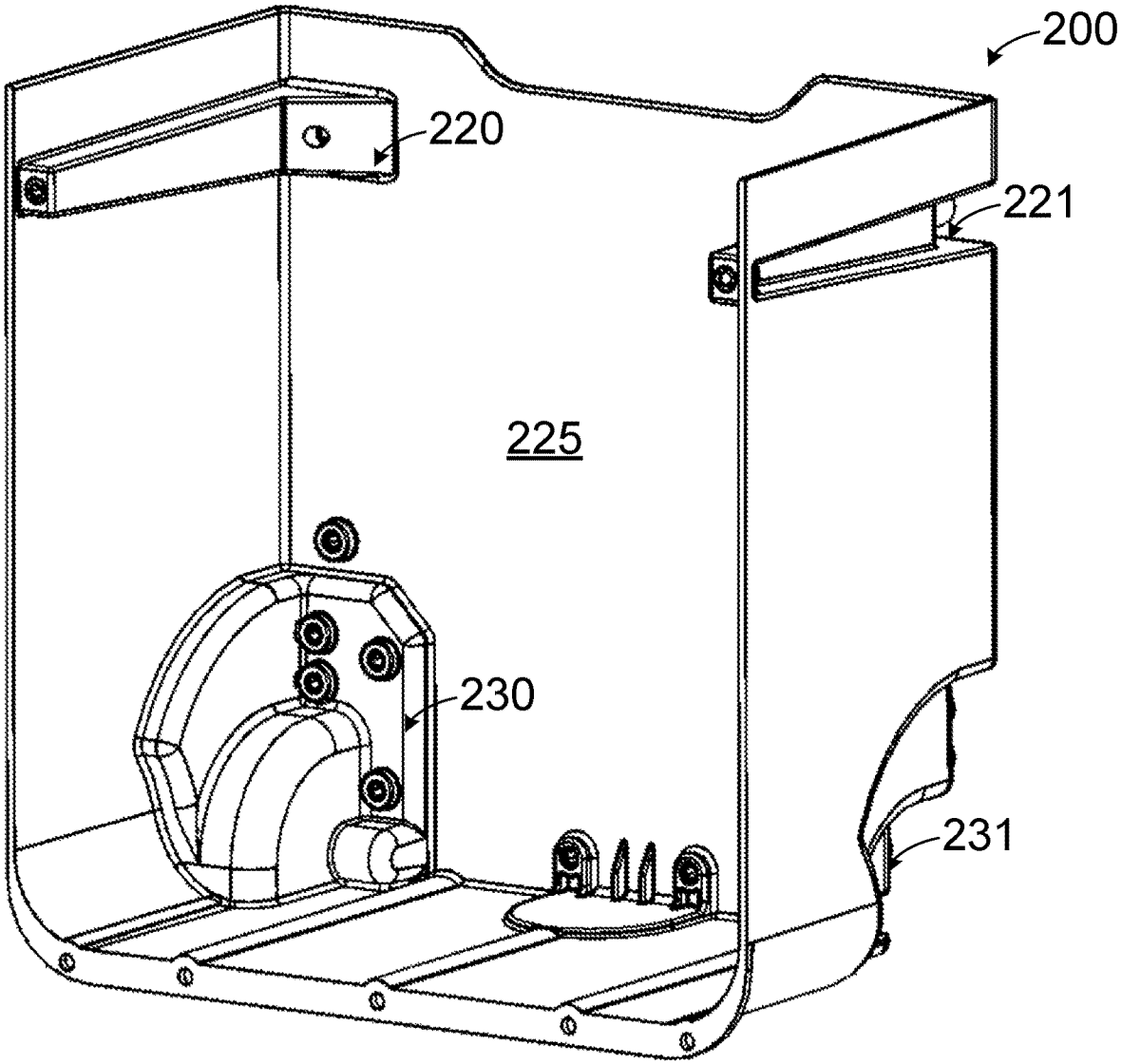
Figure 2B:
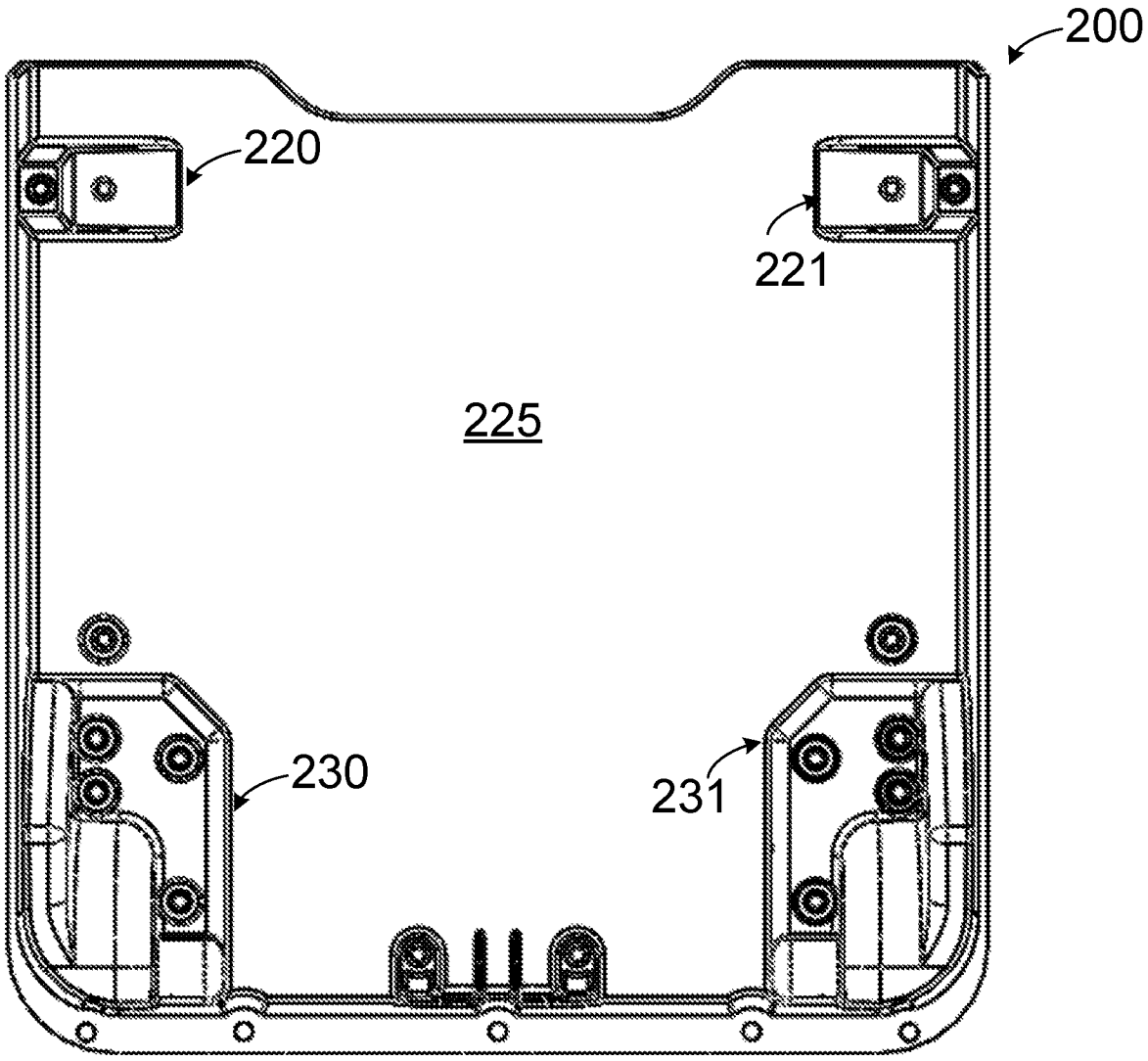
Figure 2C:
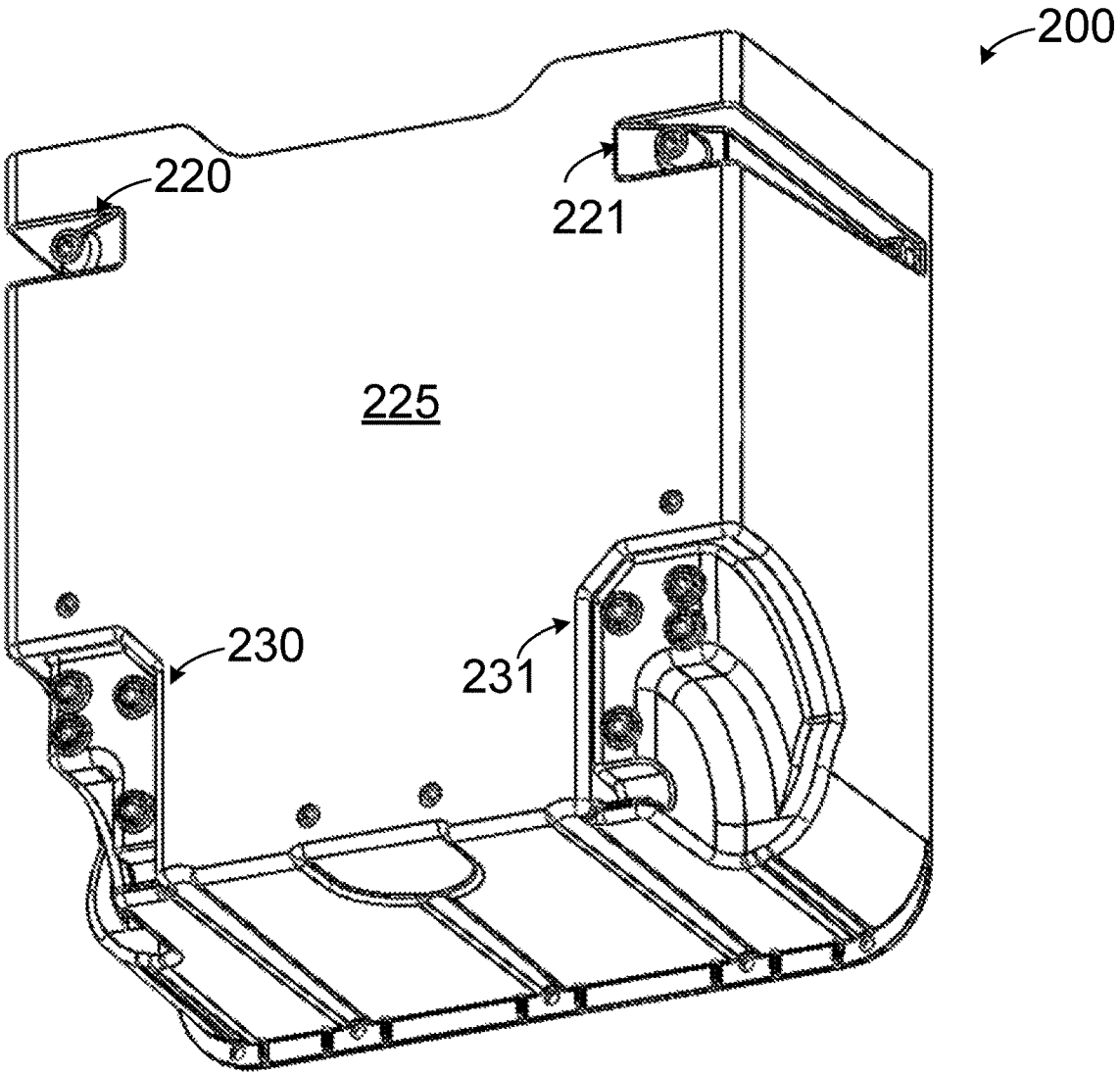

FIG. 2A illustrates a second portion 200 of the example modular luggage frame. The example second portion 200 (also referred to as a bottom portion or lower portion) is formed to include ribs 220-221 formed as indentations in the example second portion 200. The second portion 200 also includes attachment areas 230-231 for wheel assemblies, such as the wheel assemblies shown in the example of FIGS. 6A-6Y. FIGS. 2B-2C show alternative views of the example second portion 200.

As shown in the example of FIGS. 2A-2C, the ribs 220-221 form indentations in the luggage portion or section 200 which taper from a back or main surface 225 of the second luggage portion 200 to a front or open end of the second portion 200. In other examples, the ribs 220-221 can be implemented in a uniform shape and size from front to back along sides of the second portion 200.

As shown in the example of FIGS. 2A-2C, the ribs 220-221 can have a first indented portion along the back 225 of the luggage portion 200 and a second indented portion along a side of the luggage portion 200. In certain examples, the second indented portion is longer than the first indented portion (e.g., as shown in FIGS. 2A-2C).

Figure 3A:
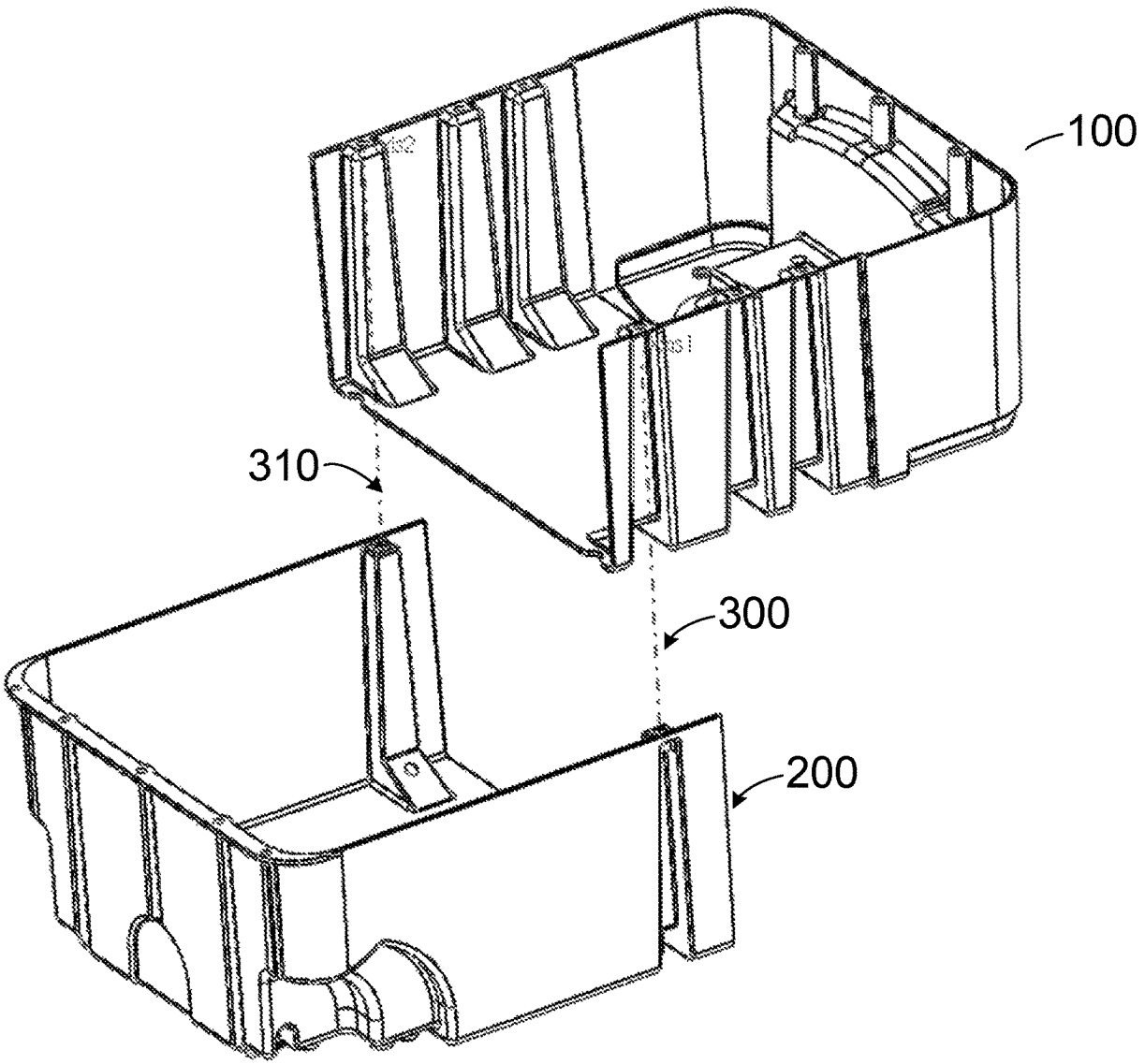
Figure 3B:
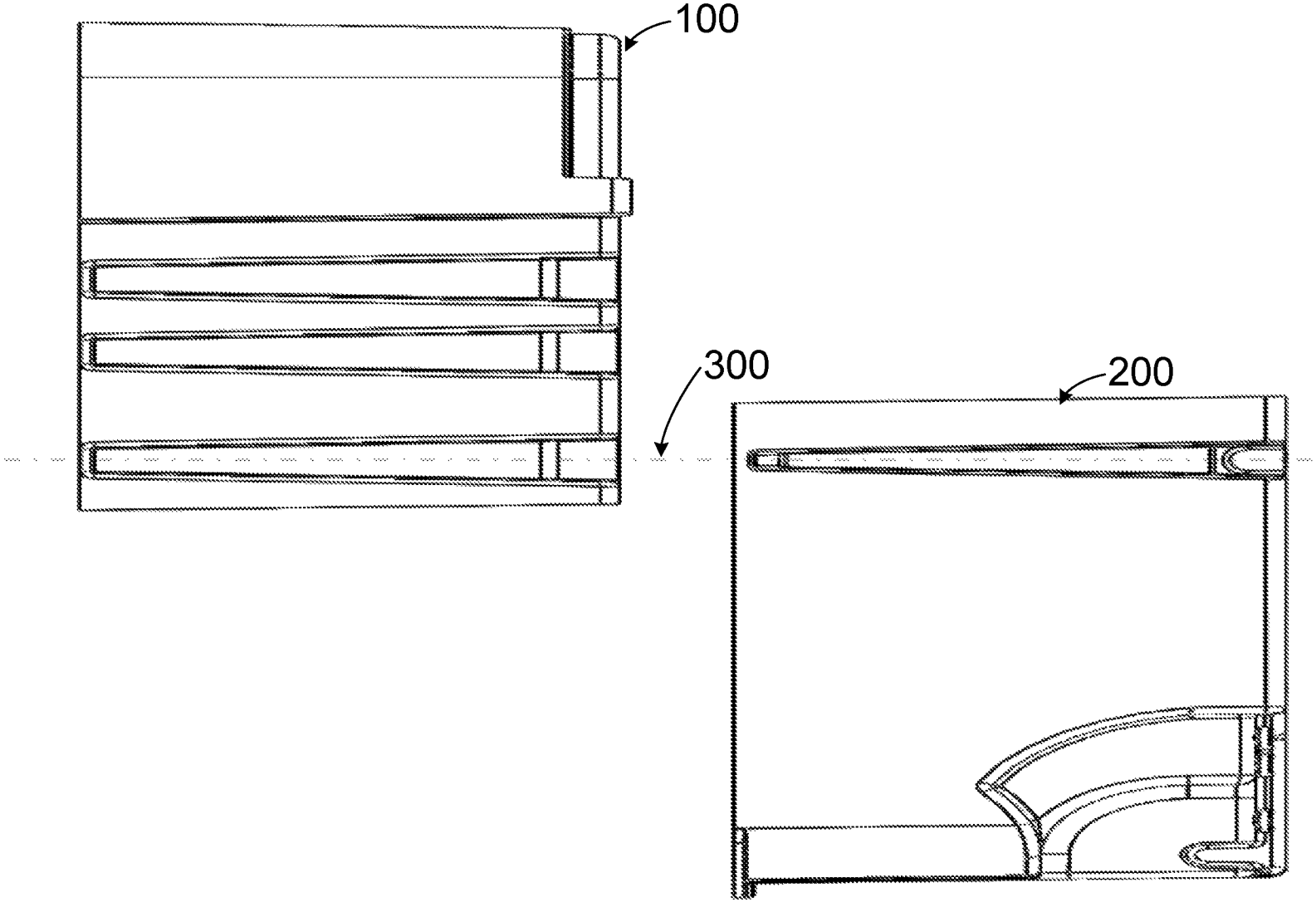

FIGS. 3A-3B show example views of the first portion 100 and the second portion 200 assembling together along a direction or path 300 to form a luggage shell. As illustrated in the example of FIGS. 3A-3B, the first portion 100 and the second portion 200 can be aligned along the ribs 210-211 of the second portion and a selected pair or set 110-111, 112-113, 114-115 of the ribs 110-115 of the first portion 100. By selecting a pair 110-111, 112-113, 114-115 of the ribs 110-115 of the first portion 100, the first 100 and second 200 portions form modular luggage of varying sizes. A cloth, wrap, cover, liner, etc., can then be position and/or formed around the luggage shell to enclose the shell and secure contents, for example.

Figure 4A:
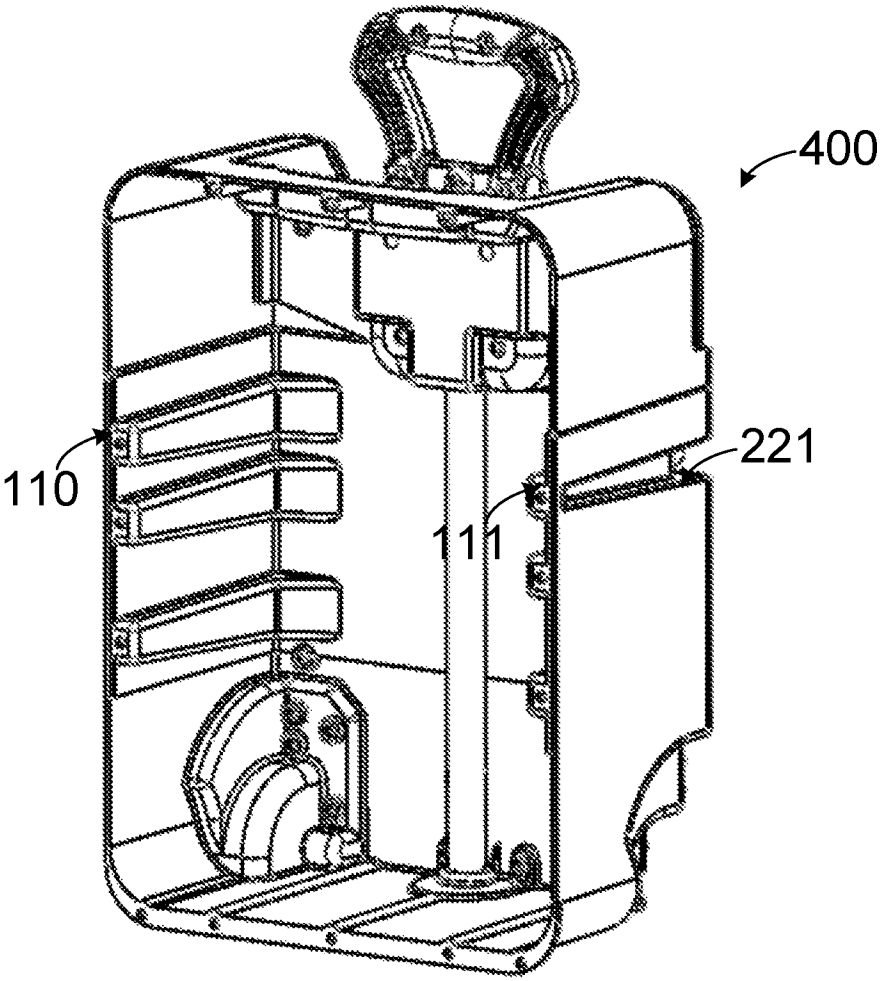
Figure 4B:
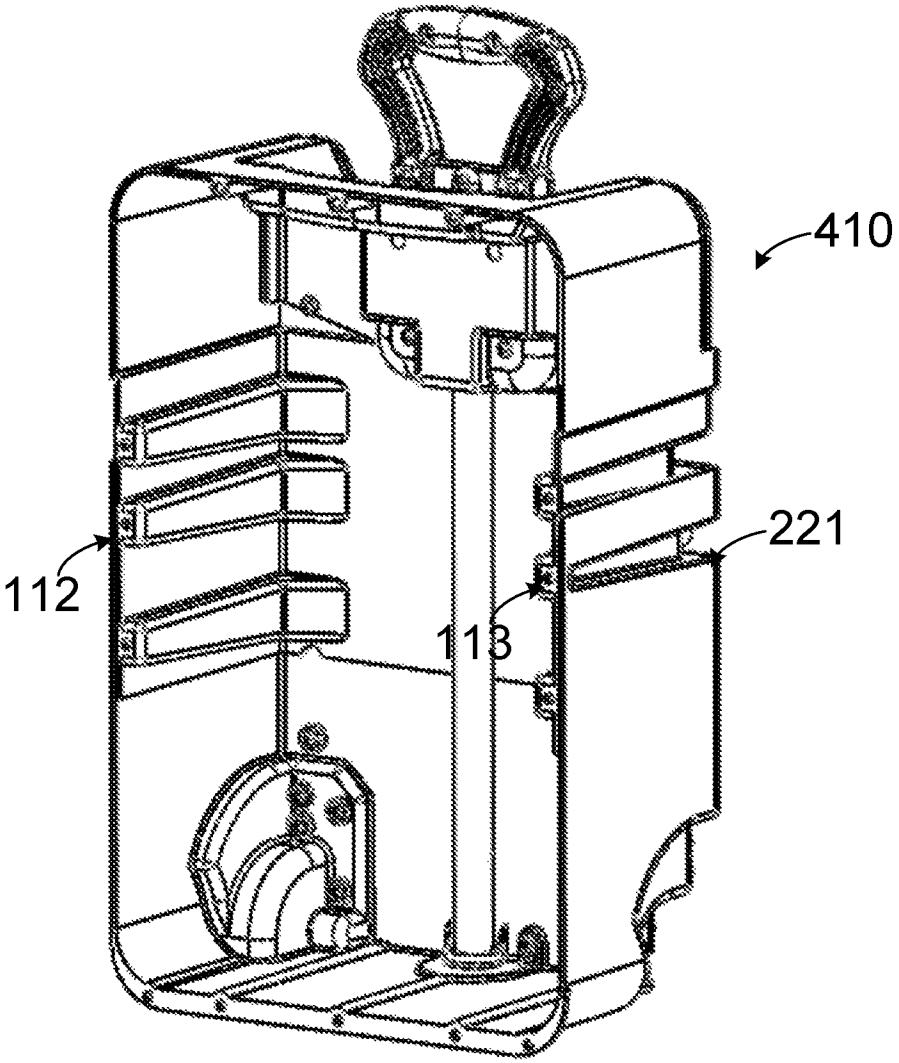
Figure 4C:
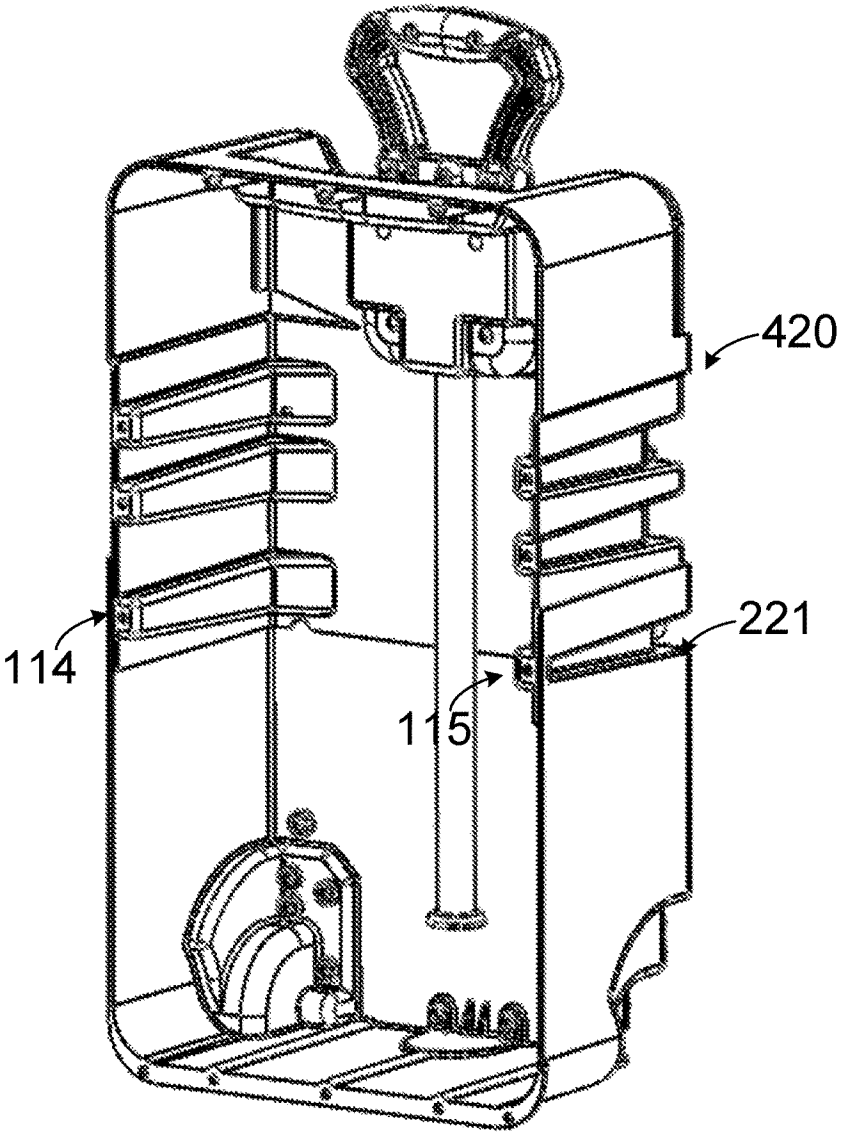

FIGS. 4A-4C illustrate three example luggage sizes formed from the same first portion 100 and second portion 200 of the modular luggage frame. The example of FIG. 4A forms a first size (e.g., a small size) luggage 400 by aligning the ribs 220-221 of the second portion with the uppermost ribs 110-111 of the first portion 100. The example of FIG. 4B forms a second size (e.g., a medium or middle size) luggage 410 by aligning the ribs 220-221 of the second portion with the middle pair of ribs 112-113 of the first portion 100. The example of FIG. 4A forms a third size (e.g., a large size) luggage 400 by aligning the ribs 220-221 of the second portion with the lower set of ribs 114-115 of the first portion 100.

In certain examples, the first portion 100 and the second portion 200 are formed of a composite material that provides both toughness as well as rigidity. For example, a polycarbonate (PC) material is rigid, and an Acrylonitrile butadiene styrene (ABS) material or other thermoplastic polymer is tough, so a PC-ABS mixture provides portions 100, 200 that will not fracture like PC alone. In certain examples, the portions 100, 200 are formed using an injection molding process.

In certain examples, the ribs 110-115, 220-221 are formed in a slightly triangulated shape (e.g., tapered on one or more sides along a length of the rib 110-115, 220-221. During assembly, selected pairs of ribs 110-115, 220-221 are aligned for a desired size and slid together. For example, the inner ribs 110-115 of the first portion 100 slide over and lock into the outer ribs 220-221 of the second portion 200. The corresponding pairs of ribs 110-115, 220-221 lock together tightly to secure the first and second portions 100, 200 into a frame forming luggage. The locked portions 100, 200 can further be secured or held in place by screws, bolts, rivets, etc. (e.g., two screws at the top of the interconnected ribs 110-115, 220-221). In certain examples, the screwable areas (e.g., threaded inserts, etc.) can be pressed into the molded part 100, 200 after that part 100, 200 has been molded so that, for example, a screw can be screwed into a solid metal thread.

In certain examples, the modular frame is formed by positioning the first portion 100 and second portion 200 with respect to each other, inserting and mounting the handle assembly (e.g., the example handle assembly 600 described below with respect to FIGS. 6A-6Y), and wrapping the frame in fabric to enclose and complete the luggage. For example, fabric (e.g., Cordura Ballistic Fabric by Invista, other durable yet flexible fabric, etc.) is wrapped around the frame formed by the first and second portions 100, 200 to enclose an interior and complete an exterior of the luggage. In certain examples, the fabric attaches to the luggage in at least two places, such as at a top of the first portion 100 with a hook and loop closure and/or other removable attachment and at a back with a hook and loop closure, etc. The wheel assemblies 500 and protective skids help to hold the fabric wrap in place around the modular frame. In certain examples, bumper guards, a skid plate, and/or a foot are added outside the fabric. For example, these components can be formed of a glass-filled nylon mixture (e.g., when injecting nylon into a mold, also inject small fiberglass fibers to form a strengthened mixture such as 30% fiberglass, 70% nylon, etc.).

Figure 5A:
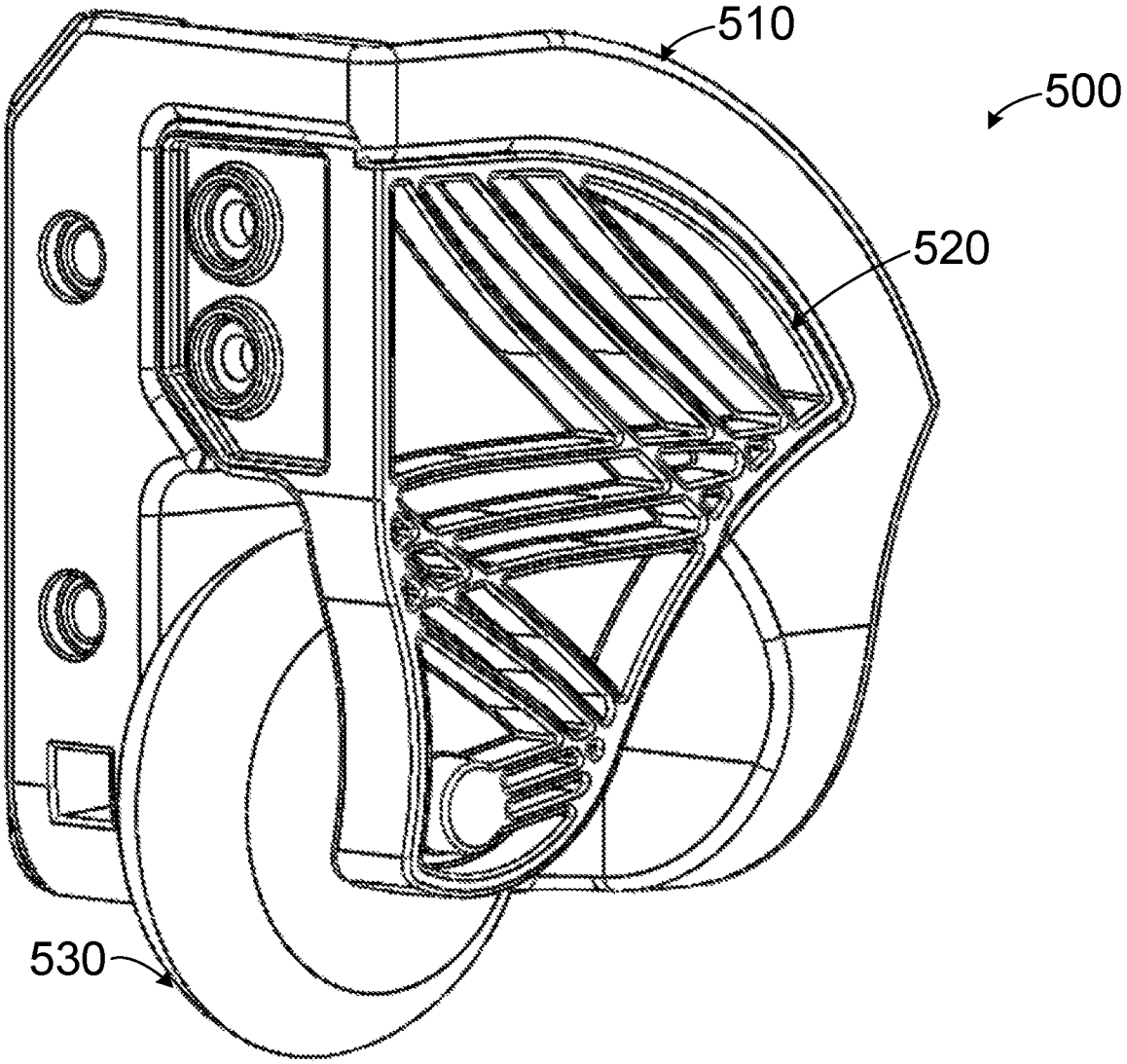
FIGS. 5A-5T illustrate example views of a luggage wheel assembly, which can be implemented separately or with the modular luggage frame of FIGS. 1A-4C.
Figure 5B:
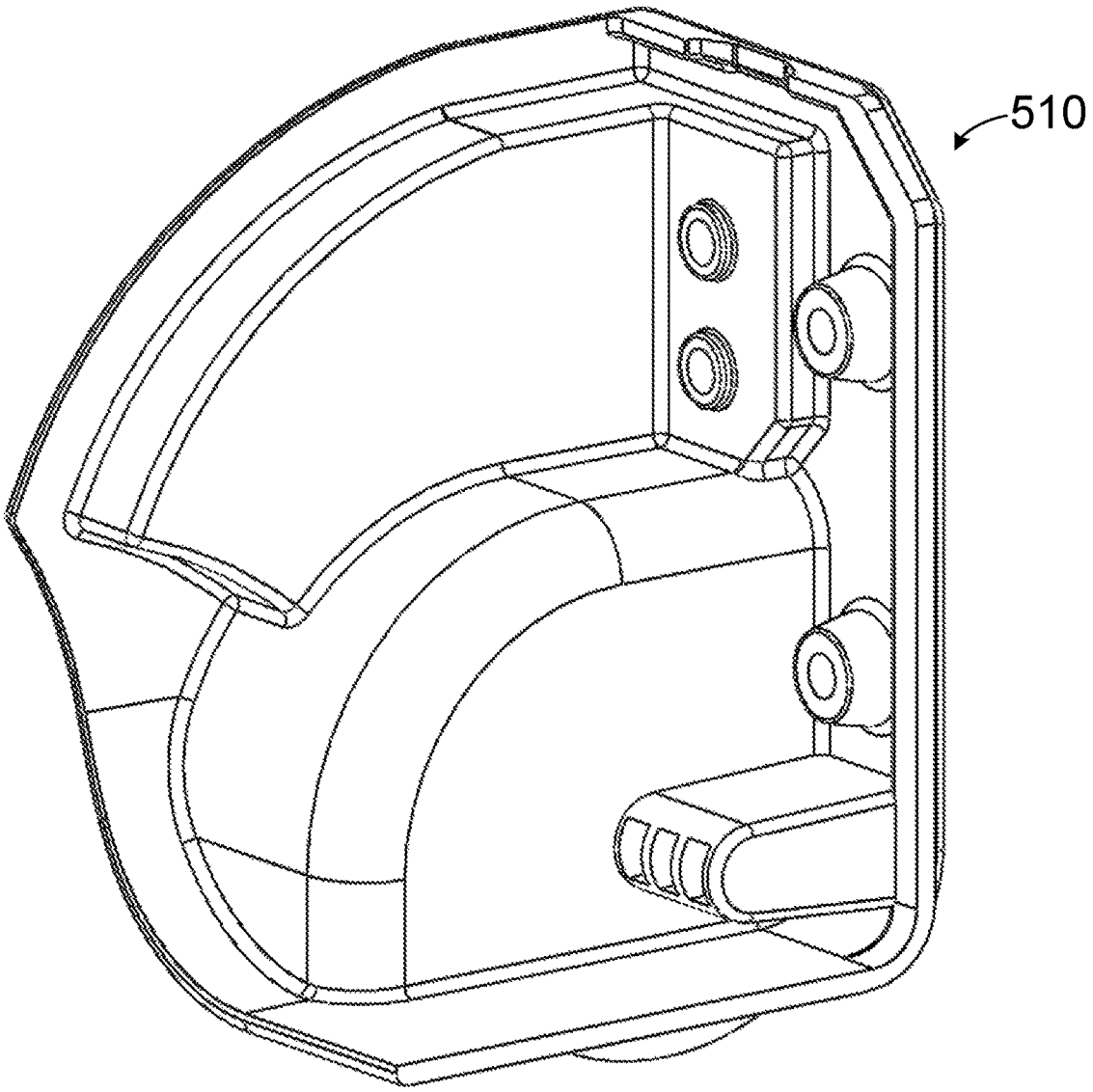
Figure 5C:
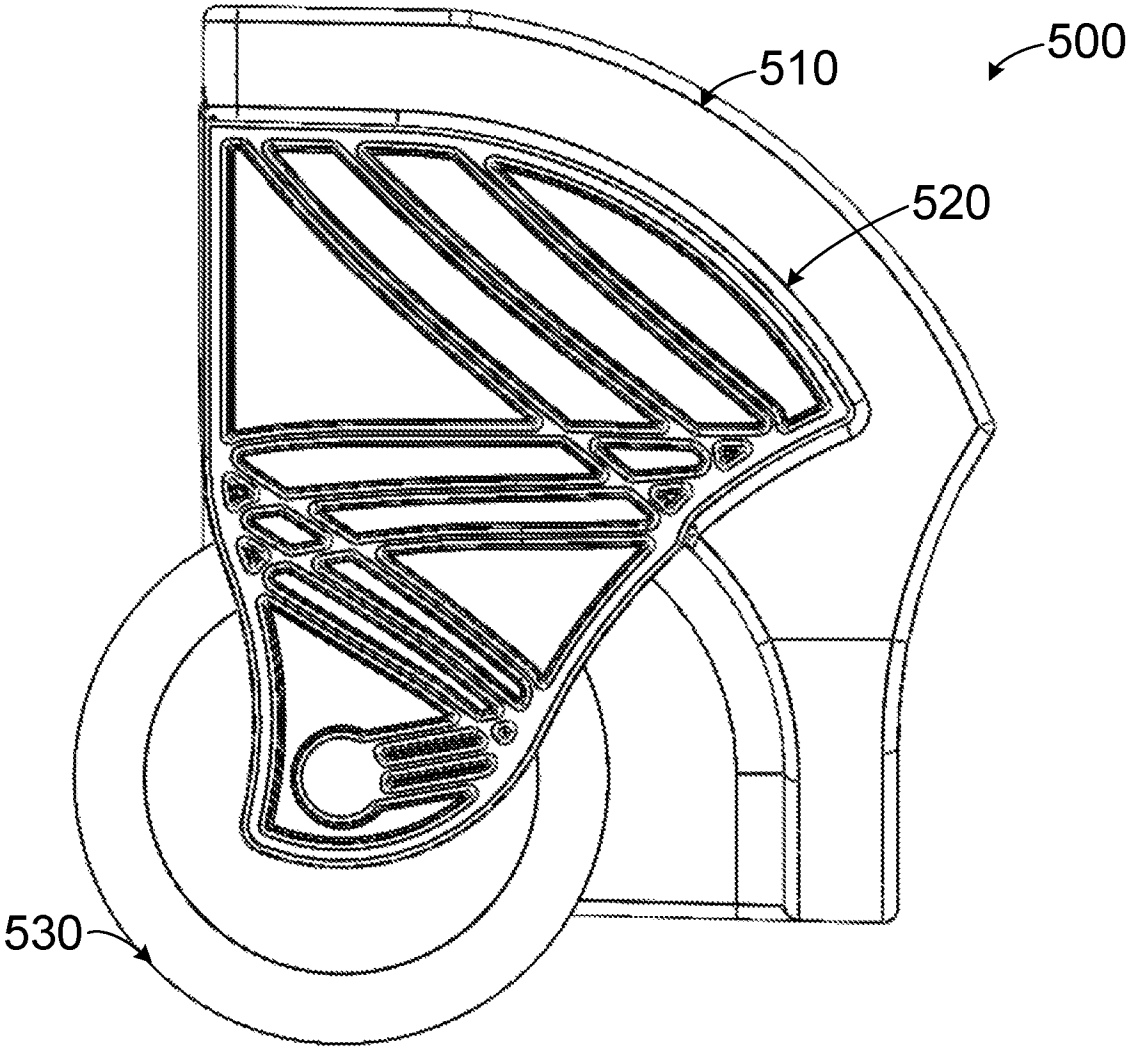
Figure 5D:
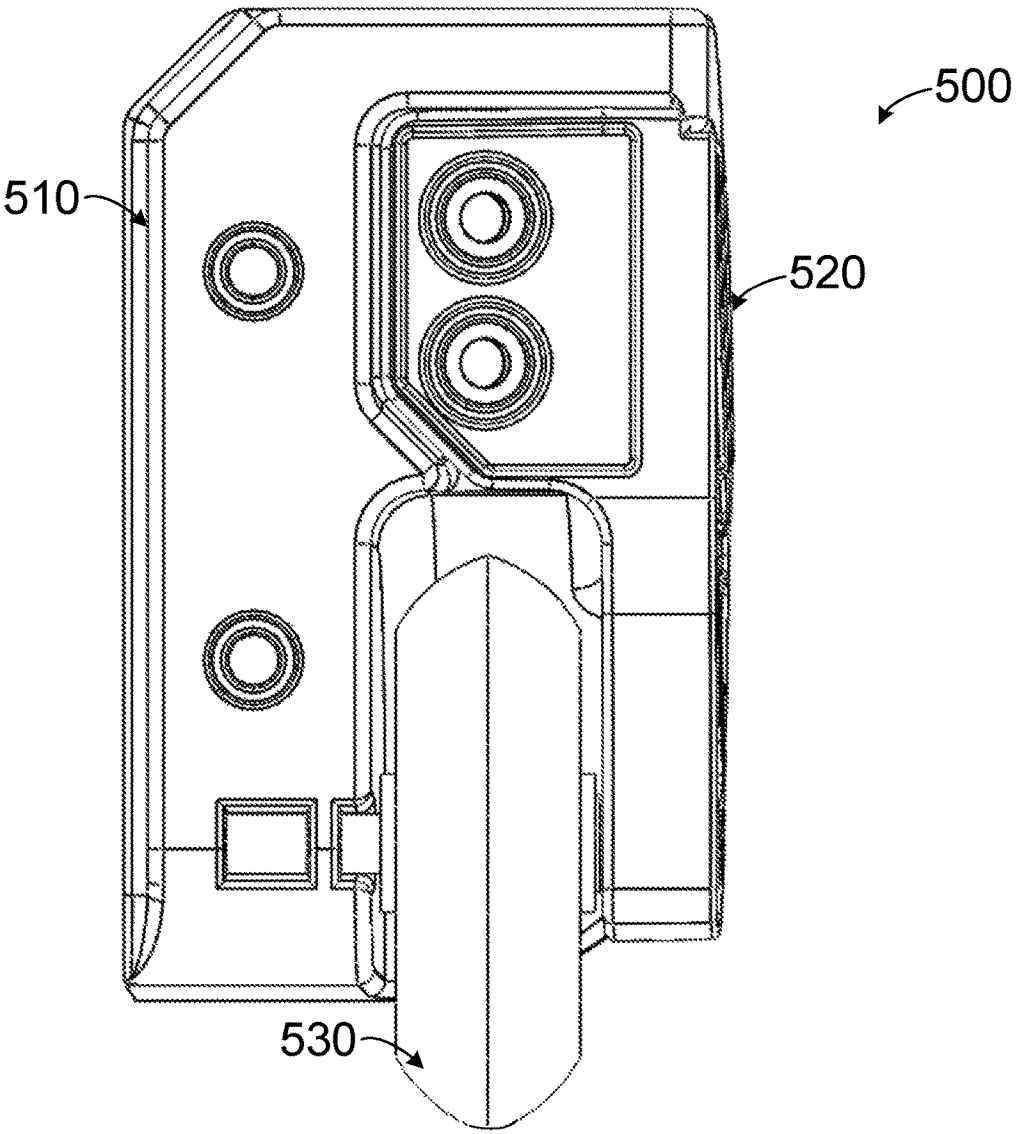
Figure 5E:
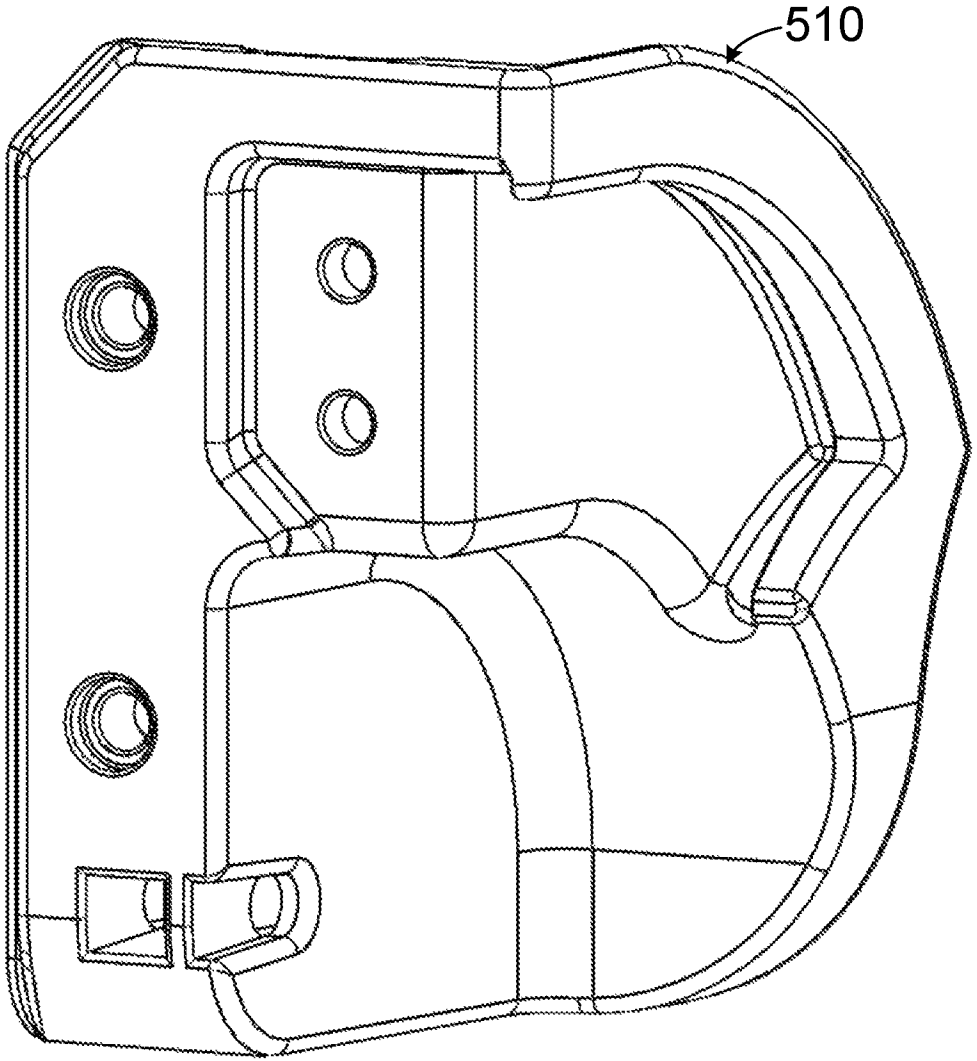
Figure 5F:
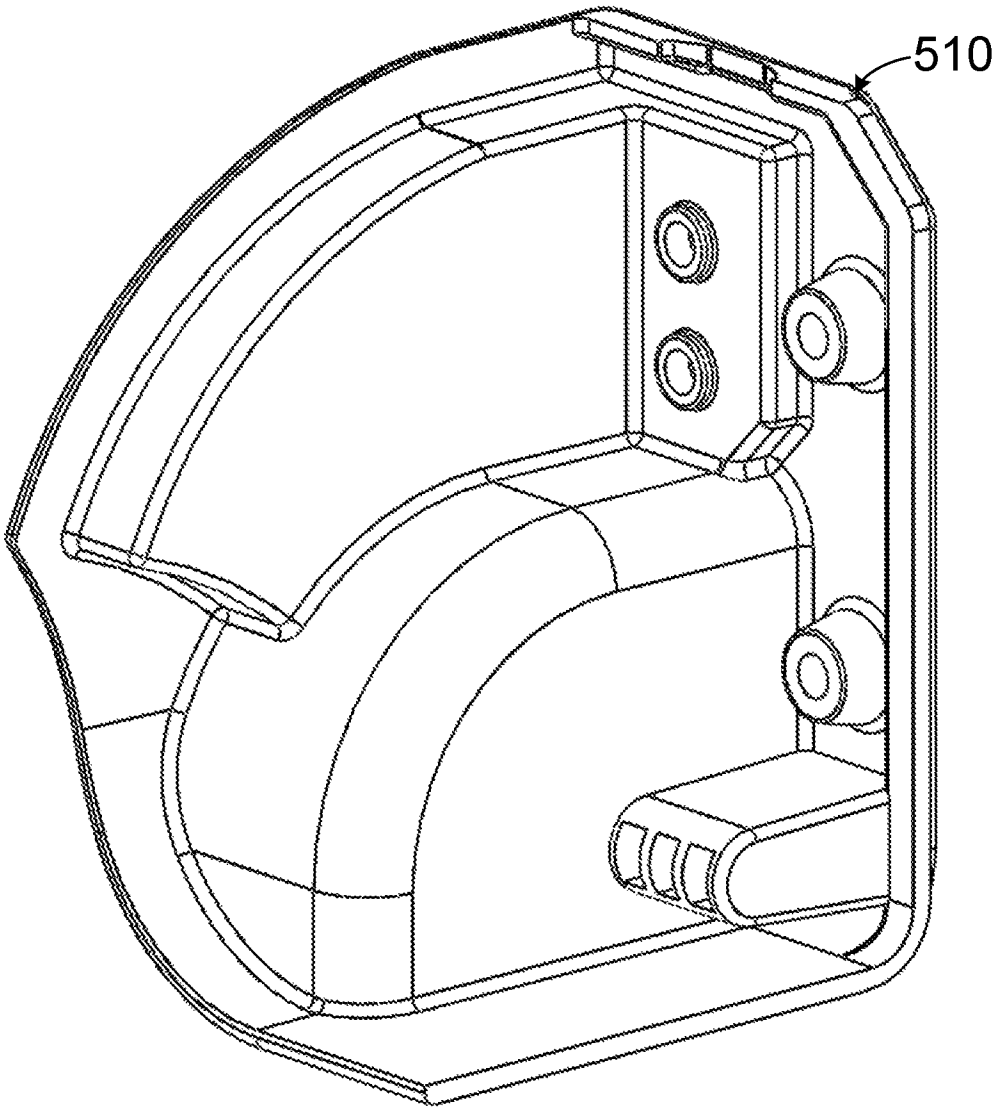
Figure 5G:
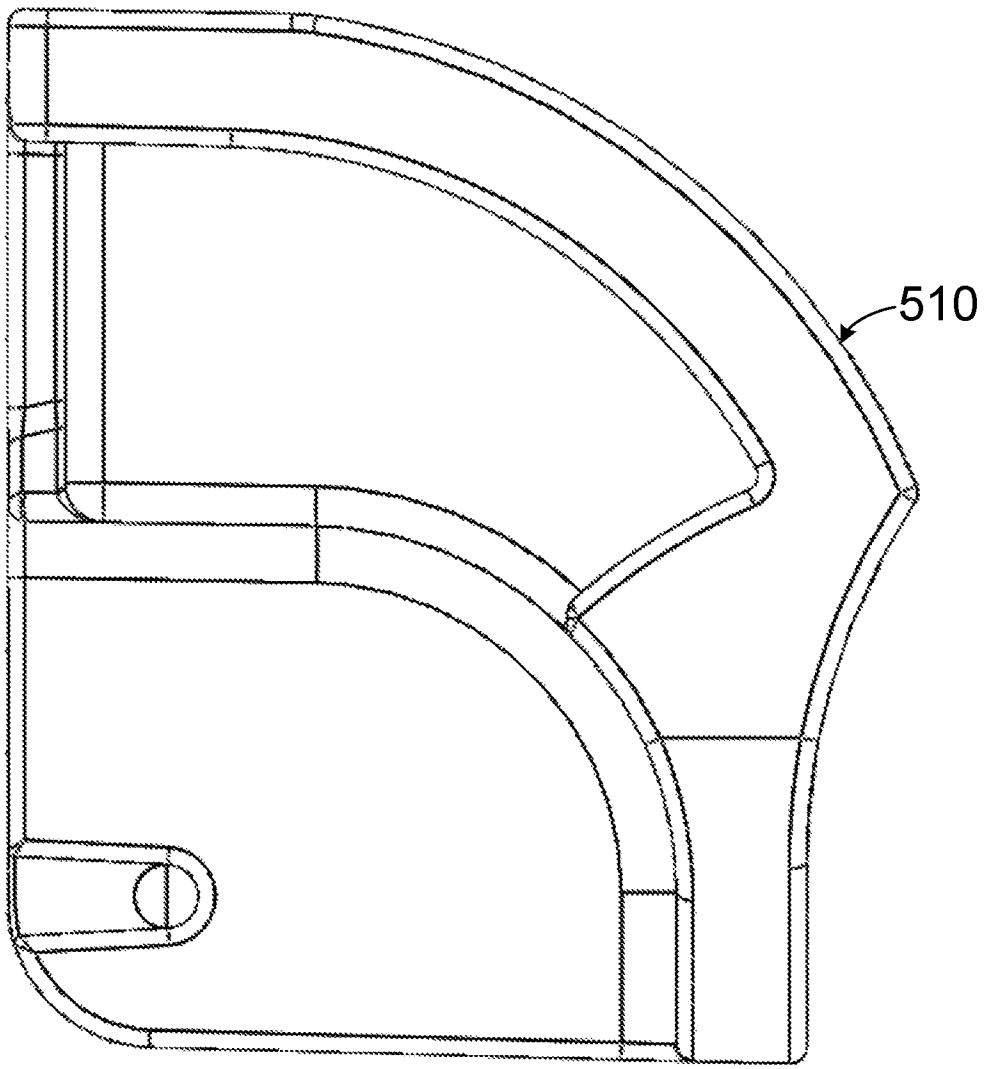
Figure 5H:
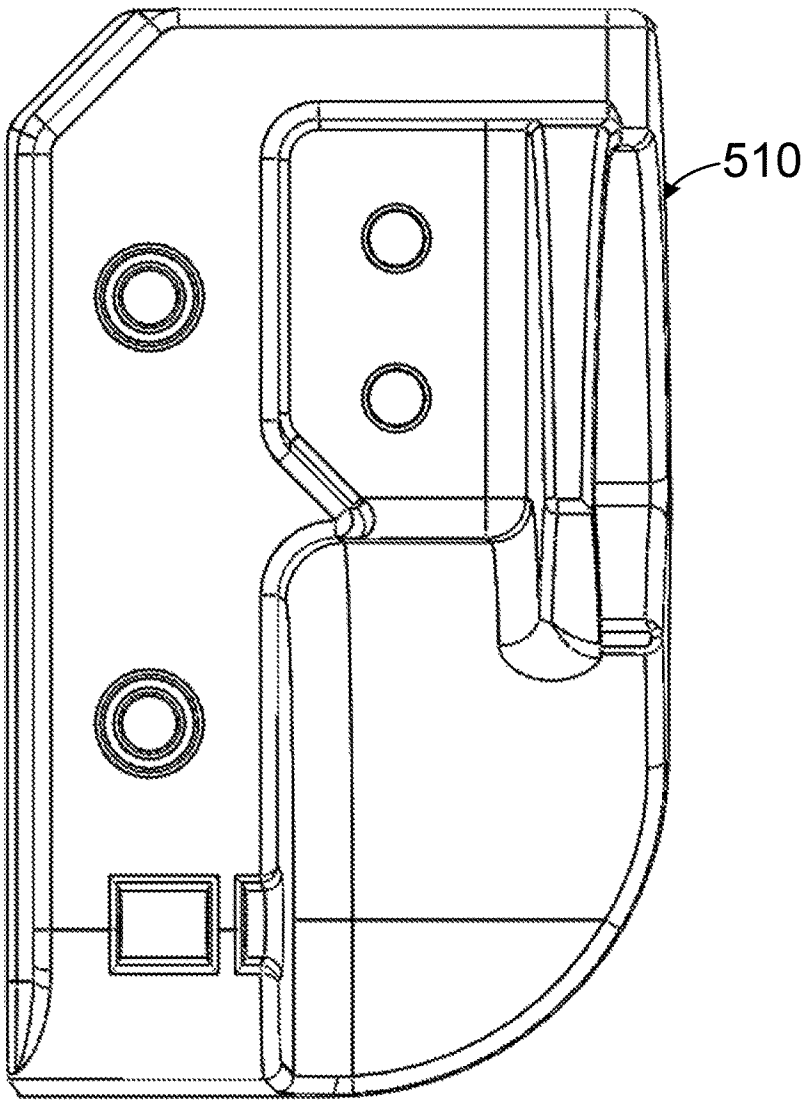
Figure 5I:
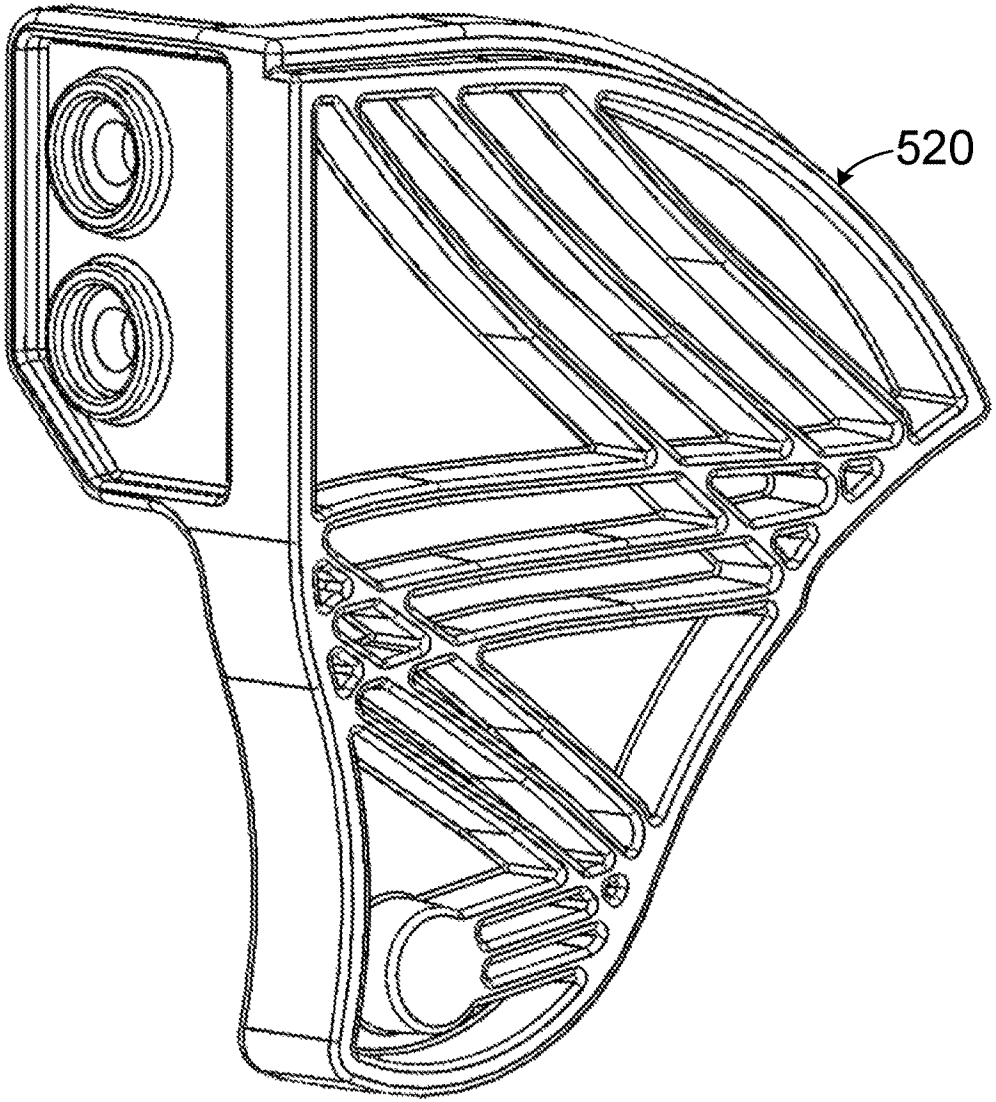
Figure 5J:
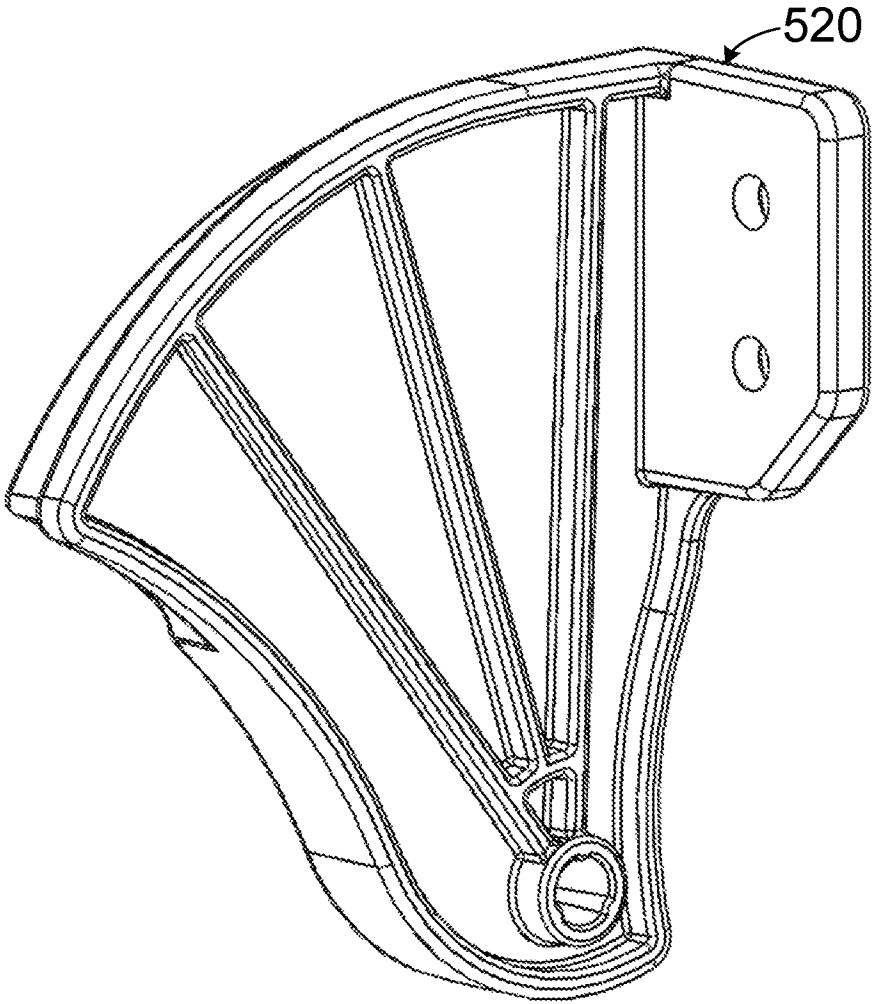
Figure 5K:
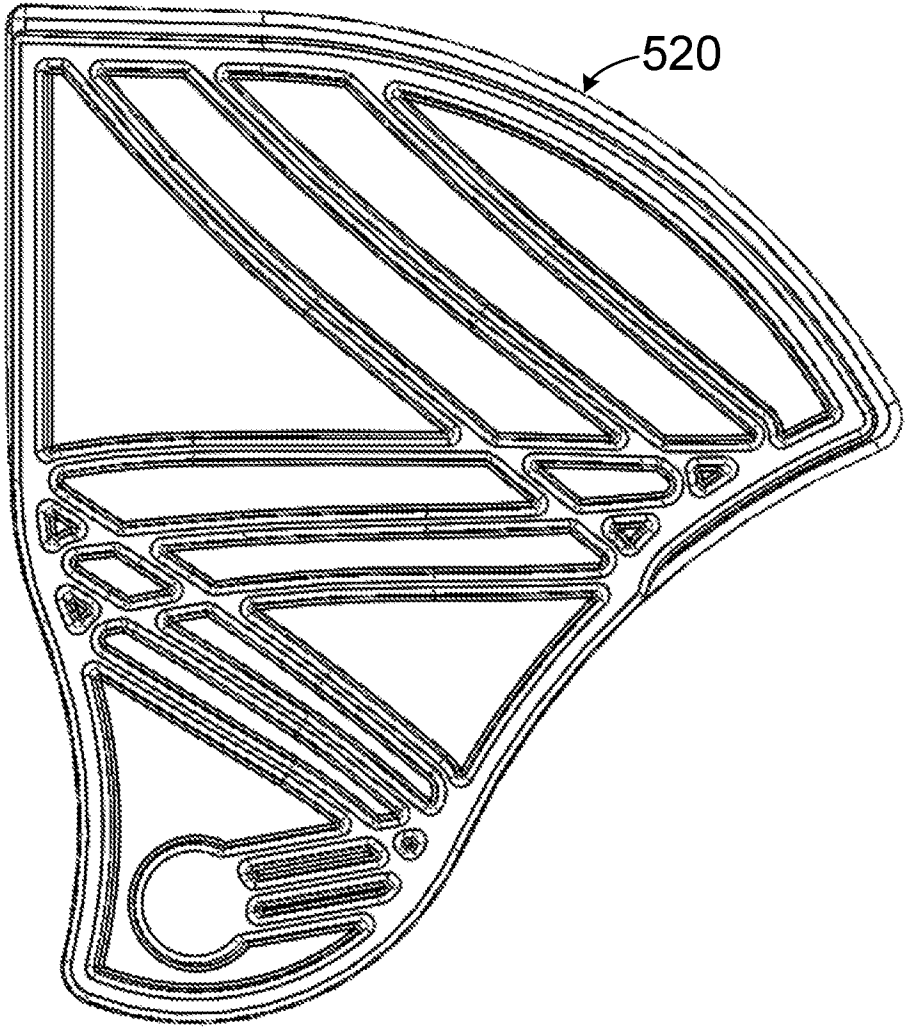
Figure 5L:
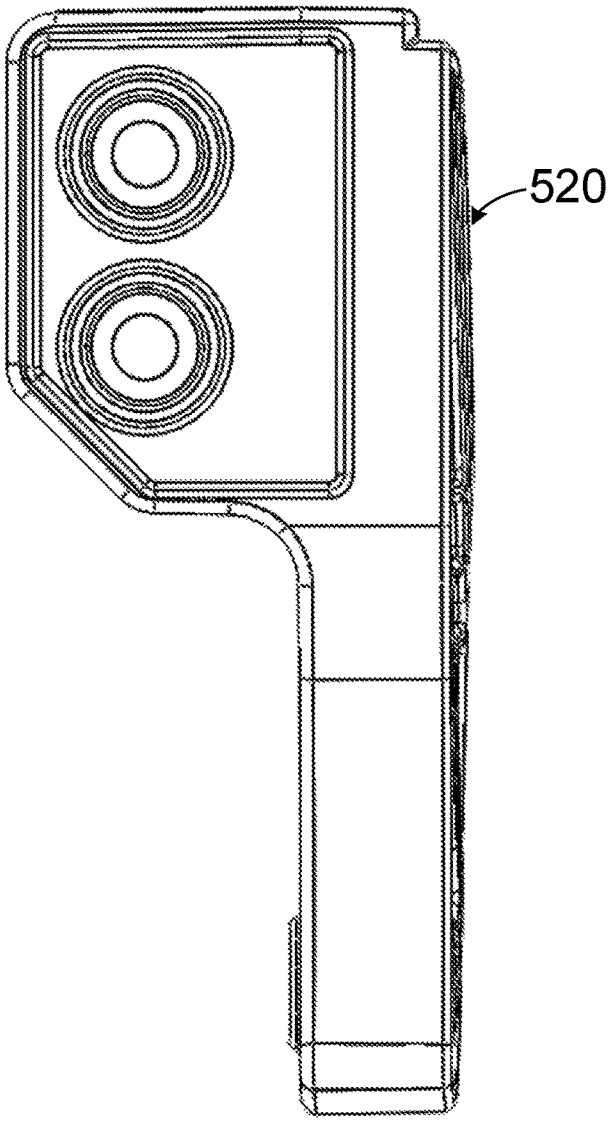
Figure 5M:
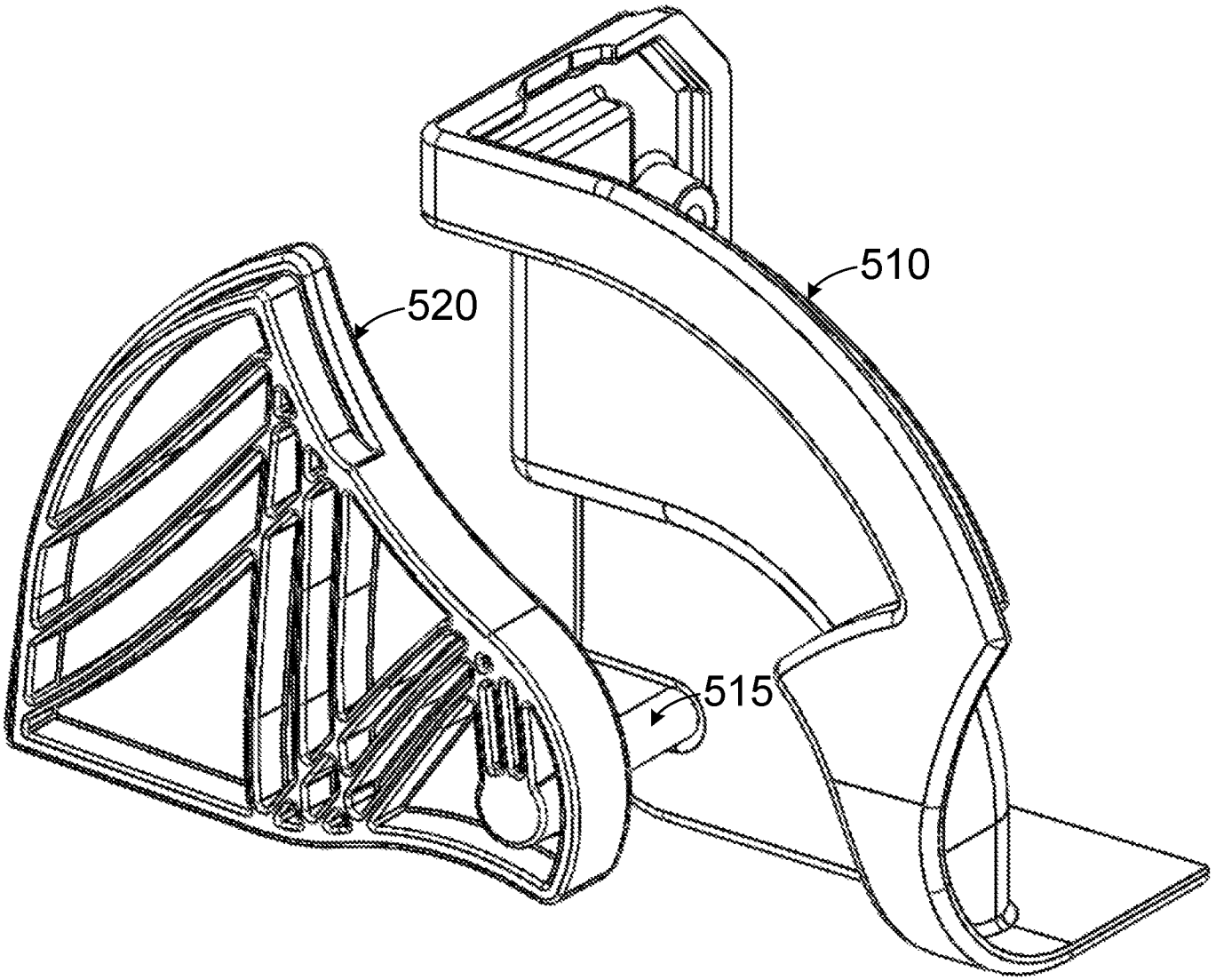
Figure 5N:
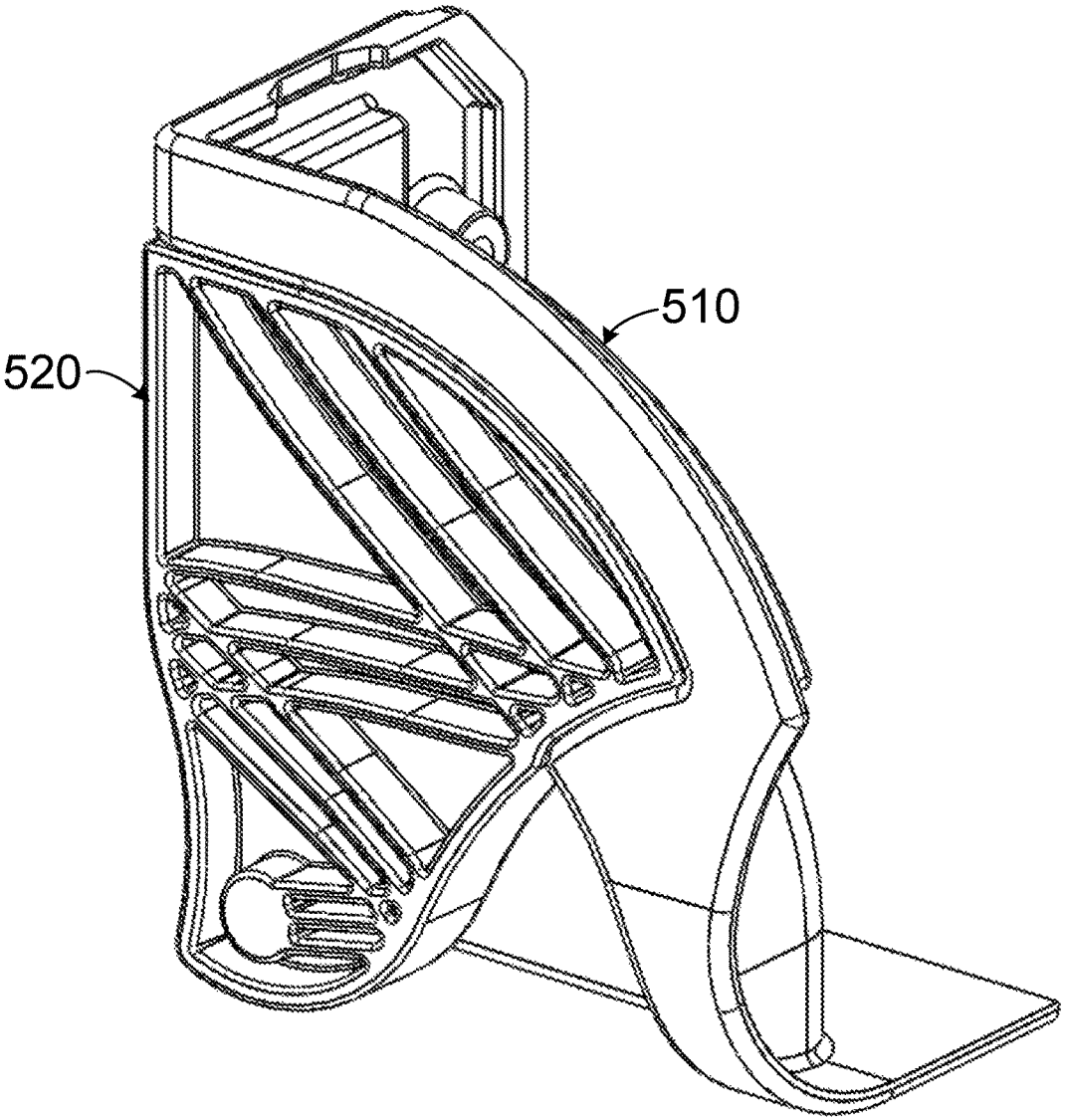
Figure 5O:
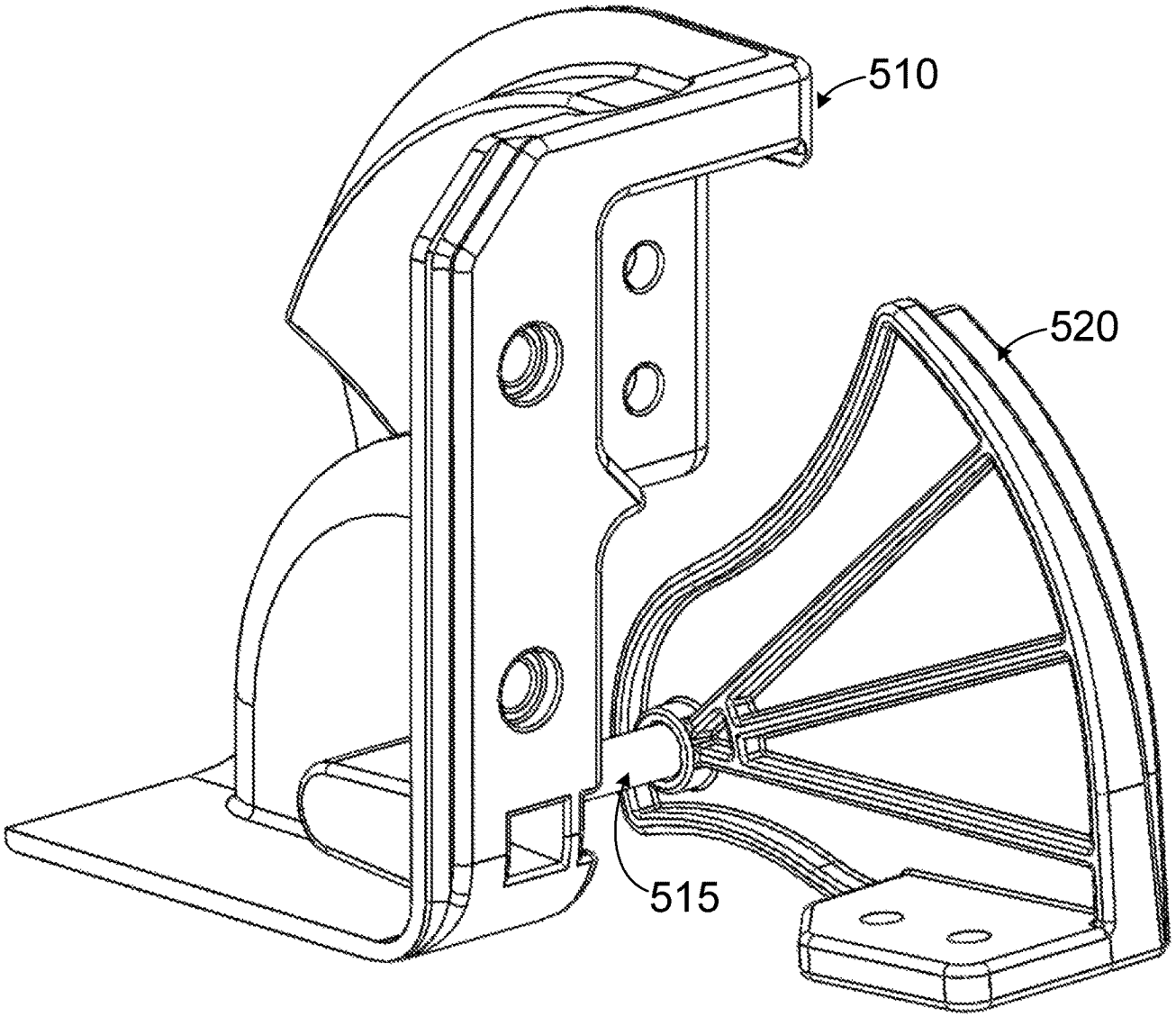
Figure 5P:
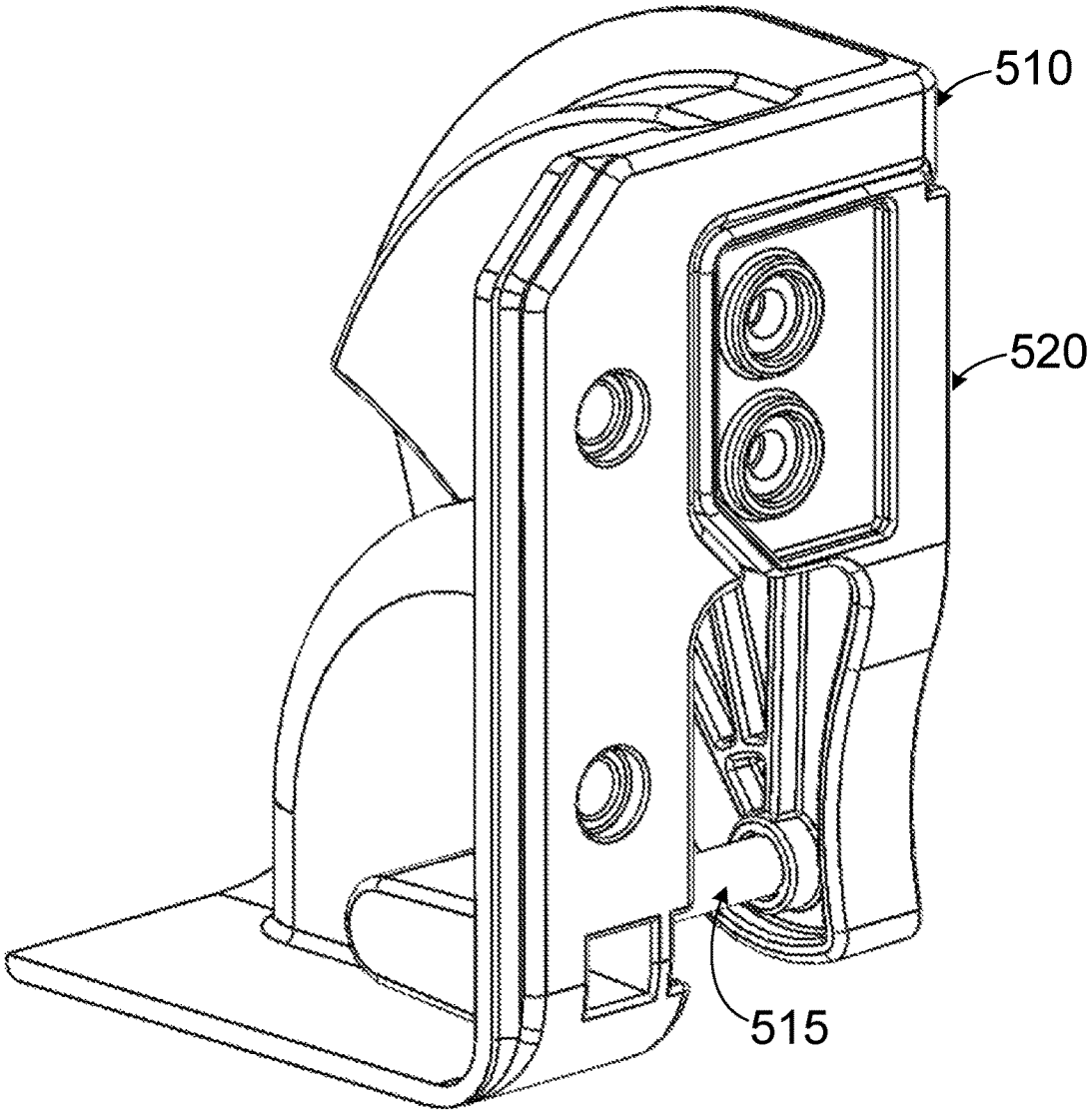
Figure 5Q:
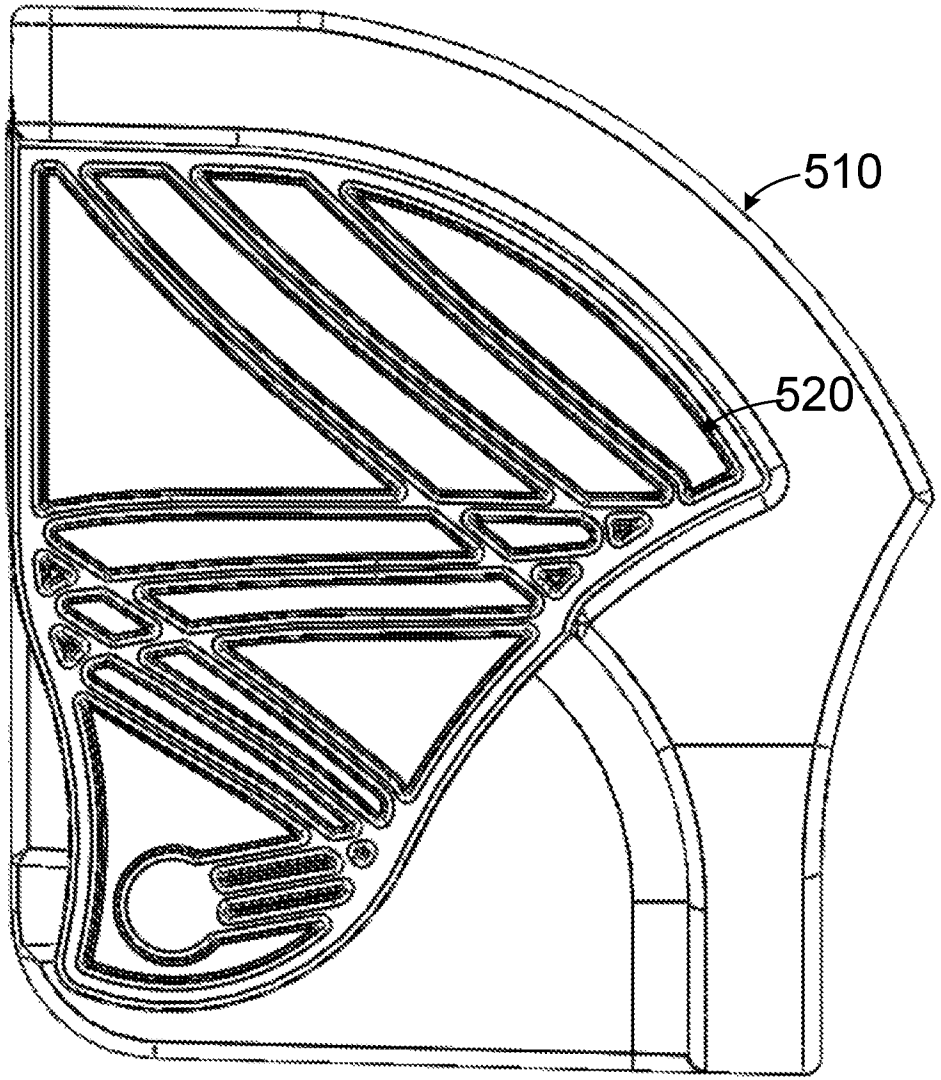
Figure 5R:
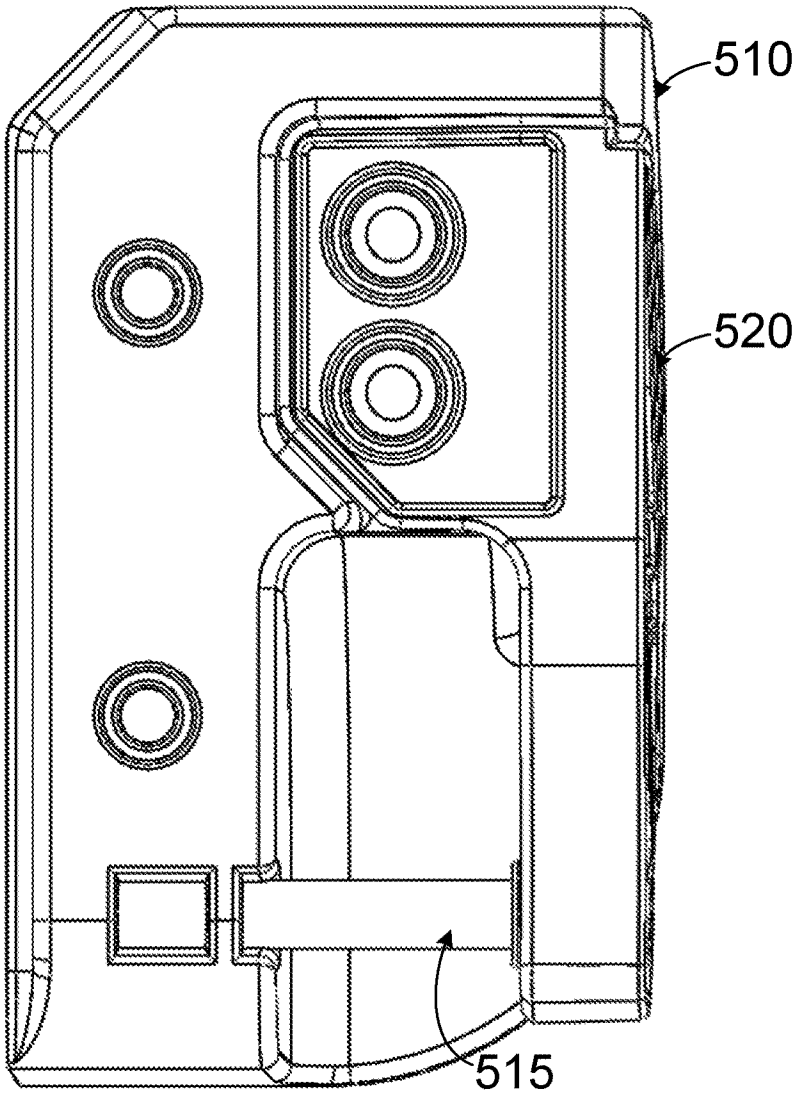
Figure 5S:
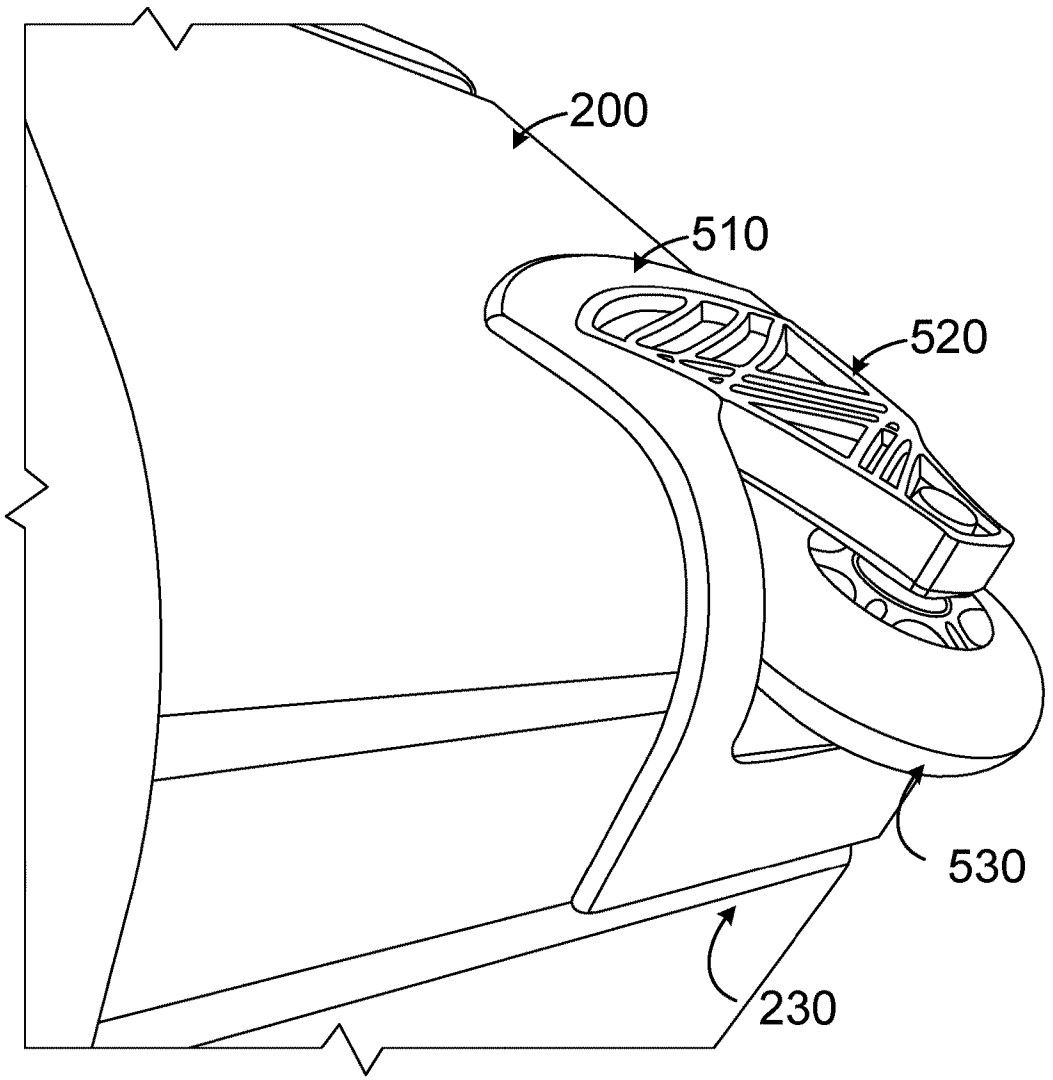
Figure 5T:
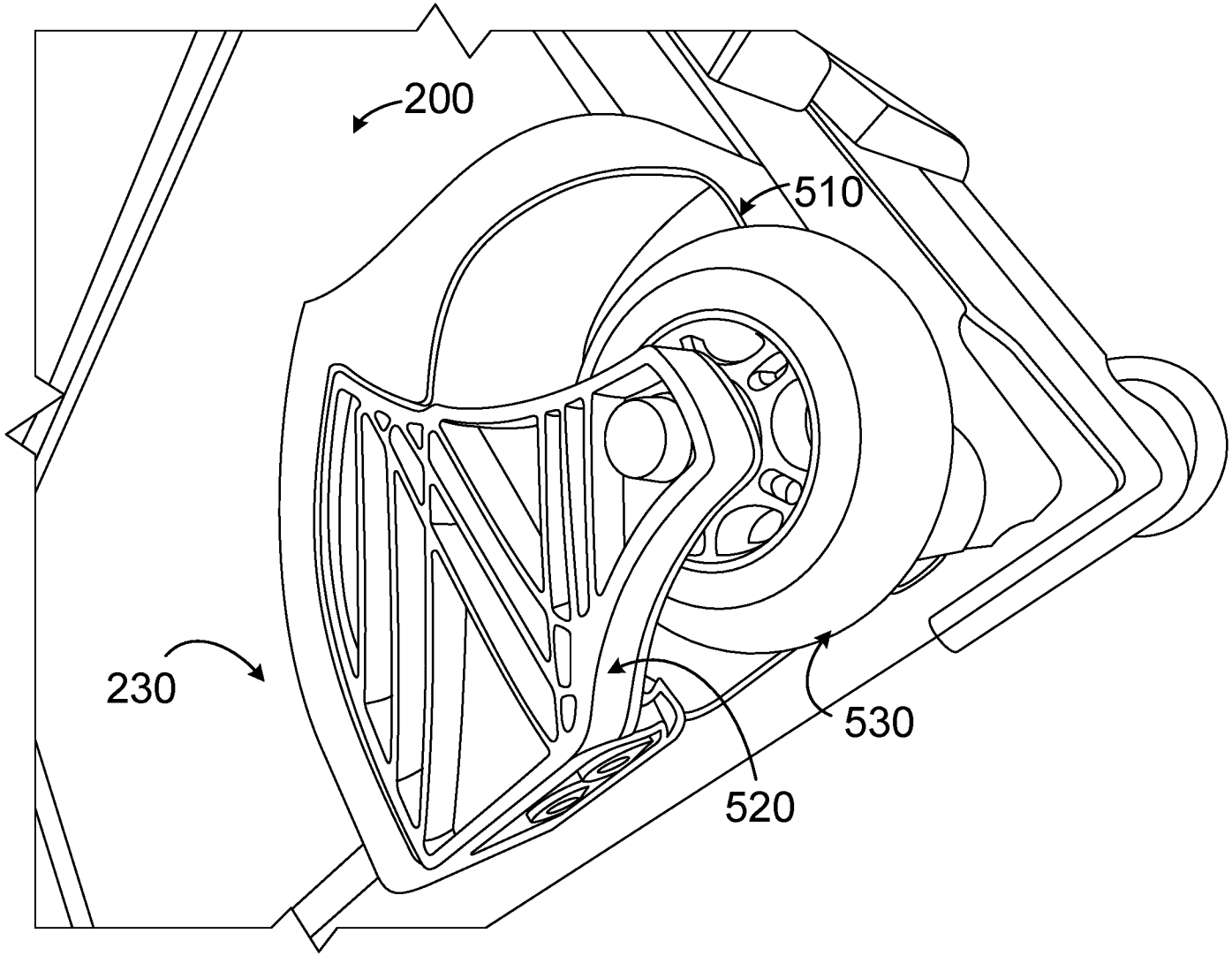

FIGS. 5A-5T illustrate example wheel assemblies 500 that can be used to attach to the second portion 200 at attachment areas 230-231 (e.g., using screws, bolts, rivets, etc., into screwable areas such as threaded inserts, etc. The example wheel assembly 500 can also be used in other luggage apart from the modular frame of first and second portions 100, 200 (e.g., non-modular carry-on luggage, other bags, etc.).

As shown in the examples of FIGS. 5A-5T, the wheel assembly 500 includes a first portion 510 and a second portion 520 that capture a wheel 530 and hold it in place with respect to the luggage. The wheel 530 is held in place with respect to the assembly portions 510, 520 but is able to move or roll freely to allow the luggage to which it is attached to roll or move. As shown in the example of FIG. 5A, the first portion 510 (also referred to as the inner portion) is affixed or otherwise attached to the bag (e.g., to the second portion 200 at its wheel assembly attachment areas 230-231). The second portion 520 (also referred to as the outer portion) is removably attached to the first portion 510 to secure the wheel 530 with respect to the bag.

FIGS. 5B and 5E-5H provide additional views of the first portion 510 of the example wheel assembly 500. FIGS. 51-5L provide additional views of the second portion 520 of the example wheel assembly 500. For example, the first portion 510 mounts to the wheel attachment area 230-231 of the second portion 200 of the luggage. The second portion 520 then attaches to the first portion 510. The second portion 520 secures the wheel 530 such that the wheel 530 can revolve, rotate, or otherwise facilitate movement but does not fall free of the luggage 200 without being deliberately removed by removing the second portion 520 from the first portion 510.

FIGS. 5C-5D and 5M-5R provide additional views of the example wheel assembly 500. As shown in the examples of FIGS. 5M, 5O, 5P, and 5R, a rod, dowel, bolt, shaft, or other cylindrical segment 515 connects the first portion 510 and the second portion 520 and passes through an opening in the wheel 530 to position and contain the wheel 530 with respect to the assembly 500 while allowing the wheel 530 to roll or otherwise move when contacting a surface (e.g., a floor, ground, etc.) and subjected to a moving force.

In certain examples, the wheel assembly 500 including portions 510, 520, rod 515, wheel 530, etc., can be formed from a PC-ABS composite or other material providing rigidity and durability. In certain examples, the wheel 530 can be formed of rubber or other flexible material. The elements 510, 520, 530 of the wheel assembly can be injection molded and combined (e.g., snapped together, screwed together, etc.) to affix the portions 510, 520 with the member 515 in between and the wheel 530 positioned about the rod member 515.

FIGS. 5S-5T illustrate example views of the wheel assembly 500 attached to the second portion 200 of the luggage. As shown in the examples of FIGS. 5S and 5T, the first portion 510 is connected to the attachment area 230 of the second portion 200 (e.g., snapped, screwed, press fit, etc.). The wheel 530 is movably positioned about the rod 515 (not shown in these views) so that the wheel 530 can roll but is secured between the first portion 510 and the second portion 520 of the wheel assembly 500. As such, the second portion 520 of the wheel assembly is attached to the first portion 510 (e.g., snapped, screwed, press fit, etc.).

Figure 6A:
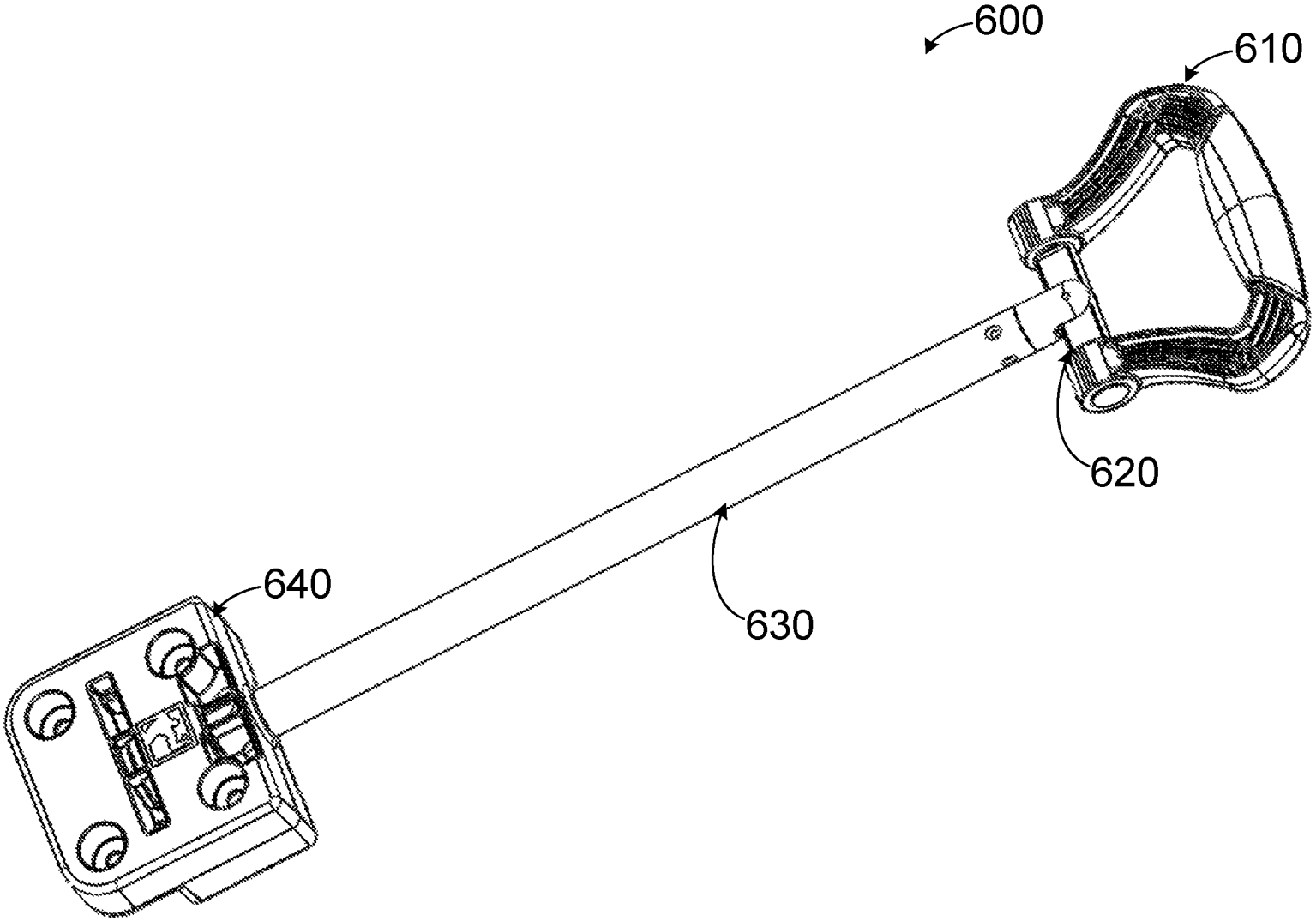
FIGS. 6A-6Y illustrate example views of an articulated luggage handle, which can be implemented separately or with the modular luggage frame of FIGS. 1A-4C and/or the luggage wheel assembly of FIGS. 5A-5R.
Figure 6B:
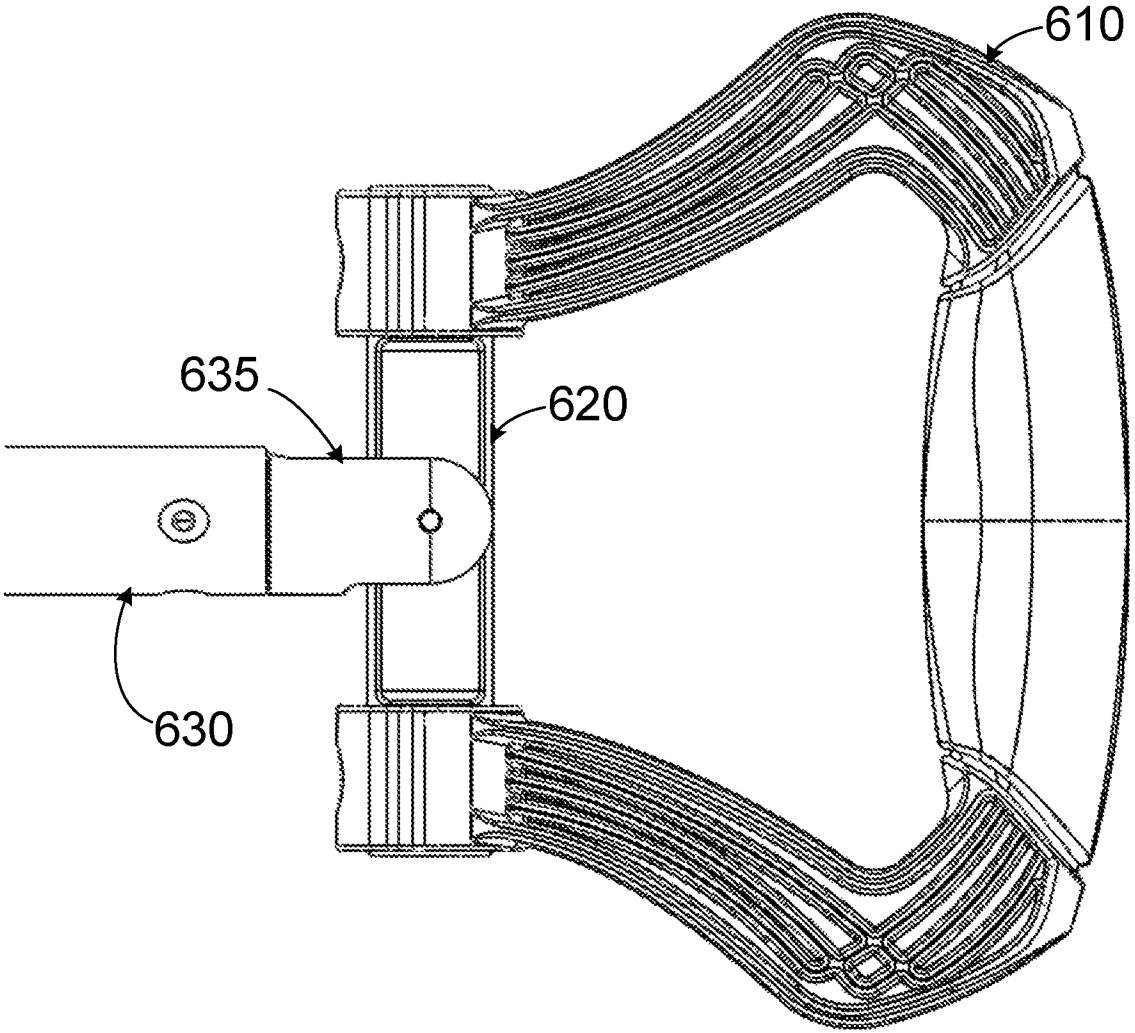
Figure 6C:
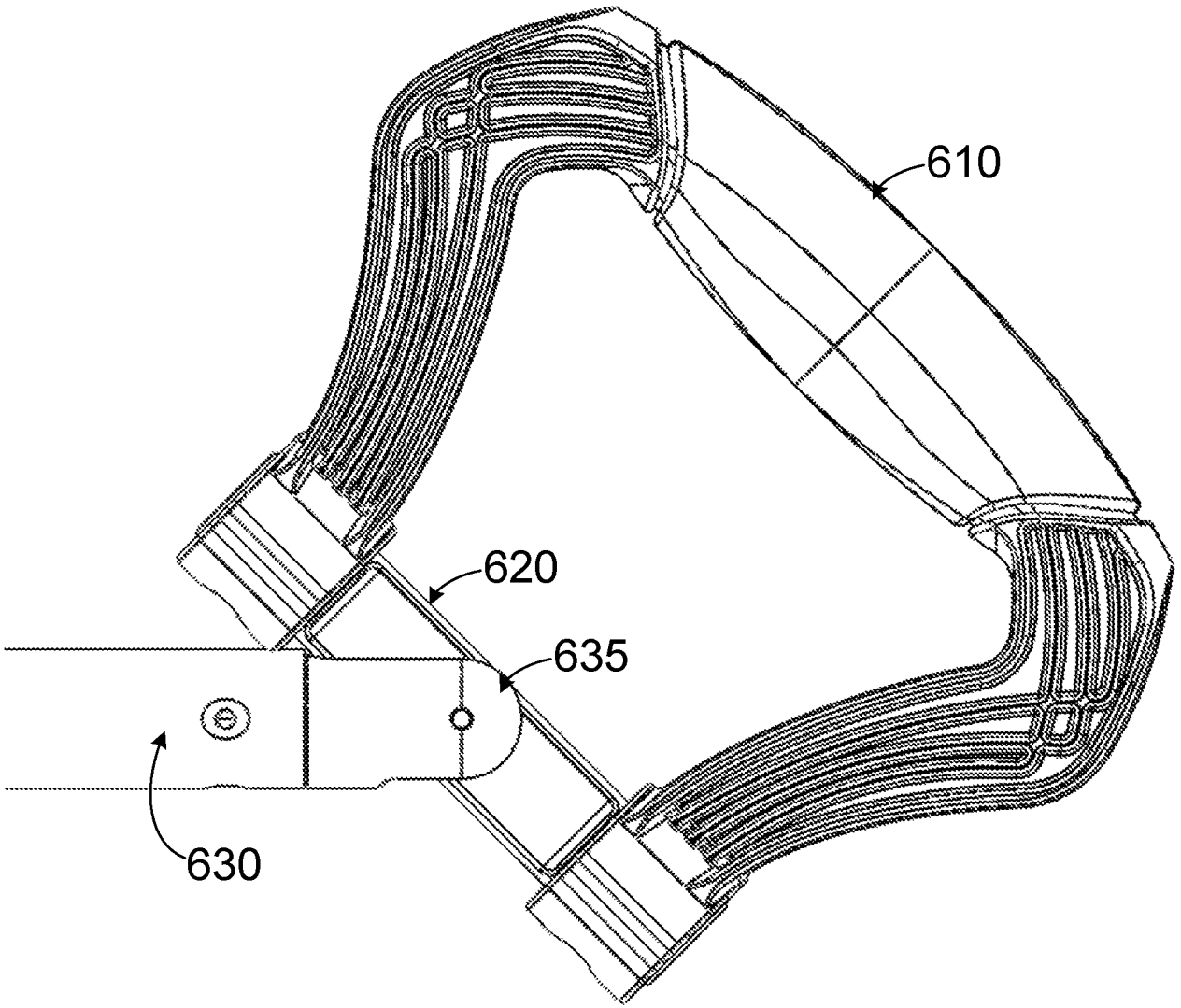
Figure 6D:
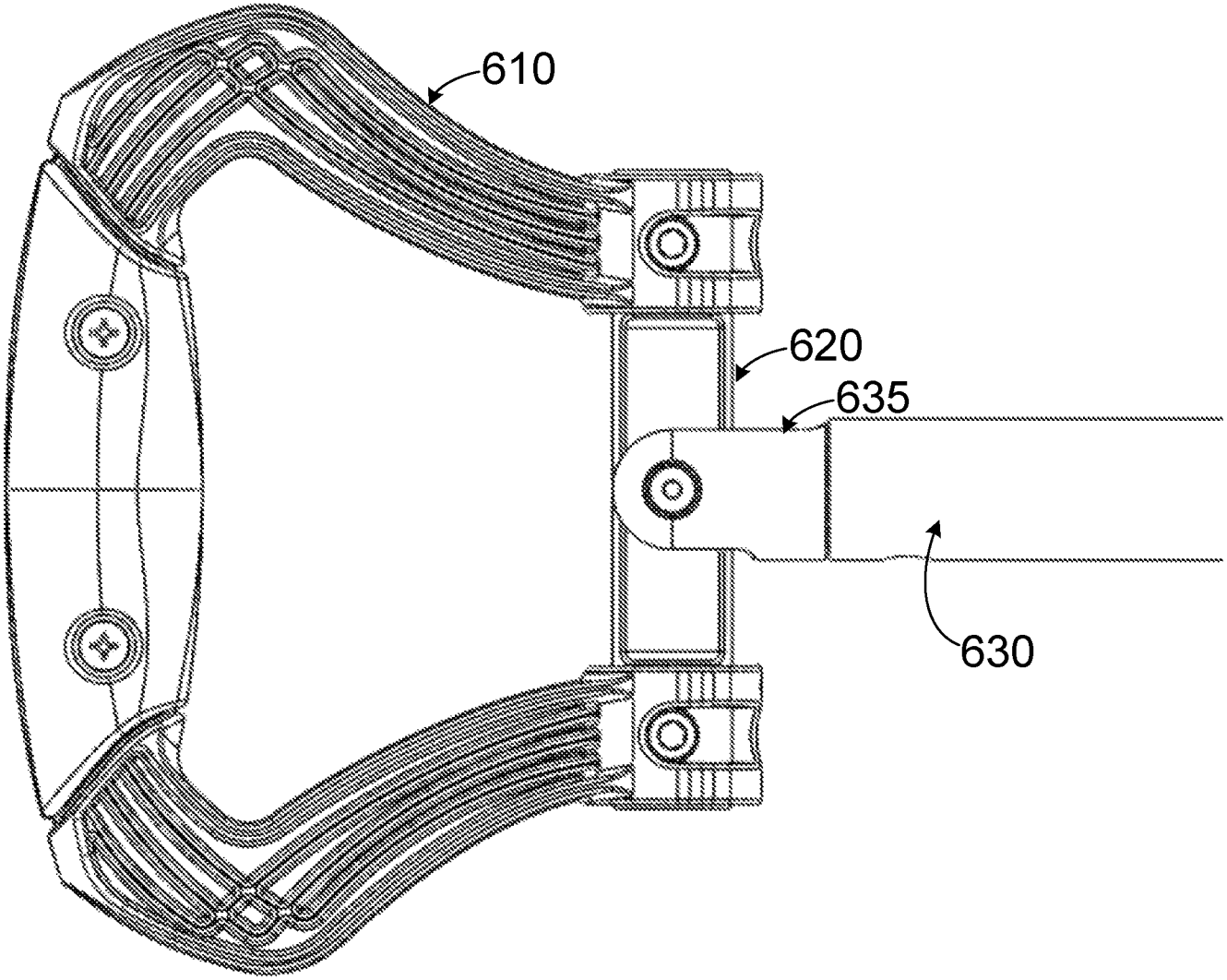
Figure 6E:
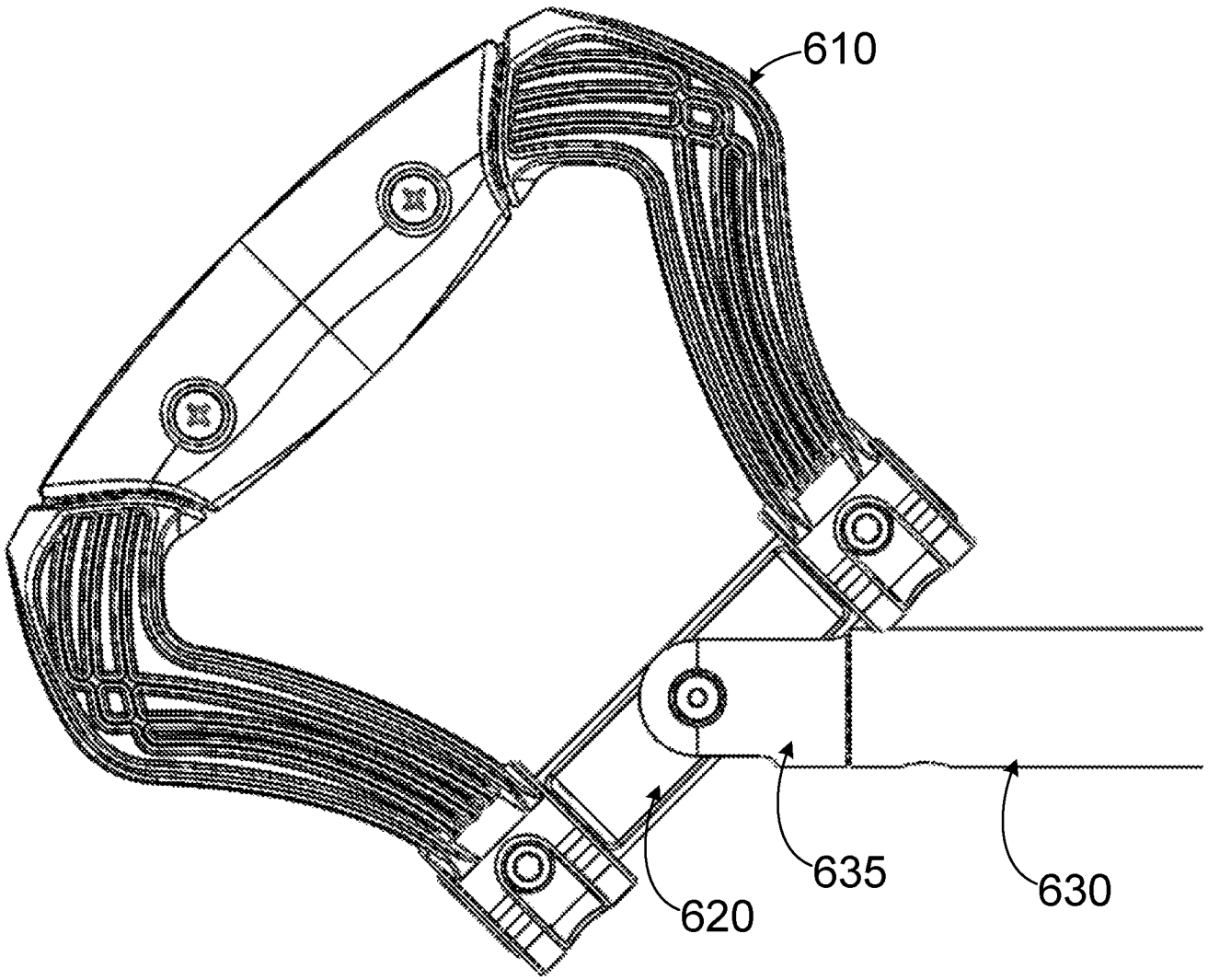
Figure 6F:
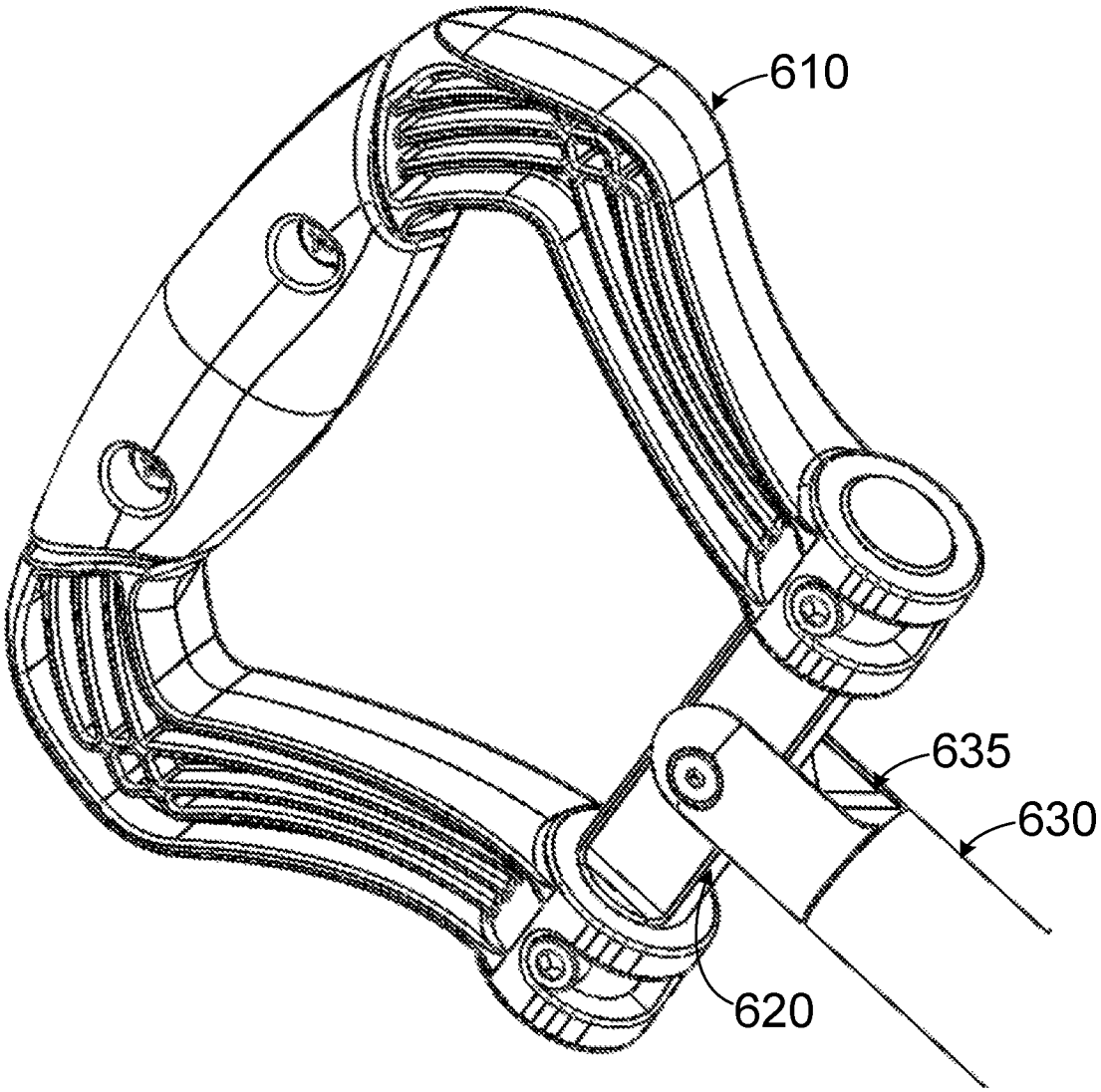
Figure 6G:
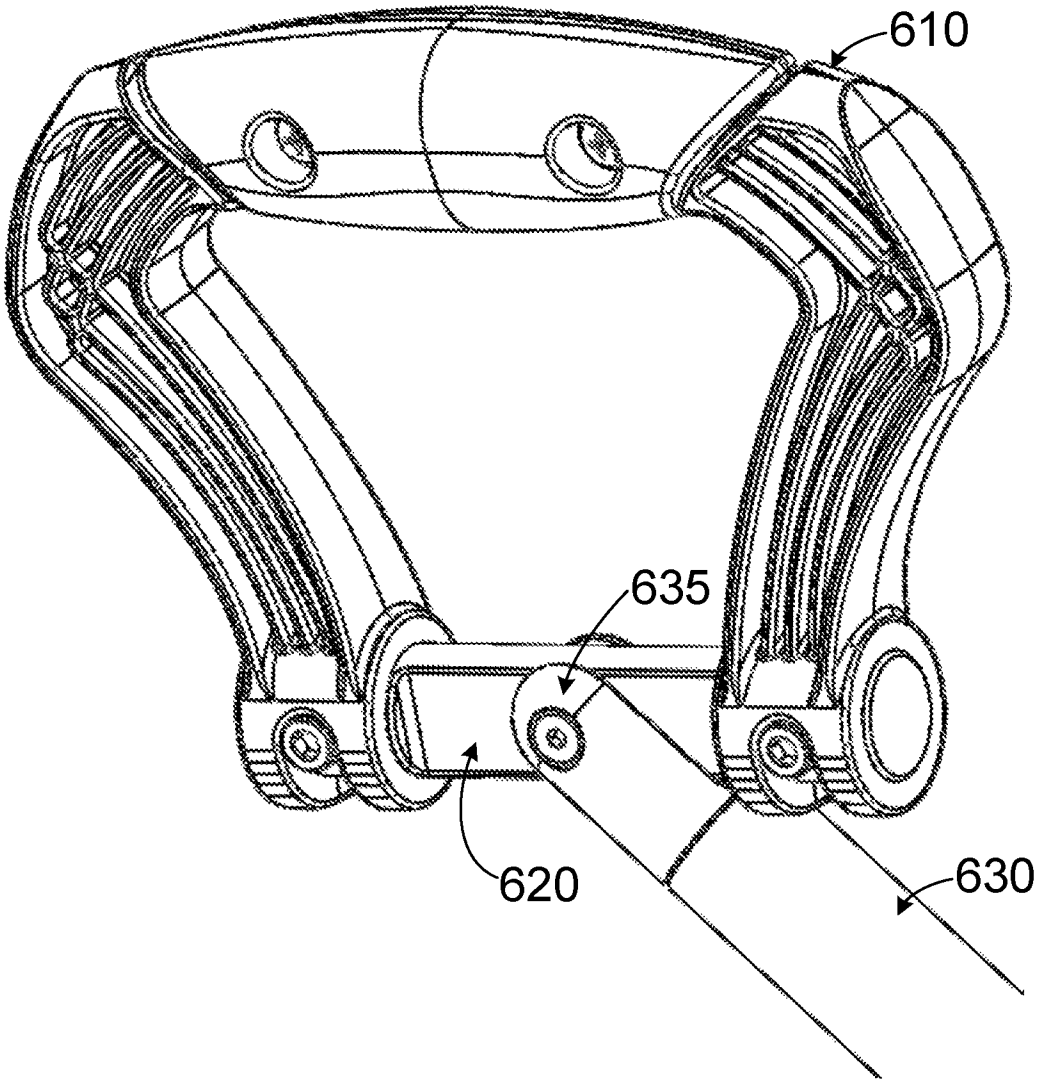
Figure 6H:
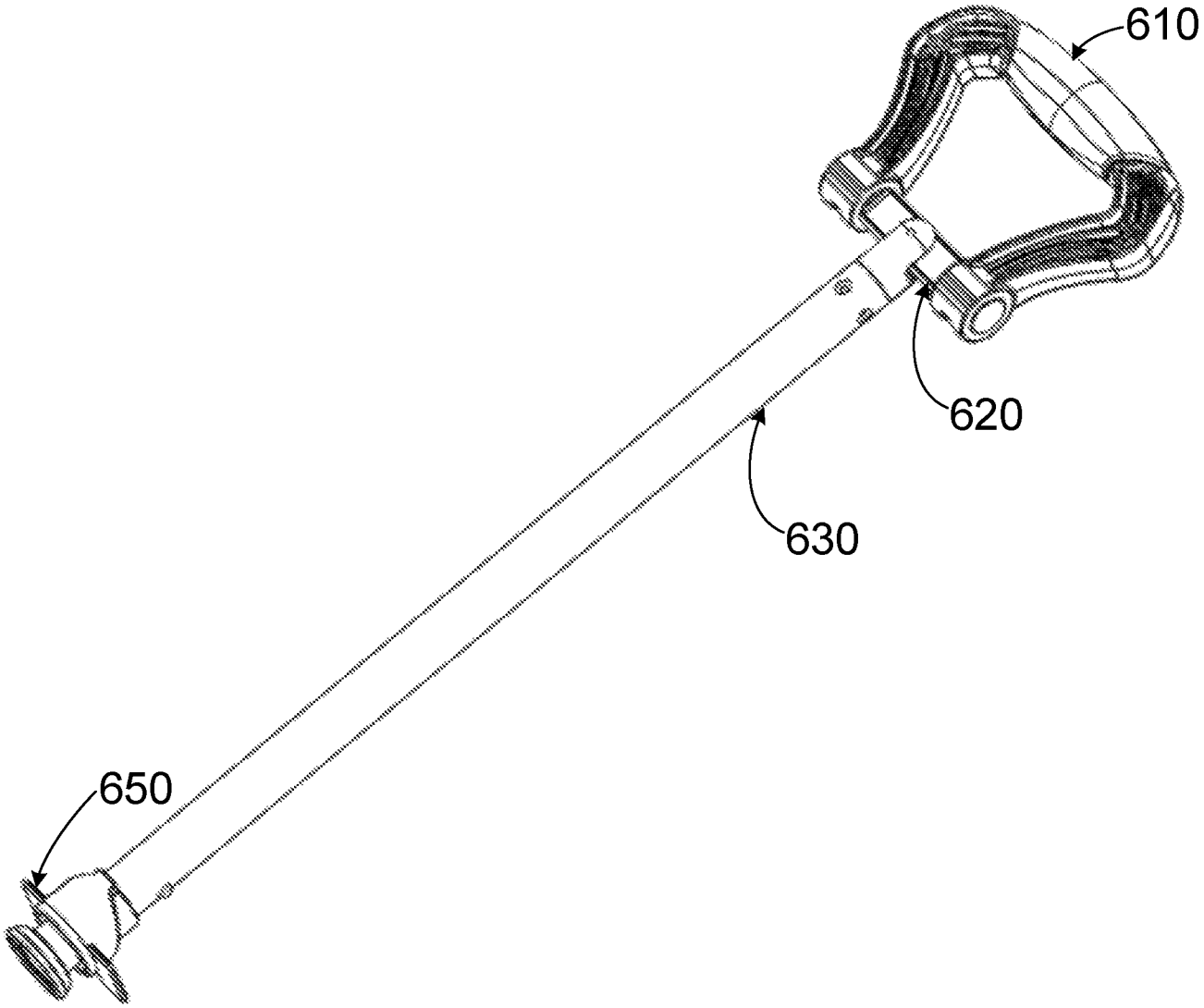
Figure 6I:
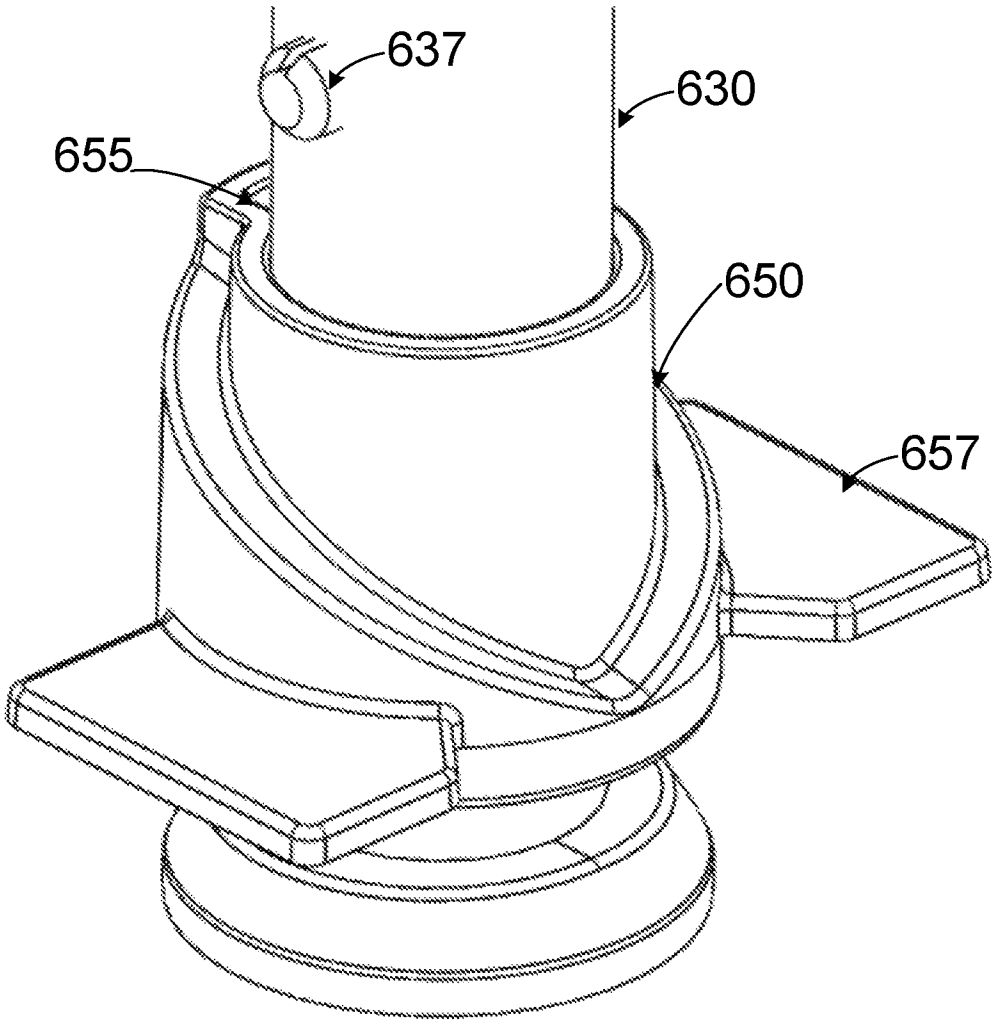
Figure 6J:
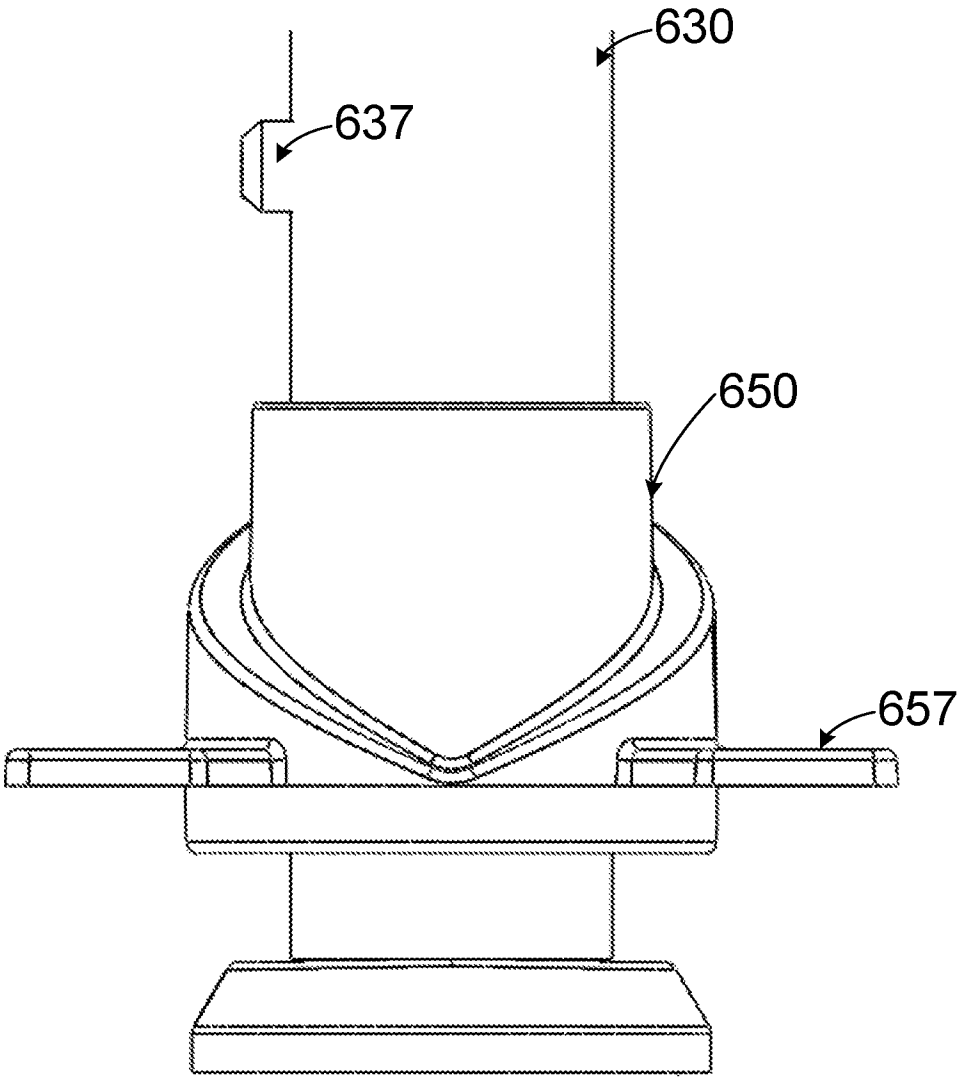
Figure 6K:
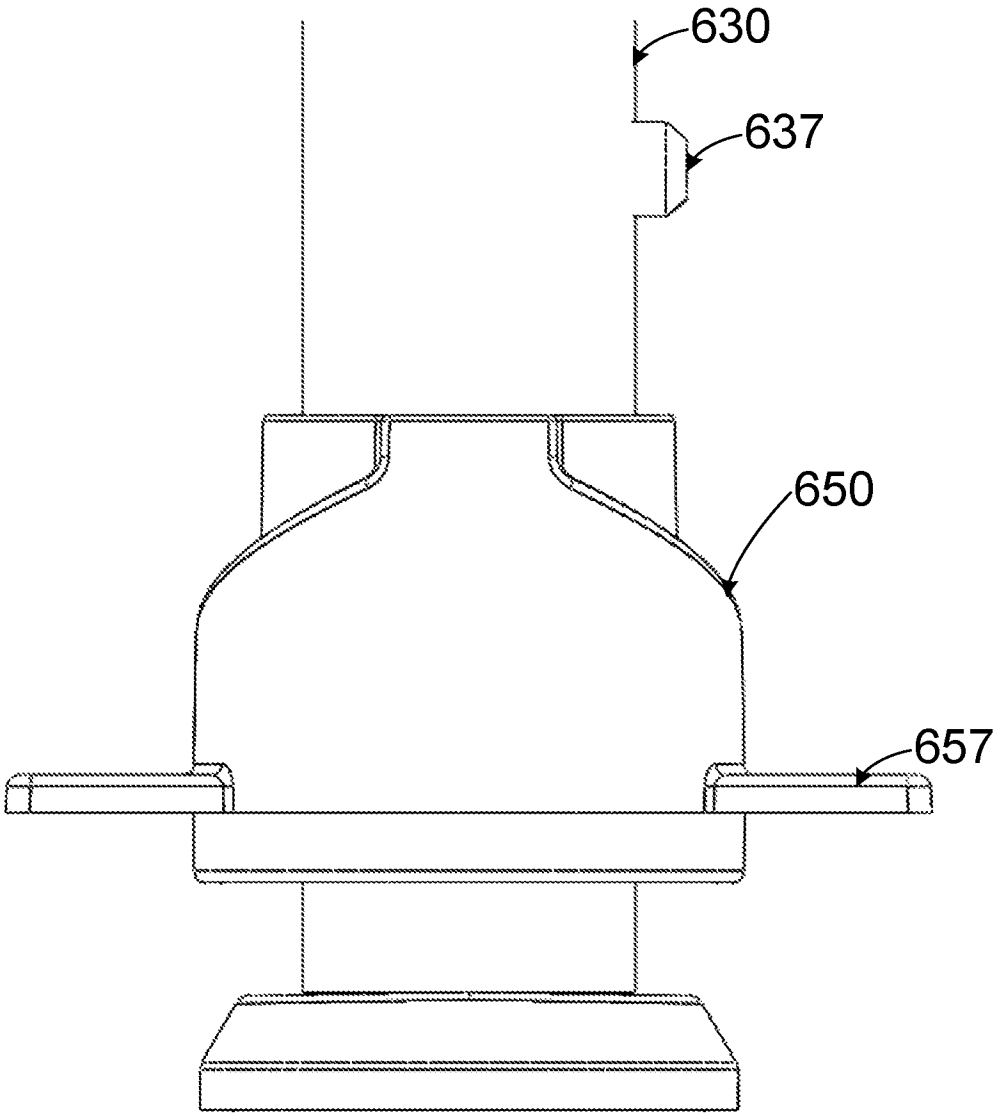
Figure 6L:
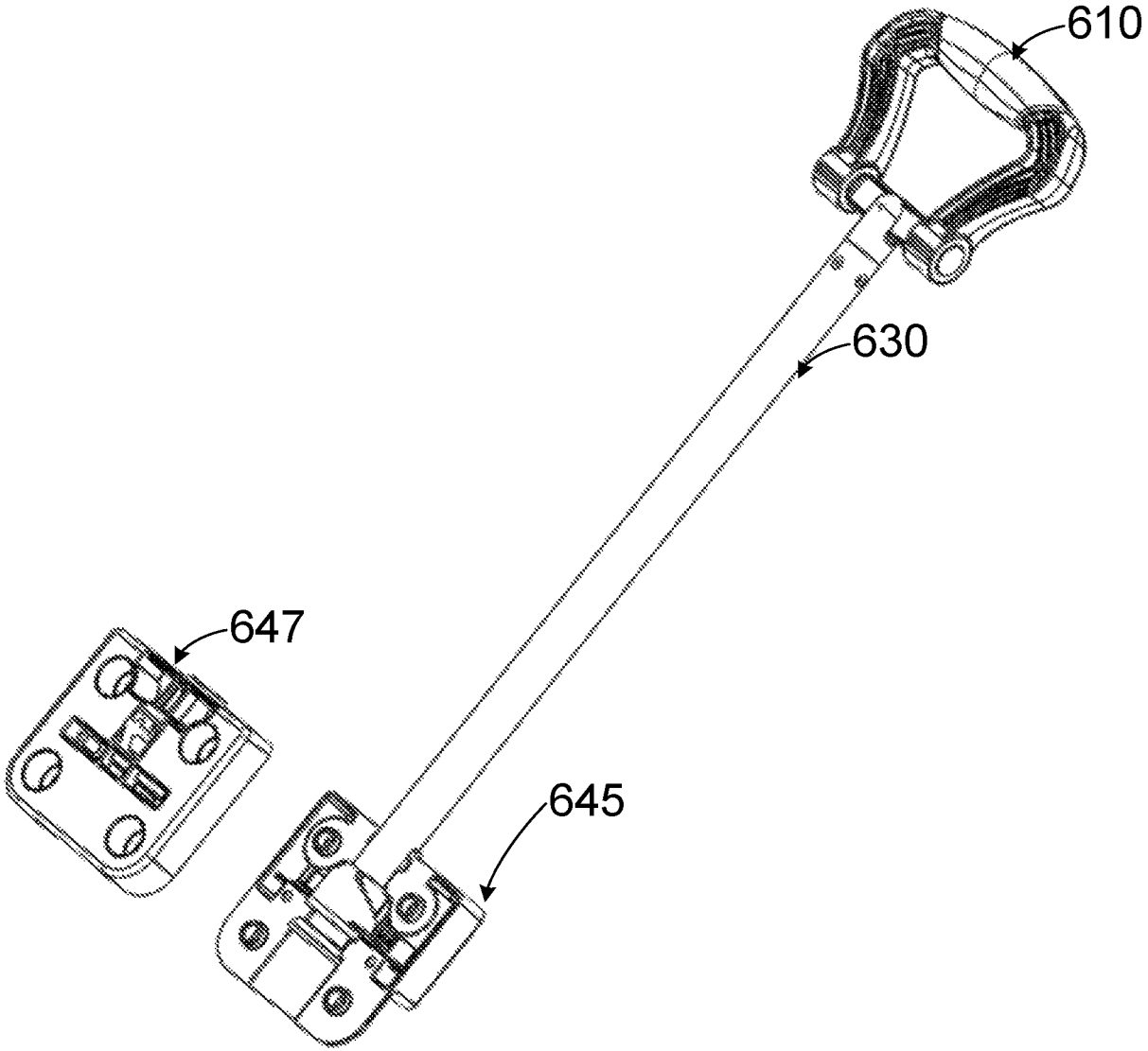
Figure 6M:
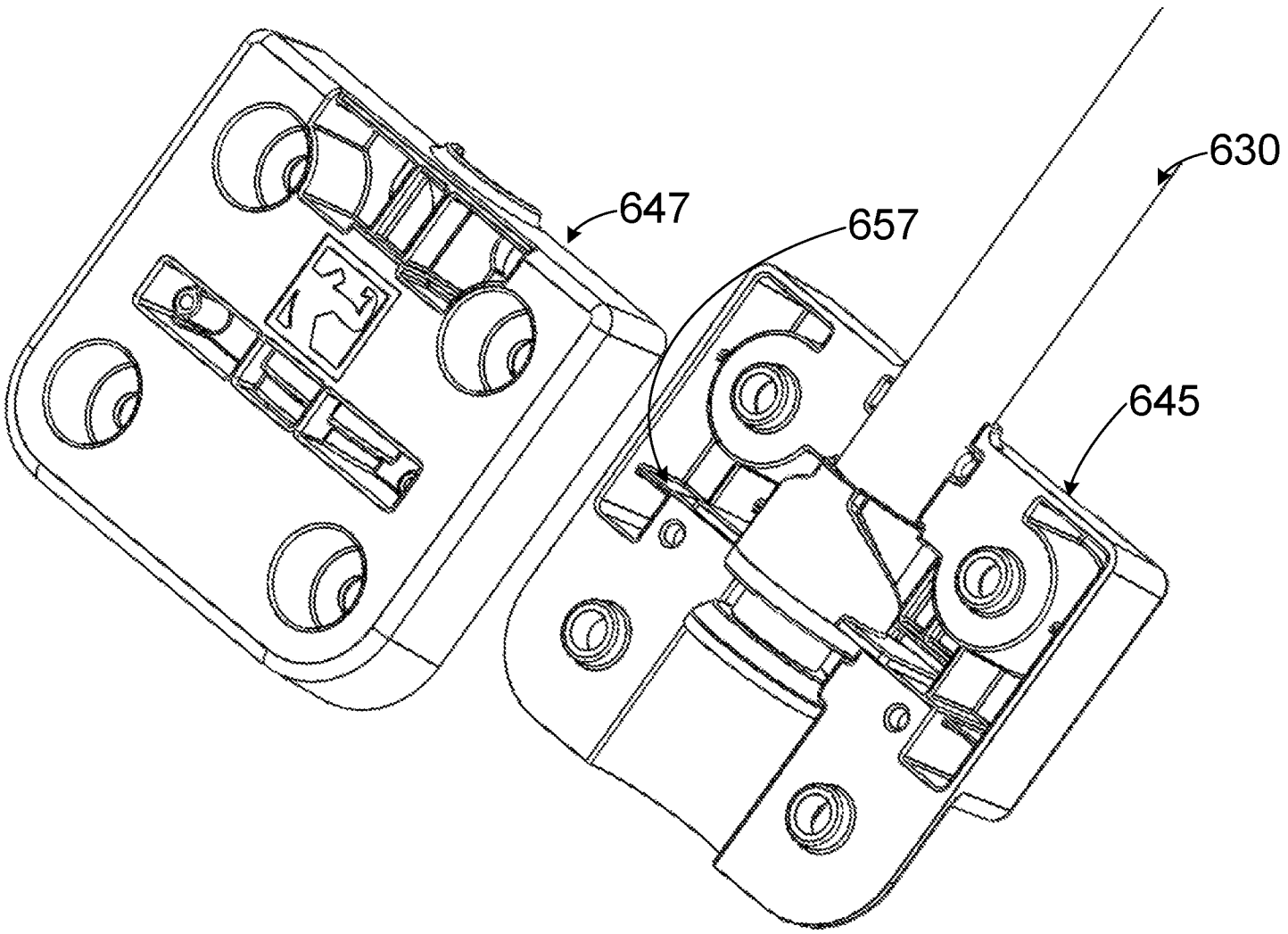
Figure 6N:
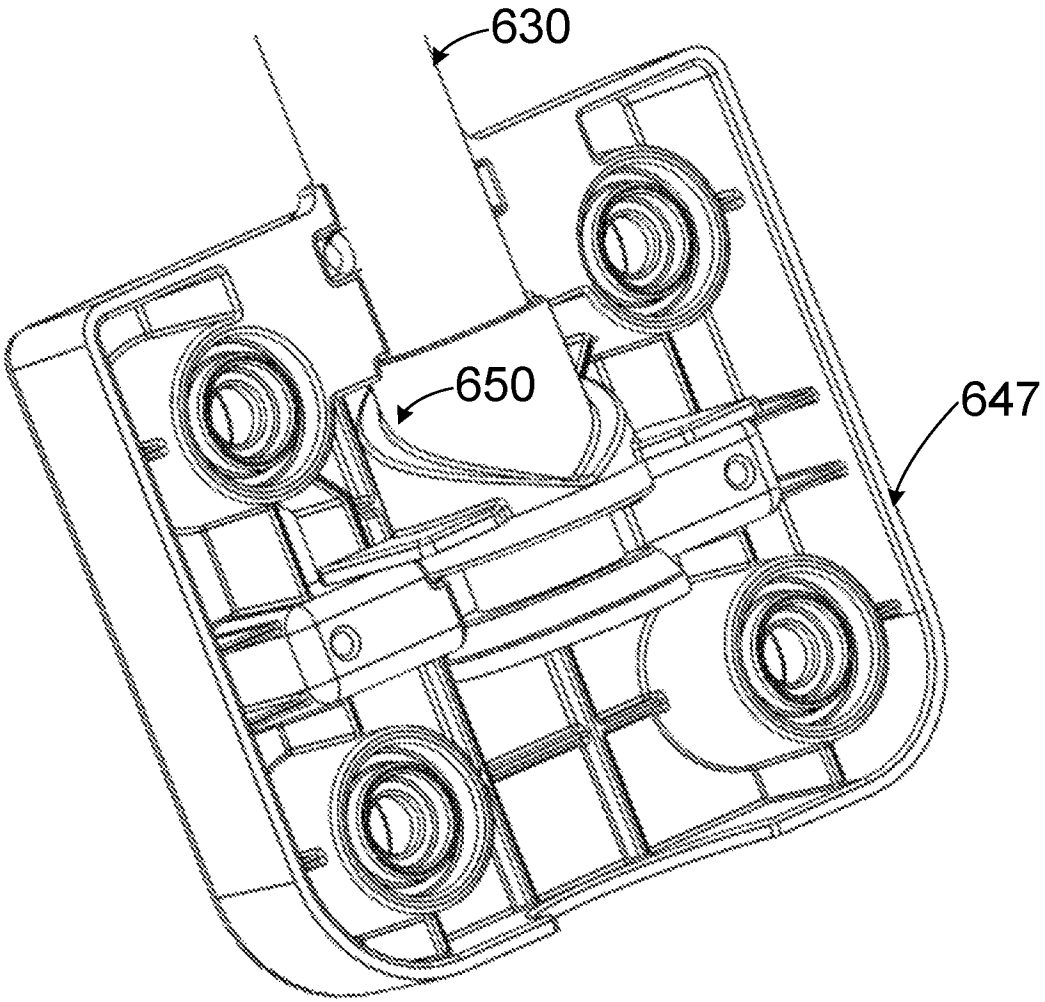
Figure 6O:
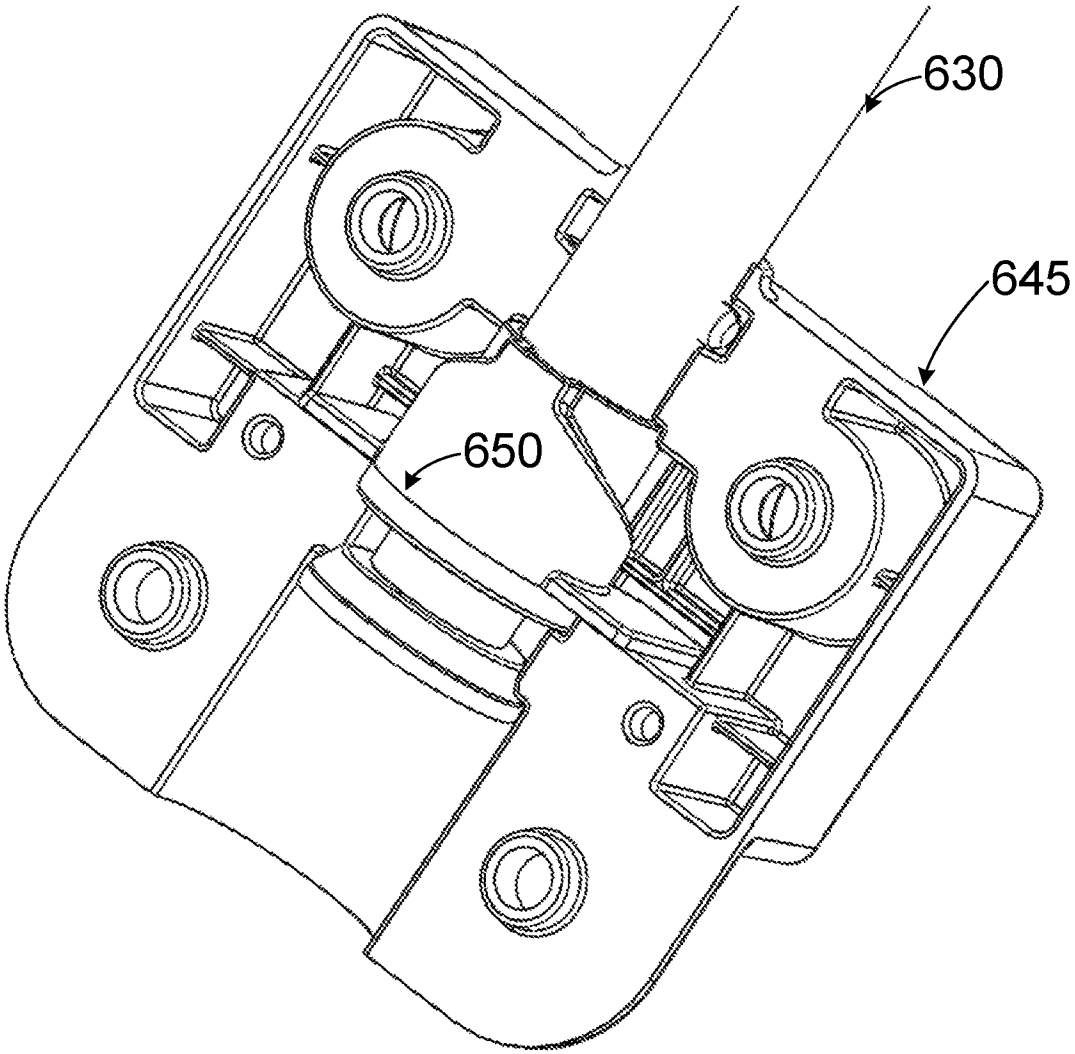
Figure 6P:
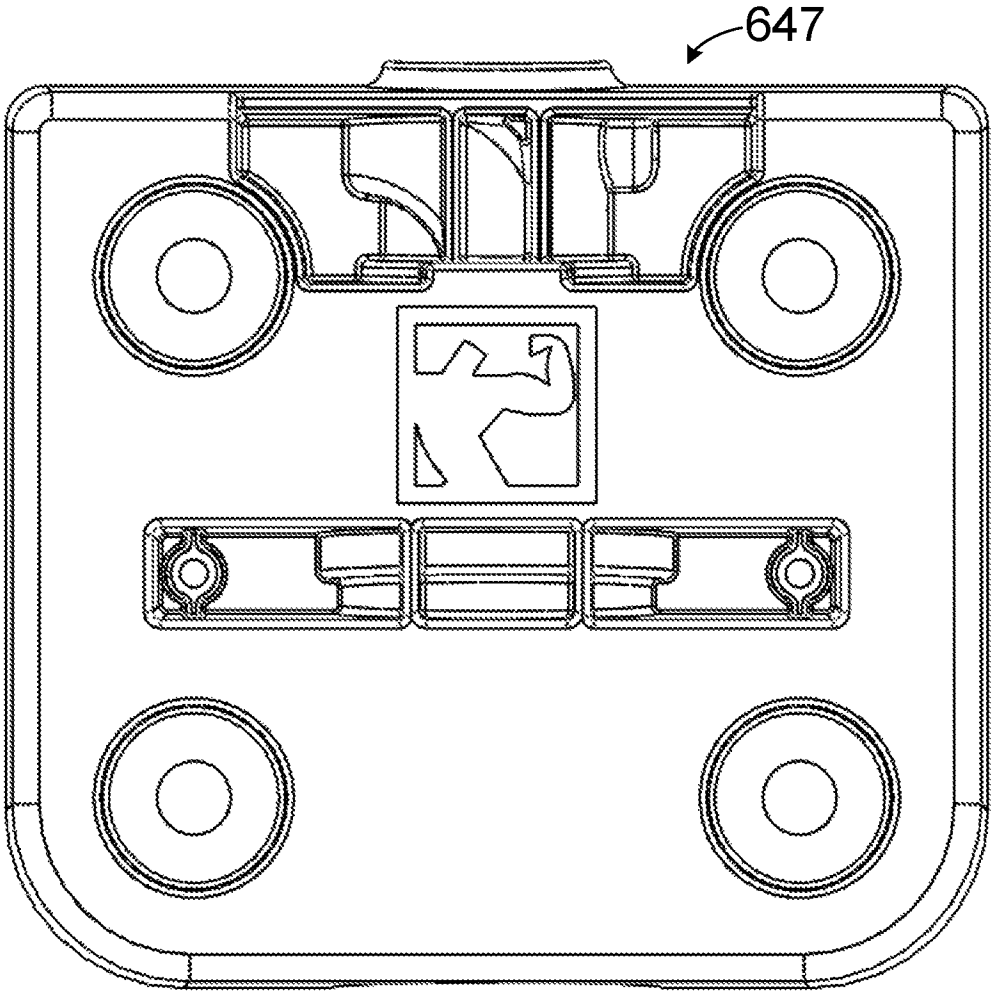
Figure 6Q:
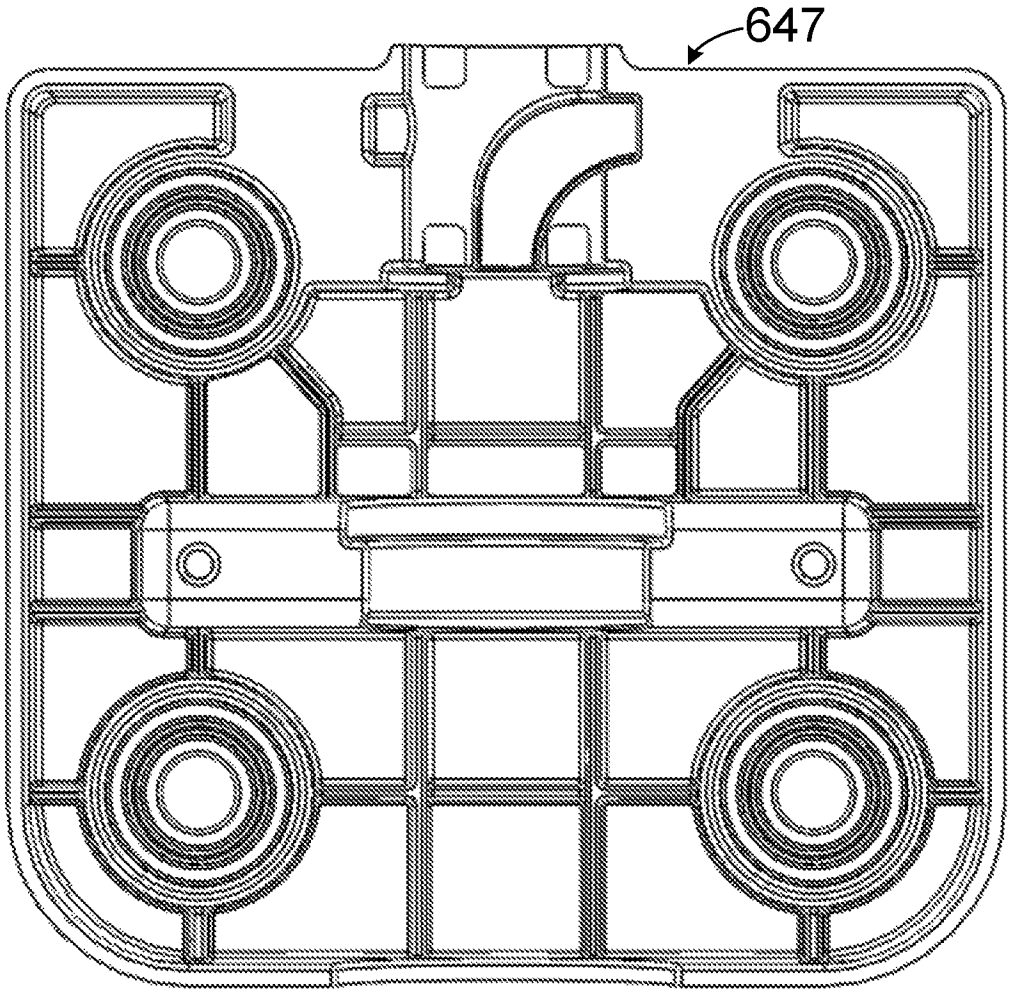
Figure 6R:
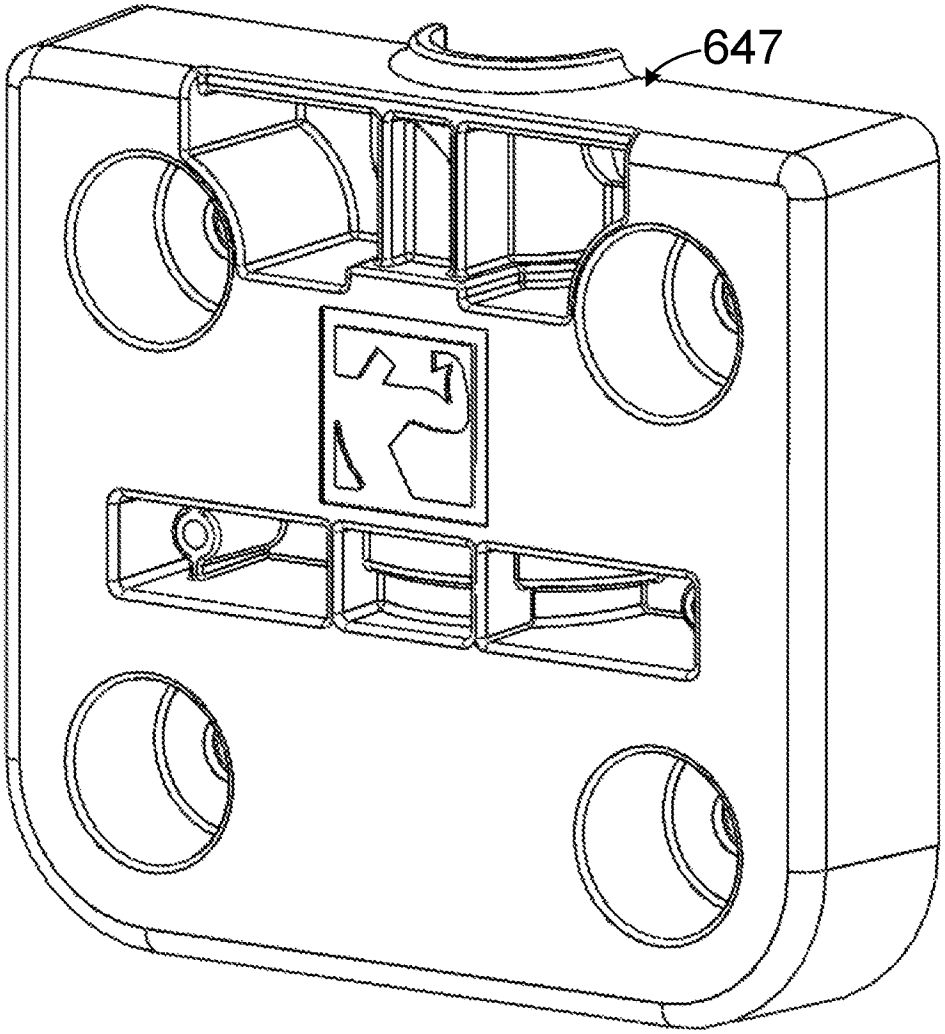
Figure 6S:
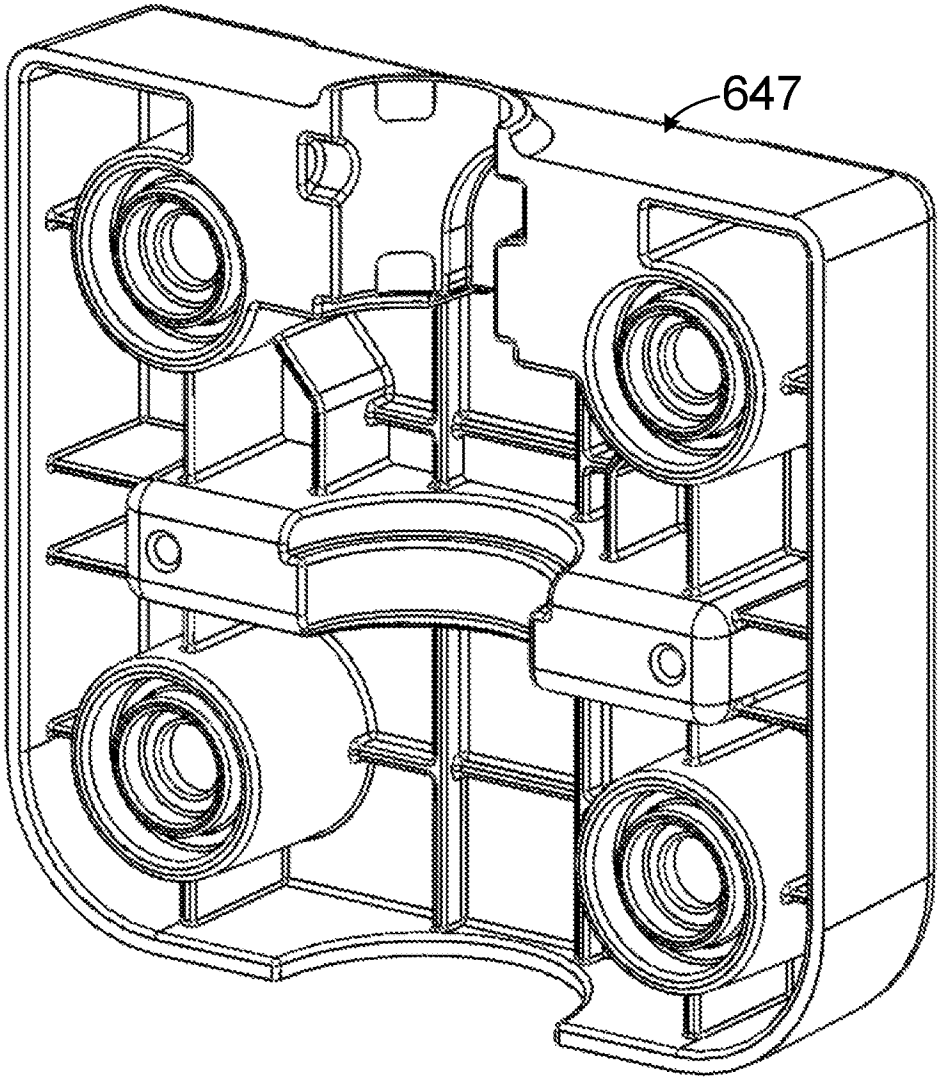
Figure 6T:
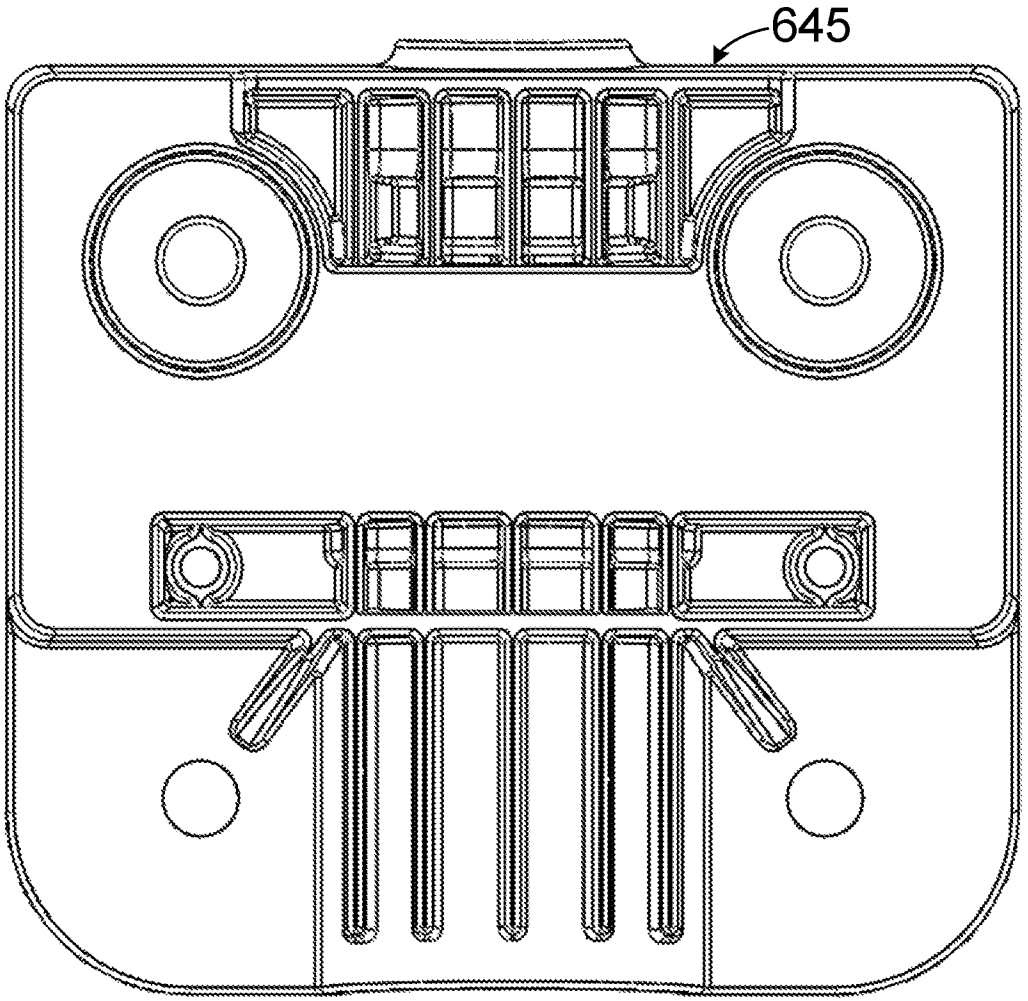
Figure 6U:
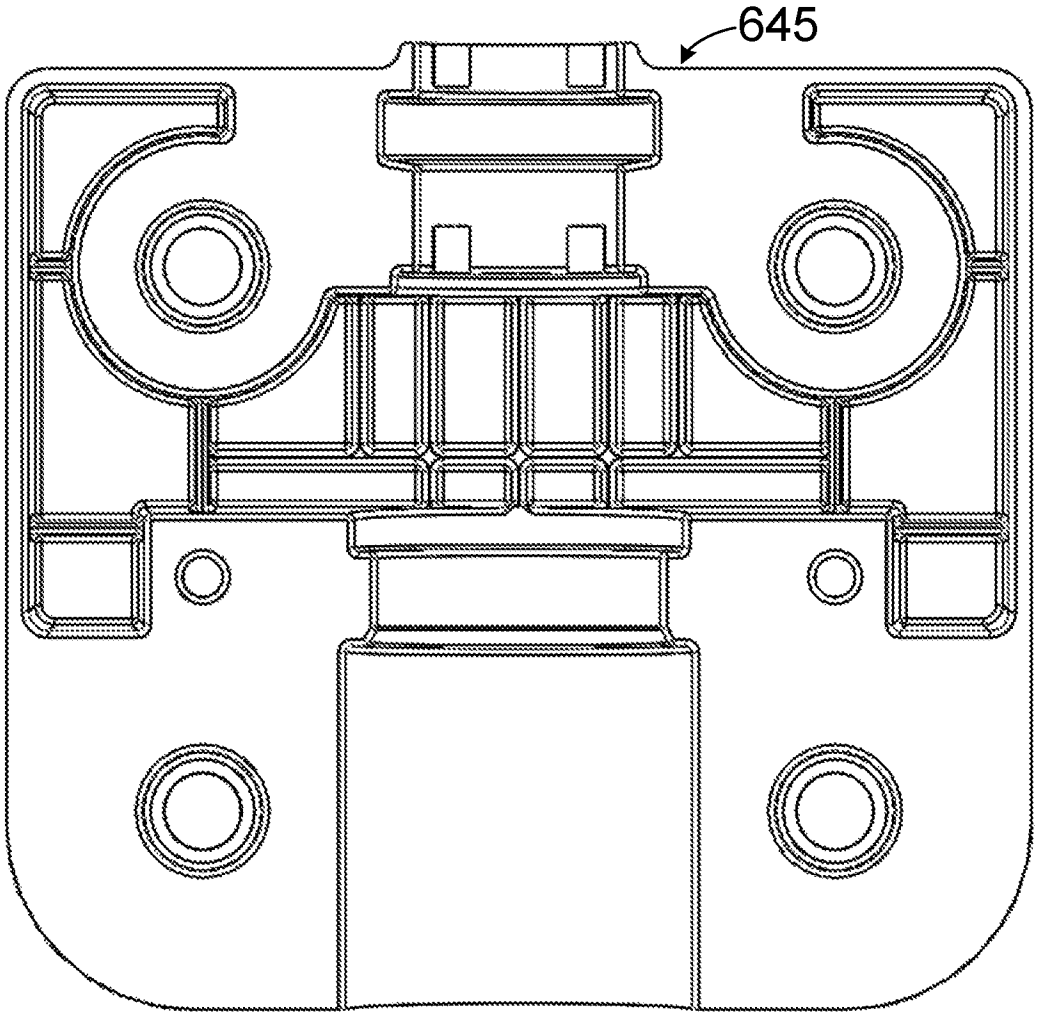
Figure 6V:
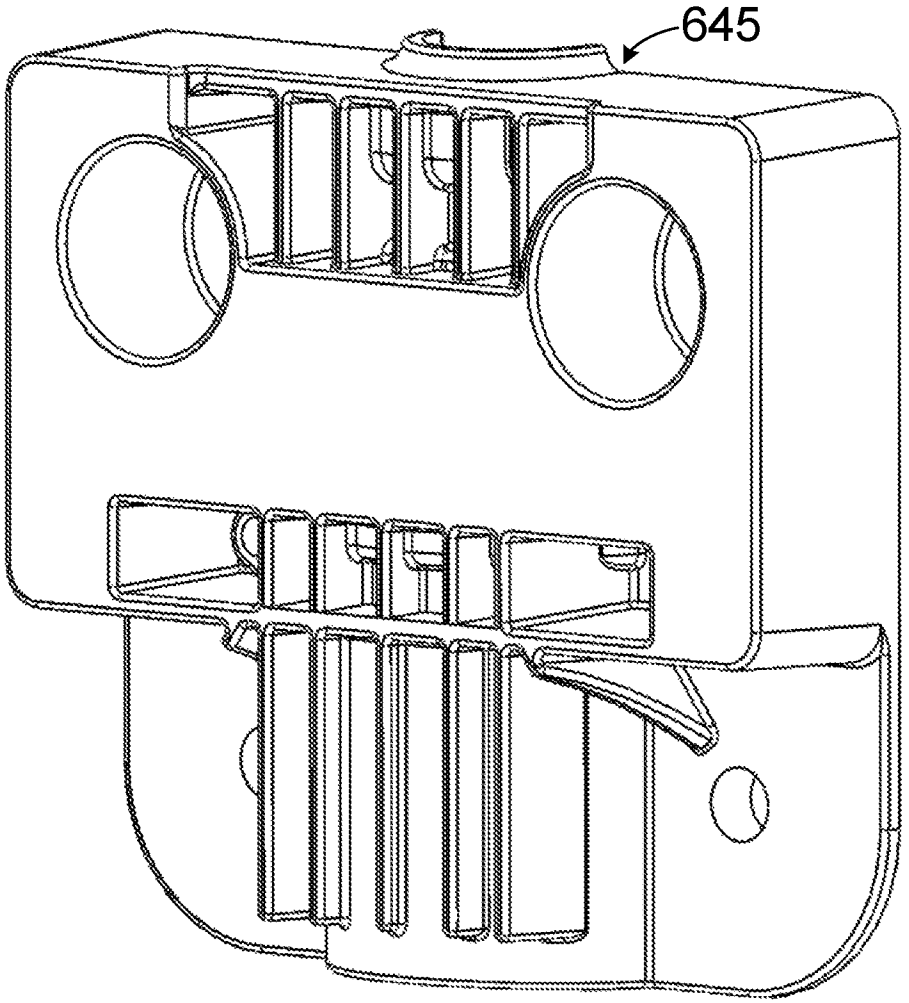
Figure 6W:
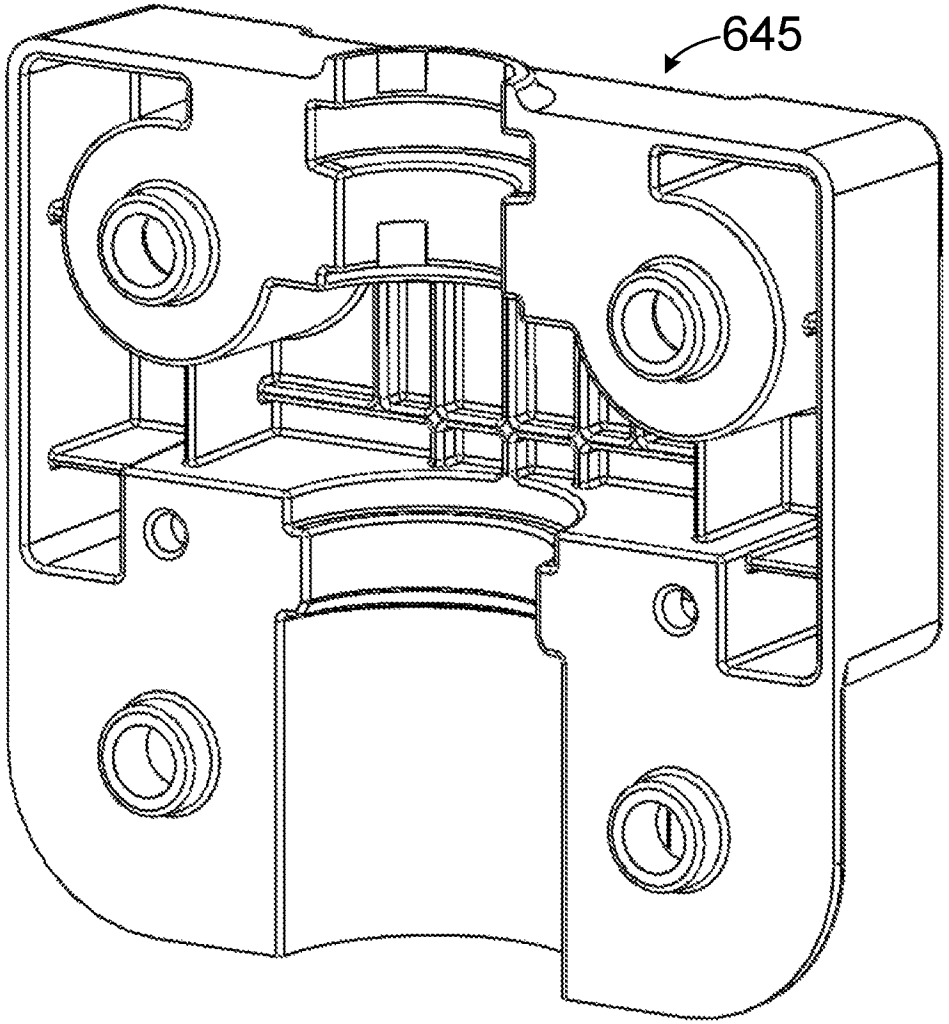
Figure 6X:
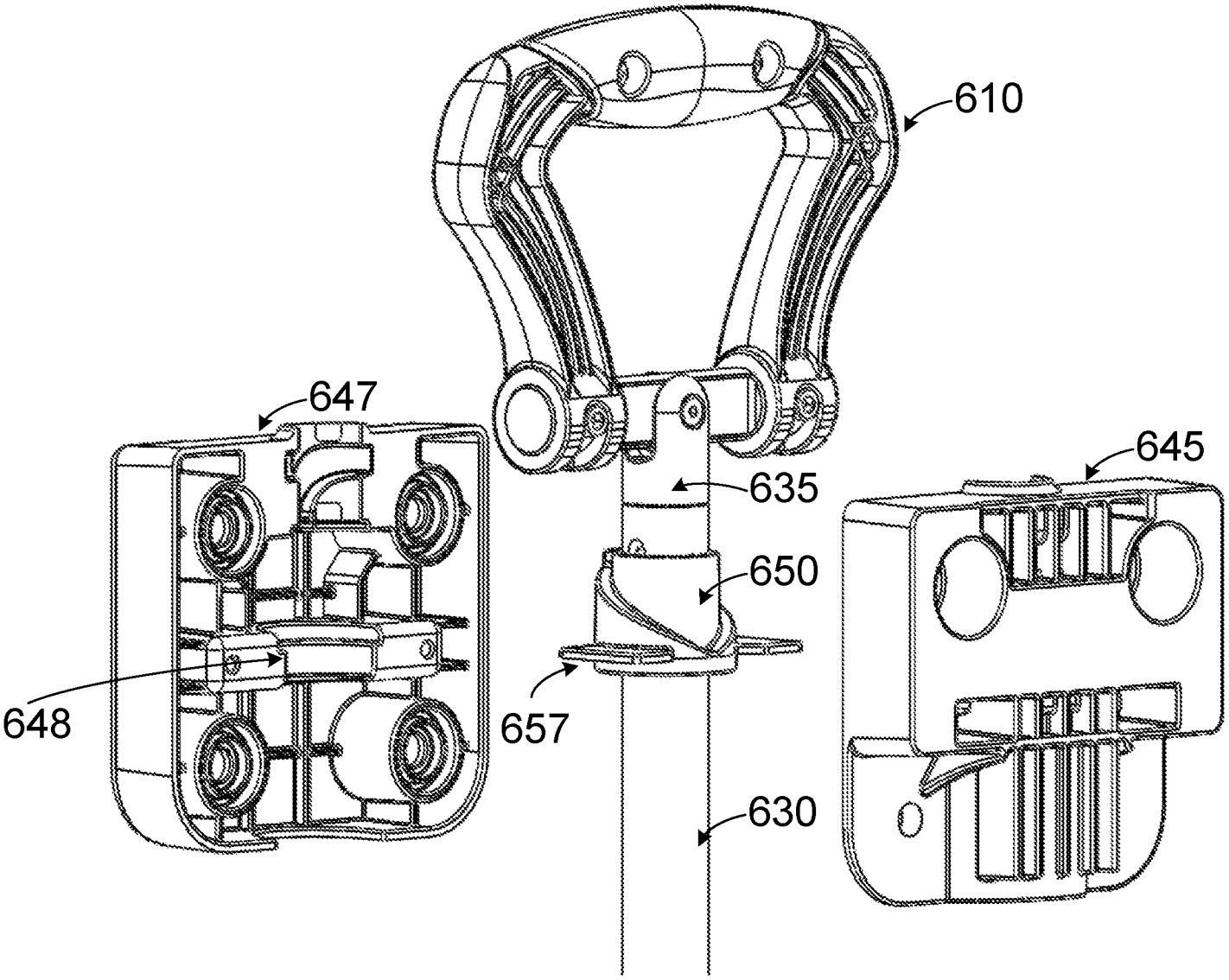
Figure 6Y:
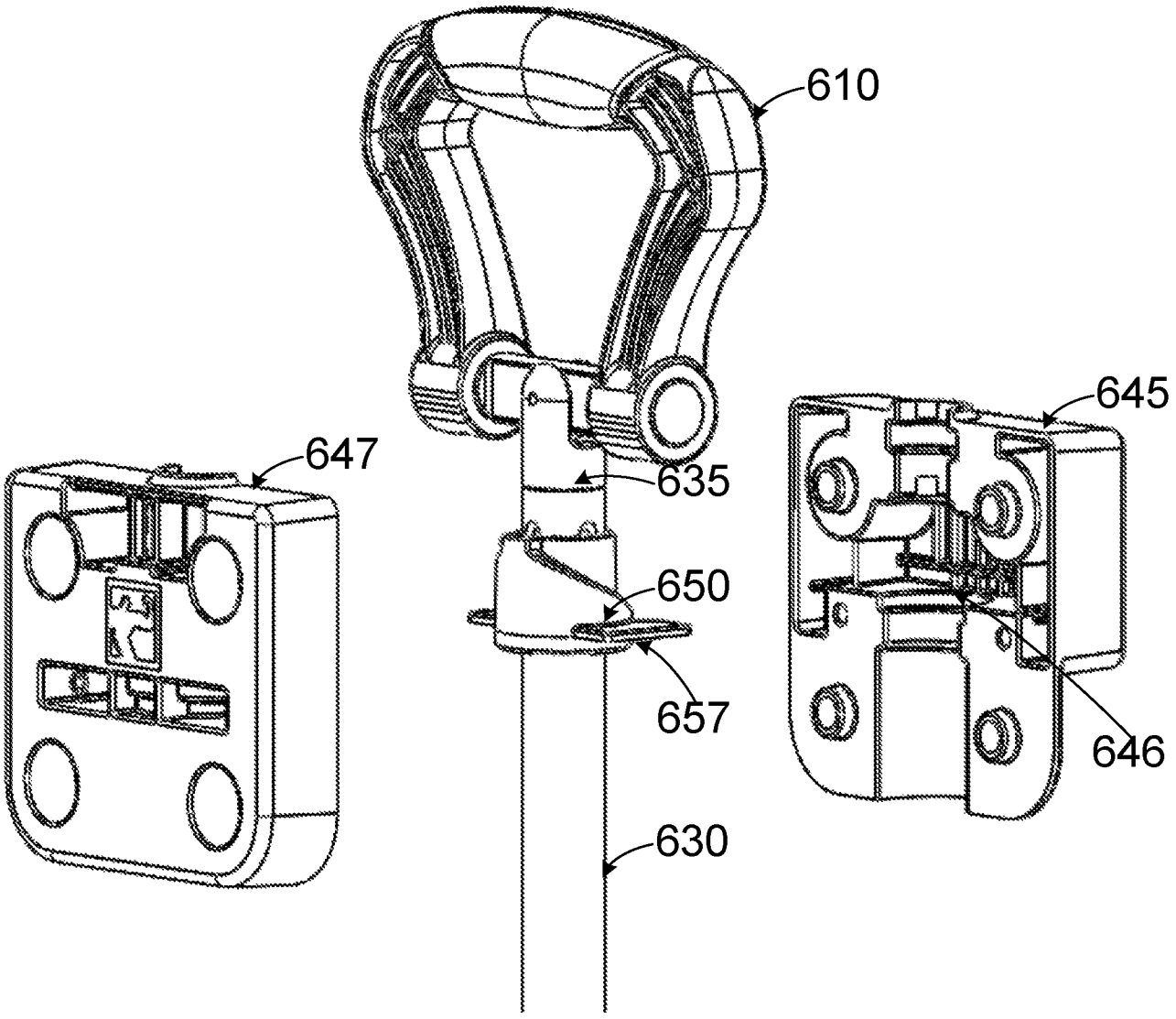

FIGS. 6A-6Y illustrate example articulating handle assemblies 600 that can be positioned with respect to the first portion 100 to enable movement of the modular luggage frame formed from portions 100, 200. For example, the articulating handle assembly 600 can be positioned with respect to (e.g., inside and out of) the first portion 100 of the modular luggage frame to allow the modular luggage to be pulled, pushed, stopped, lifted, and/or otherwise moved in a controlled fashion. The example handle assembly 600 can also be used in other luggage apart from the modular frame of first and second portions 100, 200 (e.g., non-modular carry-on luggage, other bags, etc.).

As shown in the examples of FIGS. 6A-6Y, the handle assembly includes a handle 610, a center portion or member 620, a shaft 630, and a lock box or attachment mechanism 640. The example handle 610 is formed of a composite material (e.g., 30% fiberglass/70% nylon plus an overmold of rubber/thermoplastic elastomer (TPE)) to form a handle 610 that is strong but soft to touch. In certain examples, the handle 610 is formed of glass-filled nylon. The example center portion 620 attached to the handle 610 can be formed form TPE molded over glass-filled nylon, for example. The tube or shaft 630 is formed of a woven carbon fiber fabric that hardens to form the shaft 630. The tube 630 is molded separately of carbon fiber and cut to length, for example. The tube 630 can then be coated with an extrusion for further protection, for example. The example lock box 640 can be formed from a PC-ABS composite or other material providing rigidity and durability, for example. Metal parts used to secure portions of the handle assembly 600 can be machined (e.g., using a Computer Numerical Control (CNC) machine, etc.) and used to form the handle assembly 600 from its constituent parts, for example.

FIGS. 6B-6G provide further detail regarding the handle 610 and upper portion of the handle assembly 600. As shown in the example of FIG. 6B, the handle 610 is attached to the shaft 630 using the center member 620 which attaches to the handle 610 and passes through a pivot 635 connected to the shaft 630. The pivot 635 can be formed out of an aluminum alloy (e.g., 6061 aerospace-grade aluminum alloy, etc.) and/or other lightweight, sturdy metal, for example. As illustrated in the examples of FIGS. 6B-6G, the center portion 620 and the pivot 635 allow the handle 610 to be articulated in a number of directions/orientations with respect to the shaft 630. As such, while a user is pulling luggage, the user can adjust his or her positioning of the handle 610 without affecting a position of the shaft 630 and associated luggage. For example, the user can find a comfortable grip of the handle 610 by angling or articulating it with respect to the shaft 630 without affecting position of the shaft 630 and motion of the associated luggage.

FIG. 6H illustrates the example handle assembly 600 without portions of the lock box 640. As shown in the example of FIG. 6H, a locking collar or cam 650 is used with the lock box 640 (not shown in this view) to position and affix the handle assembly 600 in a suitcase, bag, or other luggage. FIG. 6I provides a zoomed view of the locking collar 650 positioned on the shaft 630 of the handle assembly. As shown in the example of FIG. 6I, the locking collar 650 includes a notch or protrusion 655 at the end of a curved channel internal to the collar 650. As the collar 650 is moved along the shaft 630, the shaft can be twisted to lock the shaft 630 in place with respect to the collar 650. For example, a protrusion, nub, or pin 637 on the shaft 630 enters the notch 655 and rotates through the channel in the collar 650 until it is locked in place.

For example, the shaft 630 can pass through the opening 130 in the first portion 100 of the modular luggage frame (e.g., as shown in the example of FIG. 1C) and the locking collar 650 in the lock box 640 is positioned at the attachment area 120. The shaft can move up or down with respect to the first portion 100 but can be locked in place using the locking collar 650 and the lock box 640 with respect to the nub or protrusion 637 on the shaft 630. FIGS. 6J-6K illustrate example front (FIG. 6J) and back (FIG. 6K) views of the locking collar 650 on the shaft 630.

FIG. 6L illustrates the example handle assembly 600 with the lock box 640 separated into two portions 645, 647. FIG. 6M provides a zoomed in view of the portions 645, 647 of the lock box. As shown in the example of FIG. 6O, the shaft 630 and its locking collar 650 can be positioned with respect to a portion 645 of the lock box 640 and stabilized using the wings, arms, or protrusions 657 from the collar 650. FIG. 6N shows the shaft 630 and collar 650 positioned with respect to the other portion 647 of the lock box 640. FIGS. 6P-6W depict other views of the example lock box 640. As such, the lock box 640 can be affixed (e.g., by screws, etc.) to the attachment area 120 of the first portion 100 of the modular luggage frame and/or other luggage/device. The shaft 630 with locking collar 650 passes through the lock box 640 and can be freely moving between the interior and exterior of the luggage to adjust a usable length of the shaft 630. The shaft 630 with locking collar 650 can be twisted to lock in place and be secured for manipulation and movement of the attached luggage, for example.

FIGS. 6X-6Y provide additional views of the portions 645, 647 of the lock box 640 displayed in conjunction with the shaft 630, handle 610, central member 620, and pivot 630. As shown in the examples of FIGS. 6X and 6Y, the locking collar 650 can be used to position the shaft 630 in a variety of positions (e.g., at a variety of lengths) between the portions 645, 647 of the lock box 640 to adjust how far the shaft 630 and its handle 610 protrude from the luggage to which it is attached (e.g., via the lock box 640 at the attachment area 120. The example of FIG. 6X shows a notch, indentation, or receptacle 648 in which the arms 657 of the collar 650 rest to secure the collar 650 and the shaft 630 in position with respect to the portion 647 of the lock box 640. The example of FIG. 6Y shows a notch, indentation, or receptacle 646 in which the arms 657 of the collar 650 rest to secure the collar 650 and the shaft 630 in position with respect to the portion 645 of the lock box 640. When the portions 645, 647 are attached together, the shaft 630 is secured by the collar 650 in the receptacles 646, 648 of the lock box 640, for example.

Figure 7:
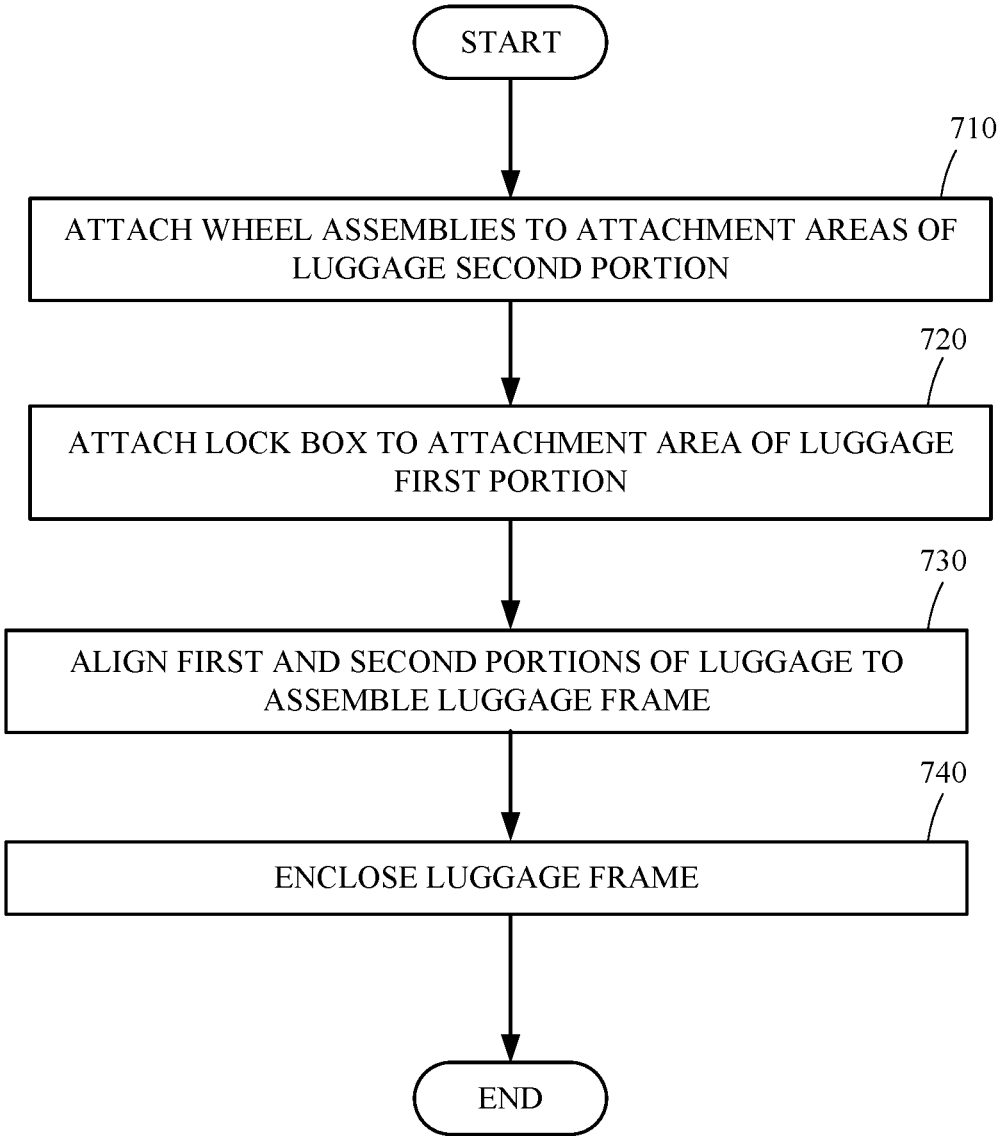
FIG. 7 illustrates an example method of assembly and/or manufacture to construct a luggage item from the components of FIGS. 1A-6Y.

FIG. 7 illustrates an example method 700 of assembly and/or manufacture to construct a luggage item from the components described above. At block 710, the wheel assemblies 500 are attached to the attachment areas 230-231 of the second portion 200 of the luggage. For example, the first portion 510 of the wheel assembly 500 is connected to the attachment area 230 of the second portion 200 (e.g., snapped, screwed, press fit, etc.), and another wheel assembly 500 is connected to the attachment area 231 of the second portion 200. The second portion 520 of the wheel assembly is attached to the first portion 510 (e.g., snapped, screwed, press fit, etc.) with the rod or other cylindrical portion 515 positioned to movably retain the wheel 530 between the portions 510, 520 on each side of the luggage 200.

At block 720, the lock box 640 is attached to the attachment area 120 of the first portion 100 of the luggage. For example, the first portion 647 of the lock box 640 is affixed (e.g., snapped, screwed, press fit, etc.) to the attachment area 120 of the first portion 100. Then the collar 650 is positioned in the receptacle 648 of the portion 647 using the arms 657 of the collar 650. The second portion 645 of the lock box 640 is then positioned and affixed (e.g., snapped, screwed, press fit, etc.) to the first portion 647 to immobilize the collar 650 between the portions 645, 647 of the lock box 640 using the receptacles 646, 648 and the arms 657 of the collar 650, for example.

At block 730, the first portion 100 is aligned and attached with respect to the second portion 200 of the luggage. For example, as shown in FIGS. 3A-3B, the first portion 100 and the second portion 200 can be aligned along the ribs 210-211 of the second portion and a selected pair or set 110-111, 112-113, 114-115 of the ribs 110-115 of the first portion 100. By selecting a pair 110-111, 112-113, 114-115 of the ribs 110-115 of the first portion 100, the first 100 and second 200 portions form modular luggage of varying sizes.

At block 740, the assembled modular luggage frame formed of the first and second portions 100, 200 is enclosed to complete the usable luggage. For example, a cloth, wrap, cover, liner, etc., can then be positioned and/or formed around the luggage shell to enclose the shell and secure contents. A zipper, snaps, hook and loop, and/or other closure can be used to open and close the covering, secure the covering to the modular luggage frame, etc. In certain examples, block 740 is executed as part of the assembly of the luggage. In other examples, blocks 710-730 are executed to prepare the modular frame, and block 740 executed later and/or otherwise separately to complete the luggage for use. In certain examples, the covering is removable to allow a user to set the modular frame position of portions 100 and 200 and can then be reattached/repositioned to enclose the luggage for use.

While example implementations of the modular luggage frame, wheel assembly, and articulating handle, and associated methods of manufacture and assembly, are disclosed and described above, one or more of the elements, processes and/or components illustrated in FIGS. 1A-6Y can be combined, divided, re-arranged, omitted, eliminated and/or implemented in any other way.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

From the foregoing, it will be appreciated that example methods, apparatus and articles of manufacture have been disclosed that provide a modular luggage frame and associated components, methods of manufacture, and assembly.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The following claims are hereby incorporated into this Detailed Description by this reference, with each claim standing on its own as a separate embodiment of the present disclosure.

What is claimed is:

1. A modular luggage frame comprising:

a first portion including:

a first back surface, the first back surface including a first attachment area for a handle;

a first side including a first rib and a second rib;

a second side including a third rib and a fourth rib, the first rib and the third rib forming a first pair of ribs and the second rib and the fourth rib forming a second pair of ribs; and a first opening, wherein the first attachment area protrudes inward from the first back surface between the first side and the second side, forming an indentation in the first back surface to which a handle is attachable; and a second portion including:

a second back surface;

a third side including a fifth rib;

a fourth side including a sixth rib, the fifth rib and the sixth rib forming a third pair of ribs; and a second opening, wherein a first indented corner formed by the second back surface and the third side forms a second attachment area for a first wheel, wherein a second indented corner formed by the second back surface and the fourth side forms a third attachment area for a second wheel, and wherein the third pair of ribs aligns with a selected one of the first pair of ribs or the second pair of ribs to removably affix the first portion to the second portion to form the modular luggage frame, the third pair of ribs aligning with the first pair of ribs to form the modular luggage frame of a first size, and the third pair of ribs aligning with the second pair of ribs to form the modular luggage frame of a second size, the modular luggage frame aligning the first back surface and the second back surface and the first opening and the second opening when the first portion and the second portion are removably affixed.

2. The modular luggage frame of claim 1, further including a movable handle attachable at the first attachment area.

3. The modular luggage frame of claim 2, wherein the movable handle is removably affixed to the first portion using a lock box at the first attachment area.

4. The modular luggage frame of claim 3, wherein the movable handle is an articulating handle on a shaft movable with respect to the first portion.

5. The modular luggage frame of claim 4, wherein the shaft is lockable using a locking collar.

6. The modular luggage frame of claim 1, further including a plurality of wheel assemblies.

7. The modular luggage frame of claim 6, wherein the plurality of wheel assemblies are removably affixed to the second portion at respective attachment areas including the second attachment area and the third attachment area.

8. The modular luggage frame of claim 1, further including a cover positioned around the affixed first portion and second portion to enclose the first and second openings.

9. The modular luggage frame of claim 1, wherein the first portion further includes a fourth pair of ribs, the fourth pair of ribs, when selected, to engage with the third pair of ribs to form the modular luggage frame of a third size.

10. The modular luggage frame of claim 1, wherein the ribs taper from the respective back surface toward the respective opening.

11. The modular luggage frame of claim 1, wherein at least one of the first portion or the second portion includes a mixture of polycarbonate and acrylonitrile butadiene styrene material.

12. The modular luggage frame of claim 1, wherein at least one of the first portion or the second portion is formed using injection molding.

* * * * *